US006283087B1

(12) United States Patent
Isaksen

(10) Patent No.: US 6,283,087 B1
(45) Date of Patent: Sep. 4, 2001

(54) ENHANCED METHOD OF CLOSED VESSEL COMBUSTION

(75) Inventor: Kjell Isaksen, 9737 SE. 41st St., Mercer Island, WA (US) 98040-4201

(73) Assignee: Kjell Isaksen, Mercer Island, WA (US)

( * ) Notice: Subject to any disclaimer, the term of this patent is extended or adjusted under 35 U.S.C. 154(b) by 0 days.

(21) Appl. No.: 09/324,089

(22) Filed: Jun. 1, 1999

(51) Int. Cl.[7] ..... F02B 53/02
(52) U.S. Cl. ..... 123/243; 123/212; 123/214
(58) Field of Search ..... 123/243, 212, 123/214

(56) References Cited

U.S. PATENT DOCUMENTS

| | | | | |
|---|---|---|---|---|
| 1,686,767 | * | 10/1928 | Saxon | 123/243 |
| 2,728,330 | * | 12/1955 | Petersen | 123/243 |
| 3,762,844 | | 10/1973 | Isaksen | 418/218 |
| 3,961,483 | | 6/1976 | Wiley | 60/616 |
| 4,653,446 | | 3/1987 | Frasca | 123/244 |
| 5,429,084 | | 7/1995 | Cherry et al. | 123/243 |
| 5,524,586 | * | 6/1996 | Mallen | 123/243 |
| 5,836,282 | * | 11/1998 | Mallen | 123/243 |

OTHER PUBLICATIONS

"Regi U.S. Inc. Receives Patent on Revolutionary Rand Cam™ Engine," *Wall Street Edge Issue III*(1).

Sauter, J., "Investigation of Atomization in Carburetors," Technical Memorandums, National Advisory Committee for Aeronautics, in *Zeitschrift des Vereines deutscher Ingenieure,* 1928.

Brokaw, R.S., *Selected Combustion Problems, II,* Buttersworths Scientific Publications, London, 1956, "Thermal Ignition, With Particular Reference to High Temperatures," pp. 115–138.

Froede, Walter G., "The NSU–Wankel Rotating Combustion Engine," *NSU Notorenwerye A.G.,* Germany, pp. 179–193, 1960.

Laderman, A.J. and A. K. Oppenheim, "Initial Flame Acceleration In An Explosive Gas," *USAF/NASA Grant NSG–10–59,* vol. 268:153–180, 1961.

"Study on Minimization of Fire and Explosion Hazards in Advanced Flight Vehicles," *ACD Technical Report,* 61–288, Oct. 1961.

Kerley, R. V. and K. W. Thurston, "The Indicated Performance of Otto–Cycle Engines," *SAE Transactions 70:* pp. 5–37, 1962.

(List continued on next page.)

*Primary Examiner*—Michael Koczo
(74) *Attorney, Agent, or Firm*—Seed Intellectual Property Law Group PLLC

(57) ABSTRACT

In a spark ignition (SI) turbine engine, the combustible fuel-air mixture is compressed by volume displacement and accelerated at high velocity into the ignition source, to reduce the combustion time relative to conventional SI engines, lowering the lean fuel-air mixture flammability limit. Increased process velocity reduces the time exposure of the compressed fuel-air mixture to combustion, permitting near adiabatic operation without pre-ignition. Reducing the time exposure of the combustible gases to high combustion temperatures may reduce emission of oxides of nitrogen. The best power combustion velocity may be maintained throughout the fuel-air mixture range. Lean fuel-air mixture operation may result in fuel savings without a corresponding loss of power, and may reduce carbon dioxide emissions. The high speed operation may provide a quieter engine. An expander or a turbine may recover some of the exhaust energy loss associated with near adiabatic combustion.

44 Claims, 23 Drawing Sheets

OTHER PUBLICATIONS

Kuchta et al., "Flammability and Autoignition of Hydrocarbon Fuels Under Static and Dynamic Conditions," Report of Investigations 5992, U.S. Bureau of Mines, Department of the Interior, pp. 1–21, 1962.

Brewster, B. and R. V. Kerley, "Automotive Fuels and Combustion Problems," in *SAE National West Coast Meeting 725C,* Seattle, Washington, Aug. 19–22, 1963, pp. 1–21.

Zabetakis, M.G., "Fire and Explosion Hazards At Temperature and Pressure Extremes,"A.I.Ch.E.–I.Chem.E. Symposium Series (2), London, 1965, pp. 99–104.

Kuchta, J.M. and R.J. Cato, "Hot Gas Ignition Temperatures of Hydrocarbon Fuel Vapor–Air Mixtures," Report of Investigations 6857, U.S. Bureau of Mines, Department of the Interior, pp. 1–14, 1966.

Slutsky et al., "An Analysis of Hydrocarbon–Air Combustion Flames," AIAA Second Propulsion Joint Specialist Conference, Colorado Springs, Jun. 13–17, 1966, pp. 1–21 + Figures and Tables.

Anderson, Griffin Y. and Allen R. Vick, "An Experimental Study of Flame Propagation in Supersonic Premixed Flows of Hydrogen and Air," NASA, 1968, Clearinghouse for Federal Scientific and Technical Information, Springfield, Virginia, pp. 1–21, 1968.

Zajac, L.J. and A.K. Oppenheim, Dynamics of an Explosive Reaction Center, *AIAA Journal 9*(4):545–553, 1971.

Mizutani, Y. and T. Nishimoto, "Turbulent Flame Velocities in Premixed Sprays, Part I: Experimental Study," *Combustion Science and Technology 6:*1–10, 1972.

Ferri, A. and A. Agnone, "$No_x$Formation By Hydrogen Burning Engines," Grant No. NGR–33–016–131, *NASA,* pp. 1–13 + Figures, 1973.

Grobman et al., "Aeronautical Propulsion," Proceedings of the Conference held at Lewis Research Center, Cleveland, Ohio, May 13 and 14, 1975, Part IV., "Combustion and Emissions Technology," Scientific and Technical Office, NASA,, Washington, D.C.

Heywood, J.B., Progress in Energy and Combustion Science, vol. 1, Pergamon Press, Oxford, 1976, "Pollutant Formulation and Control In Spark–Ignition Engines," pp. 135–164, 1976.

Gallopoulos, N.E., "Alternative Fuels For Reciprocating Internal Combustion Engines," *Alternative Hydrocarbon Fuels: Combustion and Chemical Kinetics 62:*74–115, 1977.

Hall, A. R. and J. Diederichsen, "An Experimental Study of the Burning of Single Drops of Fuel in Air At Pressures Up To Twenty Atmospheres," RAE Report No. 105, Rocket Propulsion Department, Ministry of Air, England, pp. 837–845.

* cited by examiner

ENHANCED METHOD OF CLOSED VESSEL COMBUSTION

BACKGROUND OF THE INVENTION

With increasing oil prices and greater dependency in America on imported oil, engines with improved fuel economy provide tremendous benefits. In addition, carefully controlling the type and quantity of emissions from an engine can be important.

Mounting concerns about global warming are pointing to excess emission of air pollutants from combustion of hydrocarbons. Controlled emission gases are presently carbon monoxide, and excess hydrocarbons, both caused by excessively rich combustion. Emission of carbon dioxide can also be substantially reduced by introducing other hydrocarbon fuels of a different hydrogen-carbon structure.

A substantial amount of fuel can be saved if the spark ignition (SI) engines can be made to operate on much leaner fuel-air ratios without a substantial loss in engine power and potential flame out. The thermal operating efficiencies of many engines are poor, and little progress has been made in improvements the last several years.

In Otto-cycle engines, fuel and air are mixed outside the combustion chamber and ignited by an electric spark after compression. This brings the local fuel-air mixture above the autoignition temperature to start the combustion, which then takes place over a small change in combustion chamber volume. In a Diesel-cycle air is compressed alone in the combustion chamber to a high pressure and temperature level. This brings the air temperature above the autoignition temperature, fuel is injected into the combustion chamber directly and atomized to penetrate part of the combustion volume. The fuel-air mixture is ignited by the hot air, and combustion takes place in the chamber during continued fuel injection and combustion chamber volume expansion, which simulates constant pressure combustion to some degree.

In an Otto-cycle engine, a relatively homogeneous fuel-air mixture penetrates the combustion chamber and is combusted almost completely according to the fuel-air mixture and the local mixture temperatures. In a Diesel-cycle engine, a stratified, locally rich, fuel-air mixture is enclosed by excess air, which receives heat from the compression of the air. It is therefore obvious that combustion in a Diesel engine can take place in an overall very much leaner fuel-air mixture than an Otto engine combustion chamber, where the combustion flame must penetrate the combustion chamber completely. The entire fuel-air mixture must be within the flammability limit and above the autoignition temperature to consume all the fuel. The fuel-air mixture is compressed together in an Otto engine. Care must therefore be taken to prevent a premature start to combustion, caused by hot spots or excessive compression temperature above the autoignition temperature level. This makes it almost impossible to use a conventional Otto engine cycle in adiabatic or near adiabatic type of operation, where the combustion chamber wall temperature spots may reach autoignition levels.

The problem of premature autoignition or pre-ignition in an Otto engine is solved by using high octane fuels for combustion. FIG. 1 from Technology Reference (Tech. Ref.) 1 shows autoignition temperatures for unsaturated mixtures of low octane JP-4 and high octane AVGAS 115/145 and air at atmospheric pressure versus low flow velocities. For saturated mixtures at stagnant or low flow velocities the autoignition temperatures are lower. The figure shows the autoignition temperatures of the high octane fuel-air mixture to be some 200 degrees Fahrenheit higher than the low octane one. These values are typical for groups of similar fuels. The figure also shows that the fuel-air mixture flow velocity can compensate for lack of octane rating. Ignition delays for the low octane fuel show about 10 seconds at the lowest temperature level without flow. This reduces to 0.2 second at 1200 degrees Fahrenheit at fuel-air mixture flow velocities of about 18 ft/sec. Combustion time at constant pressure combustion is normally 30 times longer than the ignition delay, which suggests a very slow reaction. The important message here is that the combustion rate is enhanced substantially when conducted in a flow.

FIGS. 2 and 3 in the illustrations from Tech. Ref. 2 show the engine thermal efficiency and indicated power in a single cylinder reciprocating piston engine in Otto-cycle operation as functions of equivalence ratios for methanol and gasoline fuels. FIGS. 2 and 3 show that a standard mixture of gasoline and air will not ignite and burn beyond an equivalence ratio of about 0.8 unless turbulence is introduced. In that case, the flammability range may improve to an equivalence ratio of about 0.7 by improved mixing and with turbulence. Methanol, however, in the standard mixture will ignite and burn to an equivalence ratio of about 0.68, and for an improved mixture with turbulence to an equivalence ratio of about 0.6. There are some differences between gasoline and methanol in combustion performance. According to FIGS. 2 and 3, the stoichiometric mixture in the shown engine is found at an air-fuel ratio of 14.5 by mass of gasoline, while methanol has a stoichiometric mixture of 6.5. The flammability range of gasoline is given as 0.6 to 3.8 in terms of equivalence ratio, and for methanol as 0.45 to 4.2. More important might be the laminar flame speed, which for gasoline is given as 0.37 ft/sec, and for methanol 0.52 ft/sec. The adiabatic flame temperatures are about the same, and the heats of combustion are in the same ratio as the stoichiometric fuel-air ratios.

FIG. 2 further shows that some improvement in thermal efficiency is available at lower equivalence ratio operations. This is at the expense of indicated power, as seen from FIG. 3.

FIGS. 2 and 3 of the illustrations show little improvement in the lean flammability limit in a single cylinder reciprocating piston internal combustion engine due to compression of the fuel-air mixture compared with standard values. The values of these figures compare with values cited for the same fuels at standard conditions in chemical handbooks as described in the Background section of this disclosure. Introduction of turbulence and flow into the fuel-air mixture on the other hand extended the low flammability limits to lower equivalence ratios. The level of turbulence available in a piston engine is very limited. If a high degree of turbulence is sought, this can only be achieved with a very high flow velocity. Such a high flow velocity can only be reached in a closed vessel combustion chamber when the combustion chamber moves at a substantial velocity relative to the combustion chamber boundaries. This type of movement was introduced to a very moderate degree in the Wankel engine, but this engine suffered from slow combustion probably due to low ignition temperature and positioning of the igniter plug.

In the Wankel engine, the fuel-air mixture moves at travel speeds up to 30 ft/sec relative to the stator. In the combustion chambers in a gas turbine engine the flow velocity is rarely more than 70 ft/sec.

Information and data used in this disclosure are based on data and illustrations taken from the cited Technology References (Tech. Refs.) to describe and substantiate the technology basis for the observations made and the methods used.

CHEMISTRY OF COMBUSTION

One fuel used throughout history is coal. The chemical reaction of coal in a combustion process of free carbons is the following:

$$1 \text{ kg } C+2.67 \text{ kg } O_2=3.67 \text{ kg } CO_2+7.777.8 \text{ kWh/kg}$$

Coal is available in nature in many forms which may also contain other chemicals not participating in the combustion process per se, but capable of polluting the atmosphere. One of these of these is sulfur, which causes acid rain and destruction of the forests. A large amount of particulate is also emitted. The heat release from coal combustion is moderate.

It is clearly seen that for each kilogram of free carbon combusted, 3.67 kg of carbon dioxide is emitted.

Another fuel is hydrogen, which is not a solid or a liquid, but a gas at normal temperatures and pressures. Hydrogen in combustion with oxygen reacts as follows:

$$1 \text{ kg } H_2+8 \text{ kg } O_2=9 \text{ kg } H_2O+34,444.5 \text{ kWh/kg}$$

Since hydrogen emits only water, it must be regarded as the ultimate type of clean fuel. The availability and distribution of hydrogen gas, however, is not presently as advanced as that of gasoline.

The most common fuel in use for automotive operation is octane, which reacts in combustion with oxygen in the following manner:

$$C_8H_{18}+12.5\ O_2=8\ CO_2+9\ H_2O+10,642.2 \text{ kWh/kg}$$

There is a small gain in mass during the combustion. This varies according to the fuel reacted, but otherwise this can be balanced in atomic weights as shown:

$$[8(6)+(18)]+[12.5(6)+(32)]=8[(6)+(32)]+9[(2)+(16)] \text{ or } 1 \text{ kg } C_8H_{18}+6.06 \text{ kg } O_2=4.61 \text{ kg } CO_2+2.45 \text{ kg } H_2O+10,642.2 \text{ kWh/kg}$$

It is here seen that one kg octane will produce 4.61 kg carbon dioxide. Compared with coal, which produced 3.67 kg carbon dioxide per kg combusted, this is no improvement. Since the heating value of the octane is higher than for carbon, octane will produce less carbon dioxide per unit power produced, or:

$$CO_2=(4.61/3.67)(7,777.8/10,642.2)\ CO_2=0.918 \text{ times that of coal.}$$

Most motor vehicles are presently powered by Otto-type positive displacement spark ignition internal combustion (SI) engines operating on gasoline, which is quite close to octane. The large numbers in operation in many locations contribute excessively to the loading of the atmosphere with carbon dioxide. Other pollutants from combustion are carbon monoxide, and unburned vapors of gasoline either from volume displacement or from lack of oxygen in the combustion process.

An emission test conducted on a 480 kW gas turbine engine operating on JP-1 gas turbine fuel showed the following result:

TABLE 1

| Parameter | g/kg | ppm | kg/hr |
|---|---|---|---|
| $CO_2$ | 3,150.0 | — | 545.5 |
| CO | 1.34 | 23.1 | 0.23 |
| $NO_x$ | 11.5 | 120.1 | 1.98 |
| Excess Hydrocarbon | 0.04 | 1.2 | 0.04 |

It is here seen that when 1 kg of JP-1 is combusted 3.150 kg of carbon dioxide is emitted with the exhaust. If that gas turbine operated at full power level for a year, the engine would emit some 4,778.6 tonnes (metric tons) of carbon dioxide. If a large number of similar engines operated in the same area, they could together seriously alter the composition of the atmosphere locally. It is therefore essential to identify and introduce means to reduce emission of carbon dioxide per unit power produced, develop economic means of power generation or develop better alternate fuels or both.

Natural gas emitted from oil or gas wells during drilling or pumping of oil has the following composition:

TABLE 2

| Gas Type | Fraction |
|---|---|
| Methane | 72.3% |
| Ethane | 14.4 |
| Nitrogen | 12.8 |
| Carbon dioxide | 0.5 |

Natural gas is very abundant in supplies during pumping of the oil and gas wells, and it is often flared off or pumped back into the well, beside being used for many heating applications. The combustion reaction of methane and oxygen from air is:

$$CH_4+2O_2=CO2+2H_2O+12,324.5 \text{ kWh/kg}$$

or in atomic weight:

$$[(6)+4(1)]+[2(32)]=[(6)++(32)]+2[(2)+(16)][10]+[64]=[38]+[36]$$

This means that for each kg of methane combusted 3.8 kg of carbon dioxide is emitted. This is somewhat better than by using gasoline, which emitted 4.61 kg carbon dioxide per kg fuel. Compared with gasoline methane has a 15.2% higher heating value, and it will therefore consume less fuel to produce the same power if the combustion is conducted correctly. The amount of carbon dioxide emitted on equal power basis is therefore:

$$CO_2=(38/10)(10,642.2/12,324.5)=3.28 \text{ kg } CO_2/\text{kg fuel.}$$

or a reduction of emission of $CO_2$ compared with gasoline of some 29 per cent.

Methanol is also used as an alternative fuel in automotive applications, but methanol is expensive, and the heating value is less than half that of gasoline. Methanol is also very corrosive, but it is still a viable fuel in this study. The combustion reaction of methanol with oxygen is:

$$CH_3OH+1.5O_2+5.65\ N_2=CO_2+2H_2O+5.65\ N_2+4,928.7 \text{ kWh/kg}$$

or in atomic weight:

$$[(6)+(3)+(16)+(1)]+1.5[(32)]=[(6)+(32)]+2[(2)+(16)][26]+[24]=[38]+[36]$$

It is seen that the nitrogen does not participate in the combustion reaction, and that the amount of carbon dioxide on equal power basis with gasoline is:

$$CO_2=(38/26)(10,642.2/4.928.7)=3.155 \text{ kg/kg fuel,}$$

which is about 31% better than gasoline, and about the same as jet fuel.

There are other alcohols and fuels available for motor use, which could be compared with methane and gasoline on equal power output basis. So while methanol appears good from an emission of carbon dioxide weight conversion point of view, the situation is less favorable on an equal power basis, which is another main basis for comparison.

Normal air is composed of the following gases by weight:

TABLE 3

| Component | Fraction |
|---|---|
| Nitrogen | 75.54% |
| Oxygen | 23.14 |
| Argon | 1.27 |
| Carbon Dioxide | 0.05 |
| Neon | 0.0112 |

To gain some understanding of how we load the atmosphere with carbon dioxide it was reported that in 1986, the U.S. consumption of crude oil amounted to:

TABLE 4

| Oil Use | Million Barrels |
|---|---|
| Cars and Light Trucks | 2,360 |
| Heavy Trucks | 540 |
| Civilian Airplanes | 310 |
| Industrial Process Heat | 772 |
| Space and Water Heating | 1,485 |

One barrel of crude oil equals $1.1924\times10^{-1}$ $m^3$, and its specific gravity is probably about 0.9 tonnes/$m^3$. The world production amounted in 1993 to 67 million barrels per day and is increasing by 2.3% per year. Without serious innovations it will be impossible to reduce the concentration of carbon dioxide in the atmosphere. In addition, 892.2 million short tons of coal was consumed and 2.16 quadrillion Btu of natural gas. It therefore takes a very forgiving atmosphere to absorb the man made carbon dioxide without loading it to toxic levels. All hydrocarbon combustion reactions produce carbon dioxide.

This patent specification discusses how to produce power at a substantially lower specific fuel consumption, and thereby also reduce the amount of carbon dioxide and other pollutants emitted into the atmosphere.

SUMMARY OF THE INVENTION

The basis for this patent disclosure is the discovery and application of a new and useful manner of executing a high speed process operation in closed vessel internal combustion and by that advancing the state of the art. The methods described in this disclosure deal with combustion dynamics developed to meet specific operating requirements over and beyond the state of the art in engine technology. The usefulness of the described methods will become more evident in the rest of this disclosure. The new method of closed vessel combustion disclosed in this specification is compatible with the heat engine described in U.S. Pat. No. 3,762,844. The complete inventive flow path of the new process is included in this disclosure.

The disclosed advanced method of combustion and its flow path operation may achieve some or all of the following objectives:

- to ensure a very fast type of closed vessel combustion for engines with very fast process operations;
- to ensure combustion at very low equivalence ratios to improve engine full and part power operations and reduce emission of pollutants;
- to ensure that near adiabatic engine operation can be achieved with fuel and air mixed externally to the engine;
- to ensure that near adiabatic operation will not result in excessive emission of oxides of nitrogen;
- to ensure multi-fuel operation with no regard for fuel octane values;
- to investigate the potential for engine power performance enhancement and exhaust temperature reduction by exploiting excess exhaust gas heat and pressure;
- to explore alternative configurations for engine torque and power enhancement;
- to reduce the specific fuel consumption and thereby the emission of carbon dioxide substantially; and/or
- study the effects of alternative fuels on emission of carbon dioxide.

There is a lean limit in homogeneous fuel-air mixture strength, beyond which, fuel-air mixtures will not ignite and burn. The lean flammability limit is important in energy conversion both from economic and environmental considerations. One objective of this disclosure is to show how the lean flammability limit can be moved to leaner values in some closed vessel or positive displacement internal combustion engines and maintain a high rate of heat release and the benefits that may result.

In the improved versions and process of this invention which can be used in the engine described in U.S. Pat. No. 3,762,844, the combustion mixture reaches velocities up to 920 ft/sec. Experimental data show that combustion can be conducted at even higher flow velocities in homogeneous fuel-air mixtures at atmospheric pressure, if turbulence is created by some flame holder to prevent the flame from blowing out, according to the invention.

The introduction of flow into the combustion process means that the process is intensified and will release more heat energy in a shorter time interval. This means that the pressure and temperature peaks in combustion will be more composed and reach higher values and can be better directed to the most beneficial timing position. This also means that as much power can be developed in lean mixture combustion as in the rich mixture best power fuel-air ratio.

High velocity combustion is heavily dependent on the availability of a vortex or a flame holder in the mixture flow to prevent the fast combustion flame from blowing out. Combustion through a small passage is also subject to heat quenching and loss of combustion Mach number, which is described in this disclosure.

Operation of a fast running engine in which compression and combustion take place in a very short time span also introduces several other benefits. These include a near adiabatic operation capability with an externally prepared fuel-air mixture, multi-fuel combustion capability with high or low octane fuels, reduced emission of oxides of nitrogen, and extremely good engine performance and a small packaging size.

These also include externally mixed air and fuel of whatever octane value is used. This is achieved by means of careful manipulation of combustion chamber leakage rates and ignition delays to meet the intended objectives.

Adiabatic operation means that more heat is available for conversion to power in the engine, but it also means that more heat is lost through the exhaust. To compensate for this added exhaust loss with its associated high noise level, more heat can be extracted and the noise reduced by means of an exhaust gas turbine or expander until the exhaust gas runs out of pressure. Further recovery can be made in a heat exchanger or other types of compounding arrangements.

The effect of increased combustion temperature in near adiabatic operation on formation of oxides of nitrogen in the described engines is more than offset by the very short residence time at the high gas temperatures due to the very fast process operation.

The overall results of applying the disclosed methods may include the development of heat engines with extremely high power/weight ratios, extremely good specific fuel consumption, extremely high power/air ratio, extremely high power outputs, extremely low levels of emission of air pollutants, and of extremely simple, although advanced, mechanical designs.

BRIEF SUMMARY OF THE DRAWINGS

The following drawings and illustrations are offered in support of this specification to describe the basic technology principles and the mechanical embodiments involved in achieving the intended combustion and power performance of the disclosed type of positive displacement internal combustion engines.

DESCRIPTION OF TECHNOLOGY

No combustion will arise in any fuel-air mixture until the conditions for combustion have been satisfied. Ignition for combustion can be induced by a hot surface, an open flame, by a hot gas jet, by an electric spark, or even by a pressure wave, if the ignition temperature is reached. If the ignition temperature is low, the ignition can be delayed and the following combustion can be slow.

Different fuels in combustible mixtures have different Autoignition or Spontaneous Ignition Temperatures, A.I.T. These may vary with the fuel-air ratio or fuel-oxygen strength, the pressure and gas temperature levels, and finally the velocity of the mixture, which also includes the turbulence level.

Figure 1:
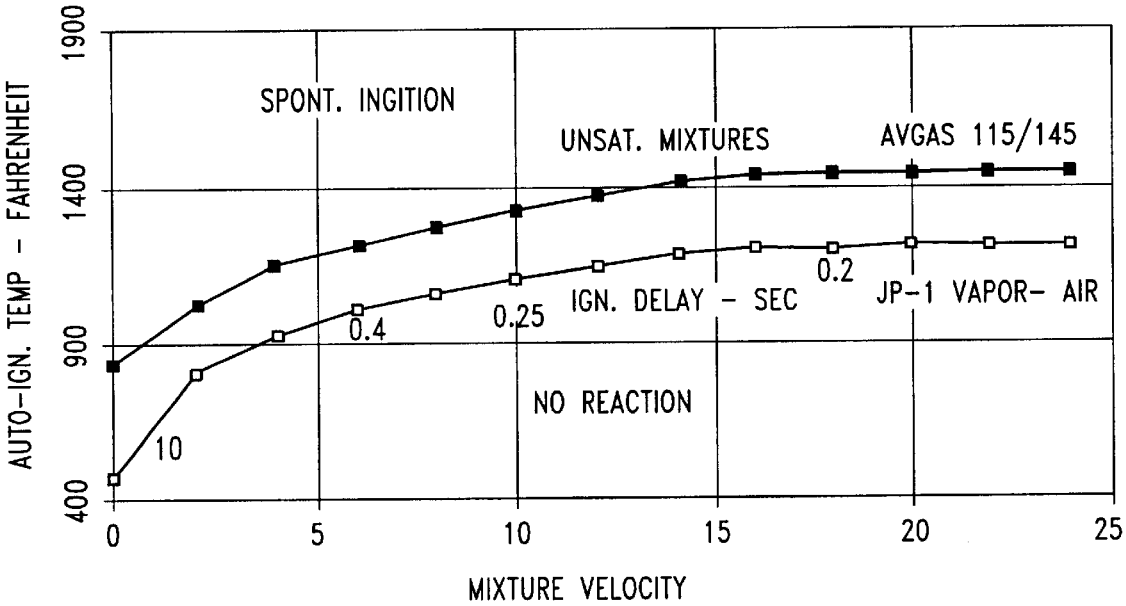
FIG. 1 illustrates Autoignition Temperatures and Ignition Delays of high octane AVGAS 115/145 and low octane JP-4 Unsaturated Vapor-Air mixtures versus Flow Velocity at one atmosphere pressure in a heated flow duct. Tech. Ref. 1.

FIG. 1 from Tech. Ref. 1 shows autoignition Temperatures versus Mixture Velocity for unsaturated mixture of low octane JP-4 and high octane AVGAS 115/145. Ignition delay values in seconds are shown along the JP-4 vapor-air curve. The figure clearly shows that the difference in autoignition temperatures of the two fuels easily can be compensated for by the introduction of flow into the mixture. This also shortens the ignition delay and by that the combustion time.

Figure 2:
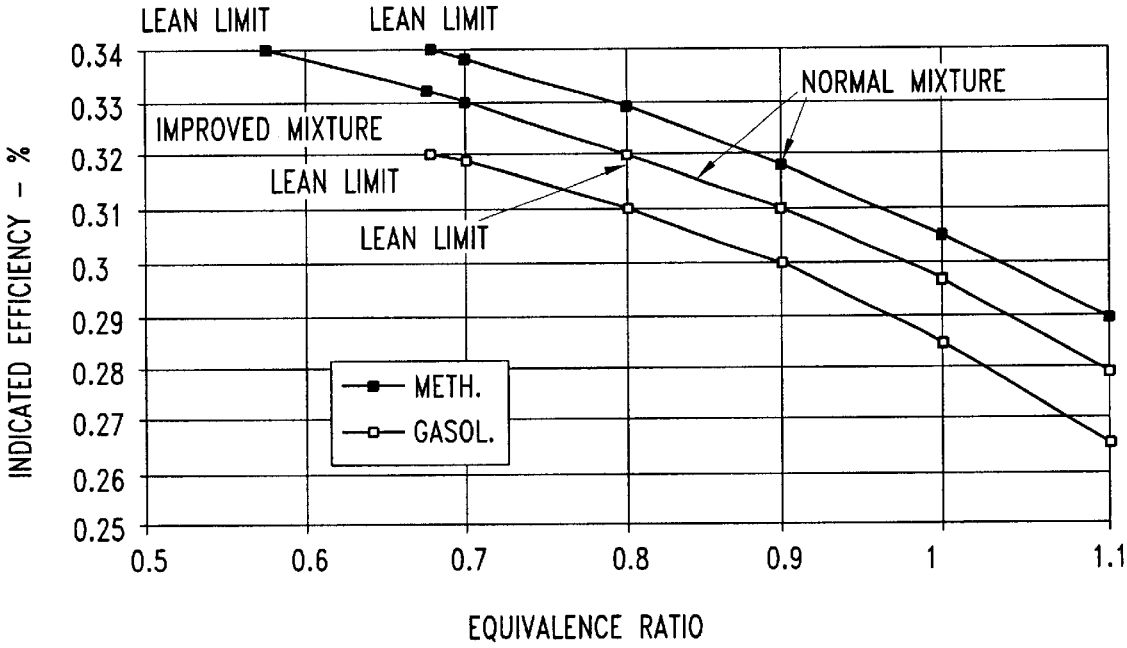
FIG. 2 illustrates Indicated Thermal Efficiency of a single cylinder reciprocating piston engine versus Equivalence Ratio in operation on Methanol and Gasoline fuels. Tech. Ref. 2.
Figure 3:
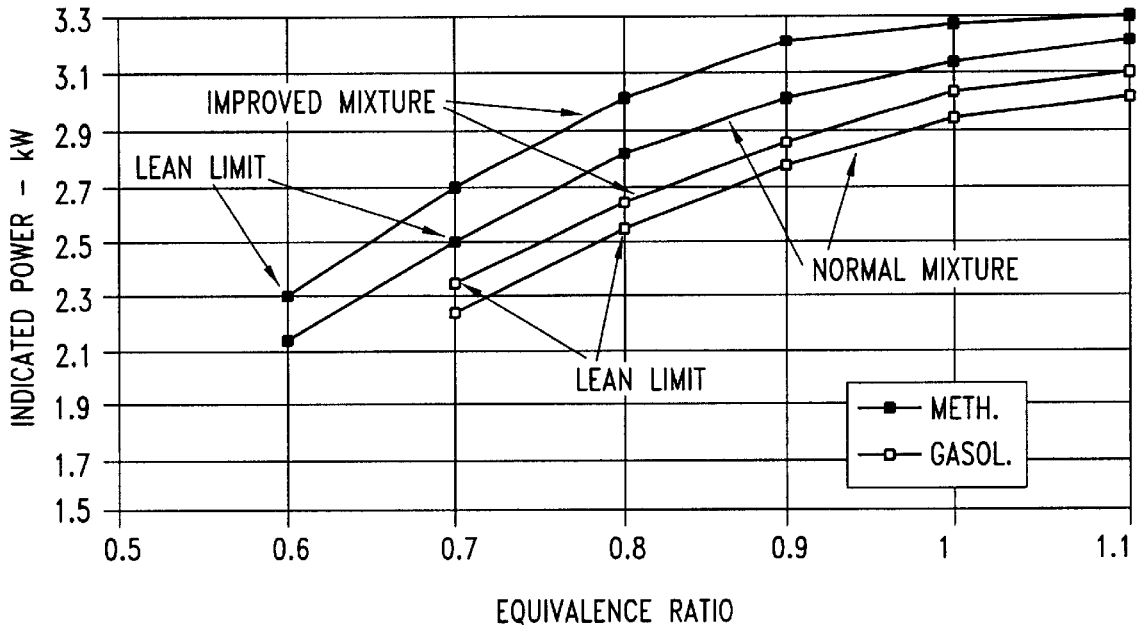
FIG. 3 illustrates Indicated Power of a single cylinder reciprocating piston engine versus Equivalence Ratio in operation on methanol and gasoline fuels. Tech. Ref. 2.

For a single cylinder reciprocating piston type internal combustion engine, it is seen from FIGS. 2 and 3 from Tech. Ref. 2, that the lean flammability limit in terms of equivalence ratio is also influenced by the turbulence level of the fuel-air mixture. Even so, the shown normal mixture lean equivalence ratio limits are barely comparable with the basic values quoted for the same fuel-air mixture at rest in chemical textbooks.

Some engines, such as diesel engines and gas turbines, can operate at very low equivalence ratios. In diesel engines, fuel is injected into air compressed to temperatures beyond autoignition levels. When the fuel is atomized, it will oxidize a stratified rich region of the fuel-air mixture, which is later diluted into an overall very lean fuel-air mixture. In a gas turbine, fuel can be oxidized at rich fuel-air ratios in the burner section of the combustion chamber. Cooling air is then introduced to dilute the products of combustion to combustion gas temperature levels acceptable for the turbine inlet guide vanes.

Figure 4:
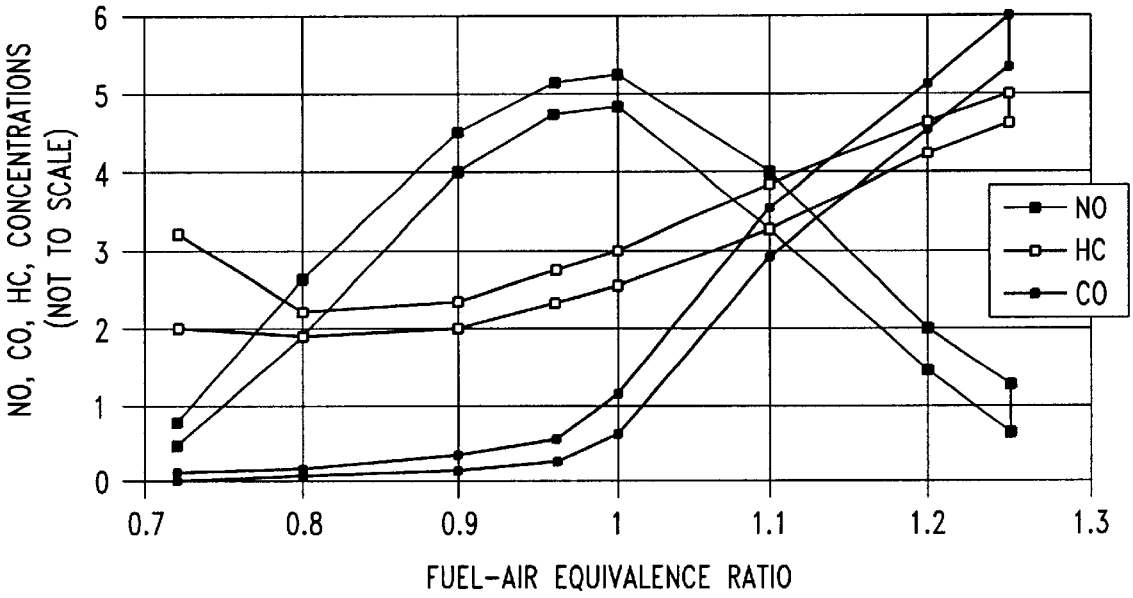
FIG. 4 illustrates variations of HC, CO, and NO concentrations of a Conventional Reciprocal Piston SI Engine with Fuel-Air Equivalence Ratio, Tech. Ref. 4.

FIG. 4 from Tech. Ref. 3 shows how various products of combustion emitted from an internal combustion piston type engine vary with the equivalence ratio. Operation in lean fuel-air mixture causes lower levels of the shown pollutants to be emitted. These curves will improve if the lean fuel-air mixture flammability limits moved toward even leaner values.

Figure 5:
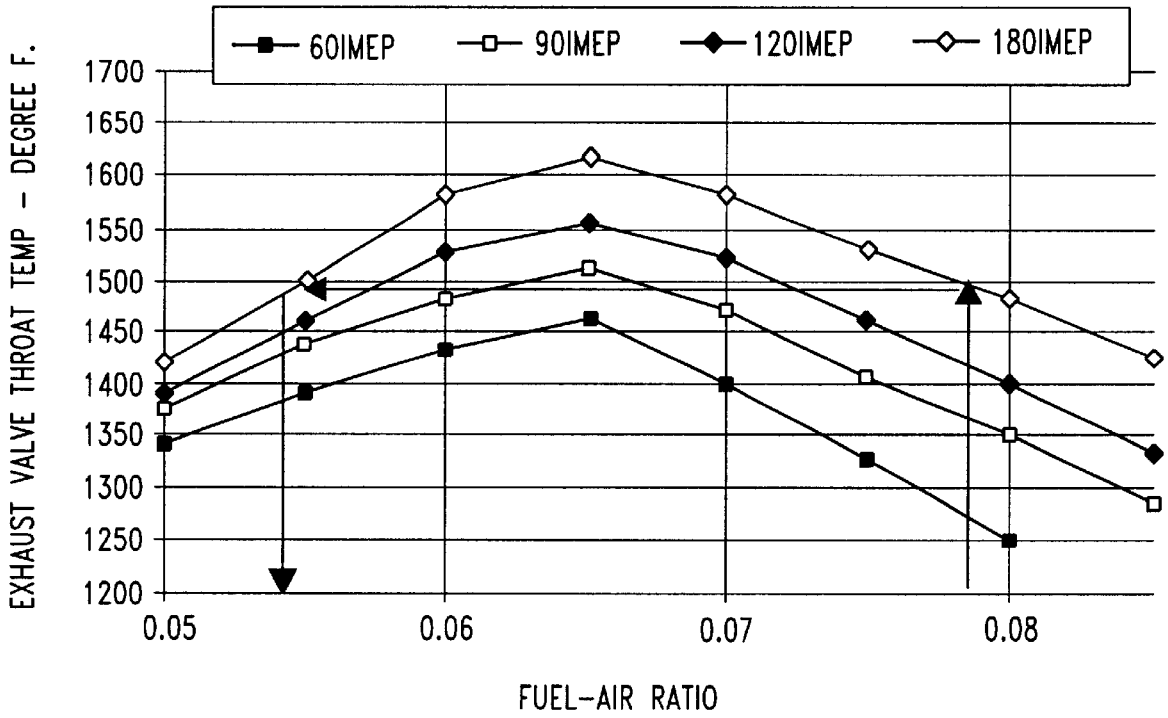
FIG. 5 illustrates the Effect of Fuel-Air Ratio on Exhaust Valve Throat Temperature at Four Constant IMEP Levels.

FIG. 5 from Tech. Ref. 12 shows the exhaust throat valve temperature for a reciprocating piston type internal combustion engine at four constant Indicated Mean Effective Pressure (IMEP) levels. Select now the 180 IMEP line as a starting point and mark the rich mixture fuel-air ratio of 0.0782 on the IMEP line. If the combustion velocity can be maintained, there will be another point at a fuel-air ratio of approximately 0.054, which has the same release of heat energy. This is very near the or beyond the flammability limit for reciprocating piston engines. Since the combustion velocity in this area is normally slow, much less power will be generated. The object is to reinstate the best power combustion velocity or better, to extract the same power for these points in both rich and lean fuel-air mixtures.

The problem is how a premixed, homogeneous fuel-air mixture in a closed vessel combustion chamber can be made to combust at equivalence ratios leaner than the normal lean flammability limit, to achieve the advantages such an operation entails. Lean fuel-air mixture combustion is preferred for reduced fuel consumption and lower emission of air pollutants. The most important pollutant in mass emitted by most combustion reactions is carbon dioxide, which is emitted according to the molecular structure of the fuel used and in quantities mostly exceeding the amount of fuel used in the engine.

Figure 6:
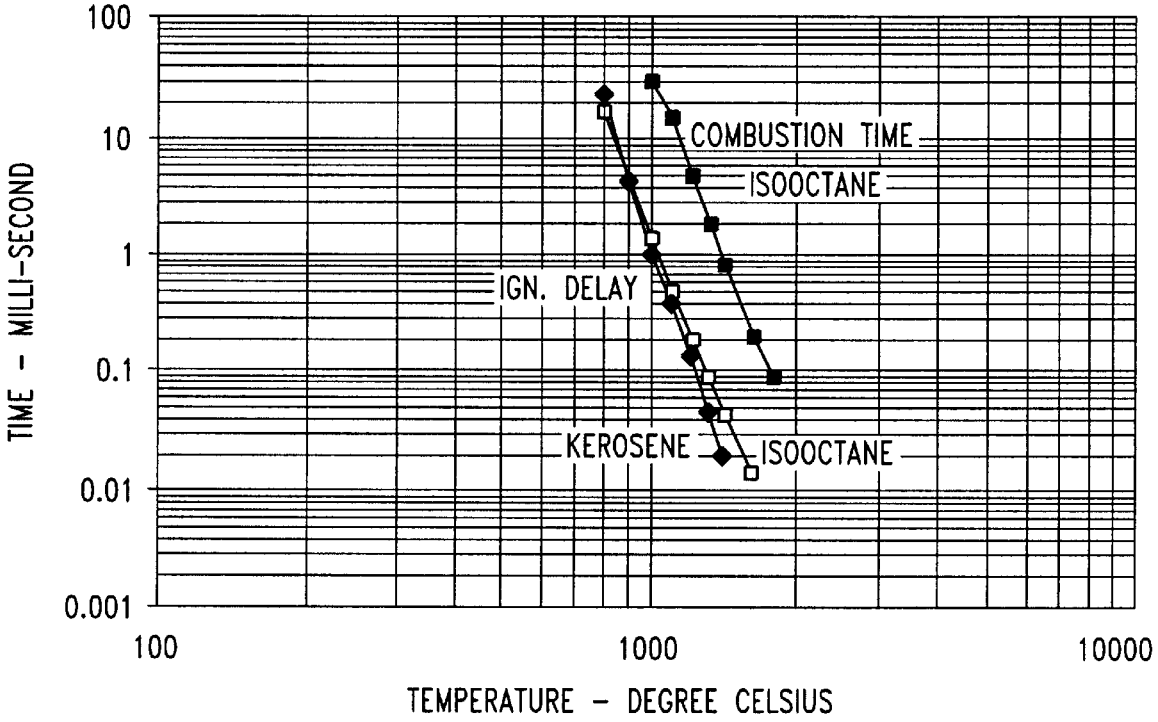
FIG. 6 illustrates a comparison of Ignition Delays and Combustion Times versus gas temperature for low octane Kerosene and high octane IsoOctane or Gasoline. Tech. Ref. 4.

FIG. 6 from Tech. Ref. 4 shows the relationship between ignition delay and combustion time versus mixture or ignition temperatures for rich mixtures of low octane kerosene and high octane gasoline near or at rest. It is commonly accepted that it takes 30 times longer to complete combustion than it takes to ignite a mixture in constant pressure combustion. This figure clearly shows that as the ignition temperature increases, the ignition delays and combustion times become shorter.

Tech. Ref. 4 also says that a pressure increase in the lower pressure range affects the ignition delay to a power of −0.86 of the pressure ratio. An undisclosed source says that the combustion velocity varies with the pressure ratio to the power of −1.0 in the higher pressure range. Tech. Ref. 7 shows that for kerosene the exponent of −1.0 may be acceptable, while their experiments suggest that an exponent of −0.69 usually may be right. According to Tech. Ref. 4 the exponent for the pressure ratio could vary from −0.5 to −1.5 dependent upon the type of fuel involved. Some differences may be due to inaccuracies in the experimental data.

Tech. Ref. 8 was seeking a method for predicting basic flame speed and came up with the following relationship:

$$S_T = K/d(\phi - 0.012)(u)^{1.15} \text{ [m/sec]}$$

where $S_T$=turbulent flame velocity [m/sec]

K=constant (6800 for kerosene spray, 4300 for light diesel)

d=Sauter mean diameter [microns]

$\phi$=fuel-air ratio [g/g]

u'=turbulence intensity of approaching flow [m/sec]

The authors claim validity for the relationship for flame velocities up to 2.5 m/sec, fuel droplet diameters ranging from 30 to 100 microns, fuel-air ratios ranging from 0.015 to 0.05, and turbulence intensity of the approaching flow, u', up to 1.0 m/sec. The flow velocity is normally about 5 times or more higher than the turbulence intensity. The Sauter method for measuring droplet sizes is described in Tech. Ref. 9.

From the preceding reference it seems that the experiments established a stable flame at a fuel-air ratio of 0.015 in a homogeneous fuel-air mixture at low flow velocities, and by that at reasonable ignition temperature levels.

Combustion in a closed vessel or volume is quite different from combustion in an open flow tube because both pressure and temperature of the enclosed mixture increase as the combustion proceeds. Tech. Ref. 10 describes the minimum elapsed time for combustion of a fuel rich gasoline vapor in a spherical container at an initial gas temperature of 70 to 80 degrees Fahrenheit to be:

$$t_m = 75(V)^{1/3}$$

where $t_m$=minimum elapsed time [millisecond]

V=volume of spherical enclosure [$ft^3$]

Involved here is also, $S_u$, the maximum flame speed, obtainable for the temperature range considered. It is here obvious that different fuels have different constants according to their combustion times and ignition delay ratios, which is indicated here by the $S_u$ statement.

The technology described so far is sufficient to establish the combustion time in a spherical type combustion chamber in a reciprocating piston type internal combustion engine. The difference in combustion time between spherical, cylindrical, and plane type chambers is insignificant according to Tech. Ref. 11.

The difference between a reciprocating piston type internal combustion engine and the engine described in U.S. Pat. No. 3,762,844 in operation is that the combustion chambers in the latter move inside the stator at a substantial velocity. A flow velocity of at least 70 feet per second relative to the ignition source is sufficient to realize the advantageous disclosed herein, although such advantages can of course be realized with higher flow velocities, and may in some cases, be realized with lower flow velocities. This means that the mixture flow velocity relative to the stator wall and the rotor also must be considered as additional factors in establishing the ignition delay and combustion time. A method of accomplishing this was therefore developed.

Figure 7:
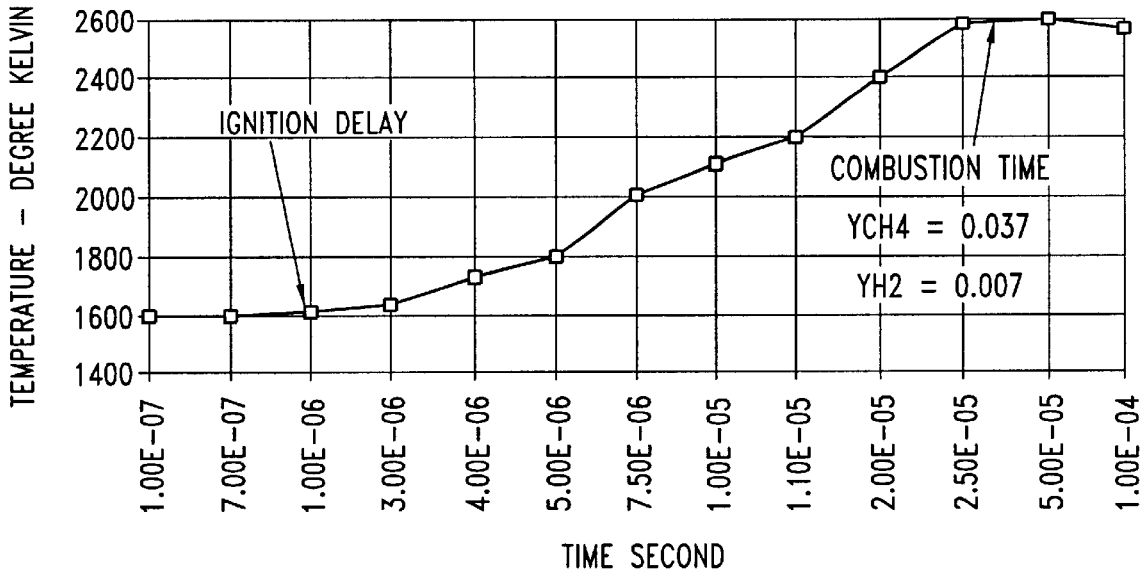
FIG. 7 illustrates a Histogram of Methane-air Ignition Delay and Combustion Time in a supersonic flow. Tech. Ref. 5.

FIG. 7 from Tech. Ref. 5 shows a histogram of combustion temperature in a flow tube with homogeneous fuel-air mixtures flowing at Mach. No. 1.5 and ignited by a central hydrogen-air flame serving as a flame holder and igniter. The histogram of the temperature development during the combustion shows that it took about $10^{-6}$ second to ignite the homogeneous mixture flow of methane and air at an ignition temperature of 1600 degrees Kelvin. The peak temperature of about 2600 degrees Kelvin shows the completion of the combustion at $3\times10^{-5}$ second. Even at this velocity the combustion time is about 30 times longer than the ignition delay. This combustion was conducted at constant atmospheric pressure.

Figure 8:
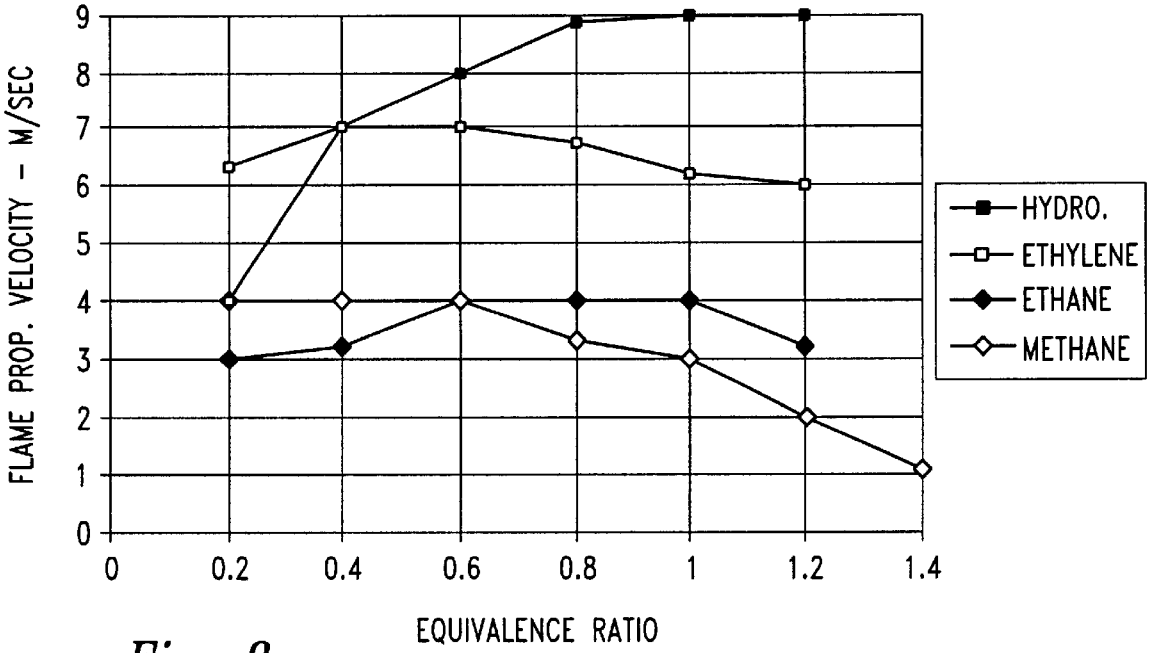
FIG. 8 illustrates Flame Propagation Velocities versus Equivalence Ratio for several gaseous fuels at Mach No. 1.5 mixture flow velocity. Tech. Refs. 5 and 6.

FIG. 8 shows the flame propagation velocities for various gaseous fuels as functions of the equivalence ratio at Mach. no. 1.5, as taken from Tech. Ref. 5. Tech. Ref. 6 used the same experimental apparatus and computed higher flame propagation velocities. Flame propagation velocity or flame speed is a computed value and can yield different results according to the theory used for its computation, as described in the references. It is here seen that hydrogen, methane, ethane, and ethylene at atmospheric pressure and an inlet stagnation temperature of 300 degrees Kelvin in a gas flow of indicated mixture strengths and a flow Mach. No. 1.5 or 1429 ft/sec (435 m/sec) can ignite and combust at extremely short times, while their flame propagation velocities remain quite low.

It is here noted that the lean static flammability limit for hydrogen quoted in chemistry texts is at an equivalence ratio of 0.1 based on weight. For methane they are 0.45 to 0.68, while the values at the lowest test points in Tech. Ref. 8 are shown to be near the equivalence ratio of 0.2. Since there is not much difference in flame propagation velocity over the shown range of equivalence ratios except for hydrogen, we must conclude that the fuel-air mixture in high relative motion stabilizes the flame speed. The combustion of most fuel-air mixtures will be little affected by their equivalence ratios with respect to ignition delay and combustion times. In other words, it will be possible to combust just as fast in lean fuel-air mixture as in rich or better fuel-air mixture. Thus, as long as the same quantity of heat is available, the same power will be available in specified rich and lean fuel-air mixtures.

Figure 9:
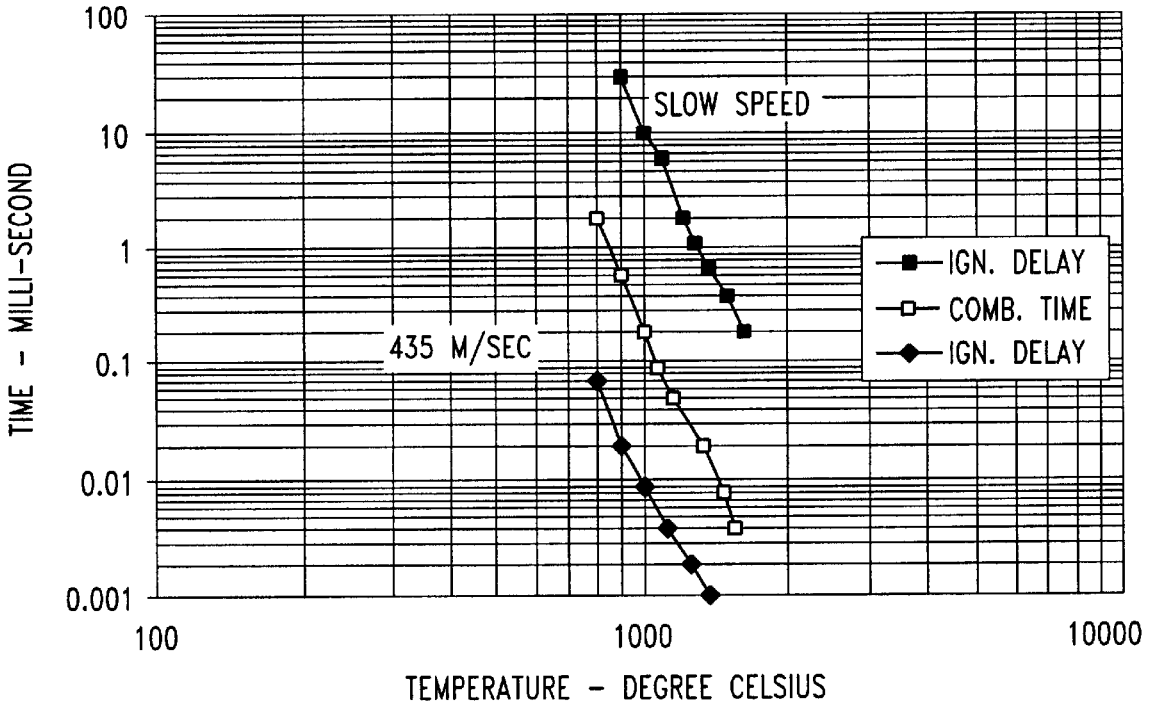
FIG. 9 illustrates the effect of High Flow Velocity on Ignition Delay and Combustion Time versus Temperature of a Methane-air in rich mixture. Tech. Refs. 5 and 6.

The ignition delay of a rich mixture of methane and air near rest is shown in FIG. 9 as taken from Tech. Ref. 5. On this figure a parallel line is drawn through the point at 0.001 millisecond and 1600 degrees Kelvin or 1327 degrees Celsius. The difference in flow velocity between the two lines with respect to ignition delay is about 1429 ft/sec (435 m/sec). Since the combustion time at constant pressure combustion is 30 times longer than the ignition delay, another parallel line can be drawn 30 times slower than the ignition delay line, at 1429 ft/sec or 435 m/sec flow velocity. The new line represents the combustion time in a methane-air flow velocity of about 1430 ft/sec. Intermediate velocity effects can be prorated between a low velocity case of about 18 ft/sec flow velocity and the drawn lines without much loss in accuracy. It can further be assumed that the velocity effects for other fuel-air mixtures will behave similarly to the velocity effects for methane and air. This situation could change if the oxygen content in the oxidizer is different. The described graphical method is used for the sake of simplicity to illustrate the various effects on ignition delays and combustion times.

From the described information it is possible to establish a factor for the combined effects of mixture pressure, temperature, and flow velocity on the rate of combustion in an identified fuel-air mixture. Such a factor can then be used in conjunction with the basic ignition delay and combustion times at normal atmospheric conditions to establish actual ignition delay and combustion times for a variety of pressure, temperature and flow velocity conditions.

It is also seen that a substantial shift takes place in the lean flammability mixture limit of fuels combusted in fast flowing air, in most cases toward a leaner fuel air mixture. Normal static lean mixture flammability limit for gasoline is found at an equivalence ratio of 0.60, and the flammability value of kerosene should be about the same.

Figure 10:
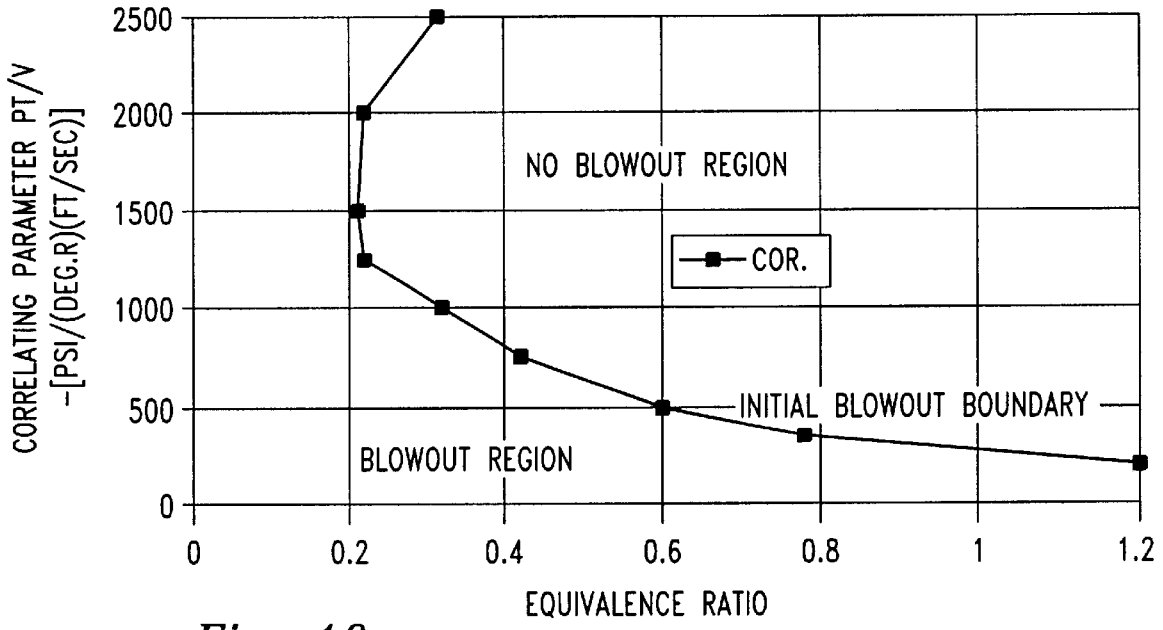
FIG. 10 illustrates a typical Gas Turbine Engine Combustion Chamber Blow-Out Boundary expressed as Equivalence Ratio versus a Correlating Factor PT/V.

FIG. 10 shows the equivalence ratio for kerosene versus the correlating factor, PT/V, for a typical gas turbine engine combustion chamber. This figure also confirms that the lean flammability limit has shifted to a lower value even at moderate flow velocities. The correlation parameter shown comprises mixture pressure, temperature, and a reference travel velocity. Stable combustion takes place inside the curve boundary. The combustion efficiency close to the curve is quite poor.

In most cases where combustion in high flow velocity mixtures is involved, the question of flame holders arises. A flame holder induces a disturbance intended to create turbulence or vortex to prevent the flame from blowing out. Very small disturbances may be involved. A vortex permits the flame to move back against the general flow direction and create a flashback. The flame holder in a gas turbine combustion chamber creates substantial turbulence. If combustion of fuel at a very high flow velocity is contemplated, it may be necessary to create a vortex for holding the flame or allow some flashback into the upstream flow region.

The teachings of this technology description on combustion show that ignition delays and combustion times are functions of the type of fuel, oxidizing agent, fuel droplet size, turbulence level and travel velocity, and finally ignition temperature, pressure, and fuel energy level.

The following section will describe in more detail how the objectives for this engine type are pursued and introduce further technology necessary to meet these objectives. The philosophy here is that high speed operation has special advantages, which have not been used in the past. As high speed operation introduces its own problems, it becomes necessary to pursue technology not previously developed but which this invention teaches.

Method of Application

To extract work from fuel, an oxidation process called combustion is conducted. In compression ignition engines combustion is conducted at elevated pressures and temperatures with fuel separately injected into the compressed air by some mechanical means. Work is extracted from the combusted gases during gas expansion.

Figure 11:
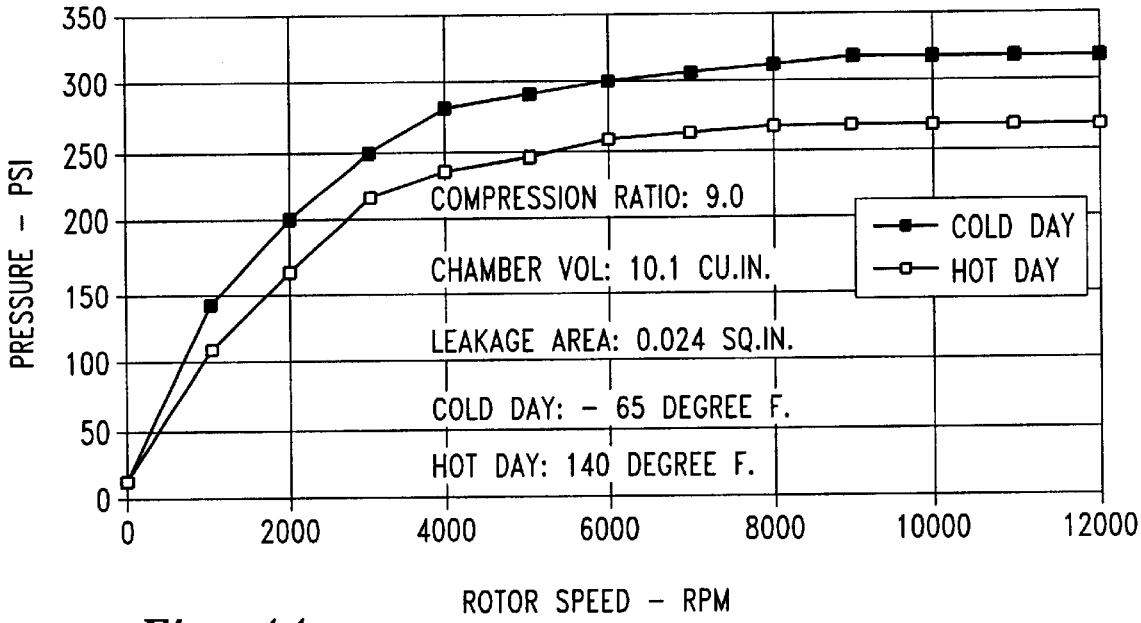
FIG. 11 illustrates Static Compression Pressure versus Rotor Speed on Hot and Cold Days for the described positive displacement engine.
Figure 12:
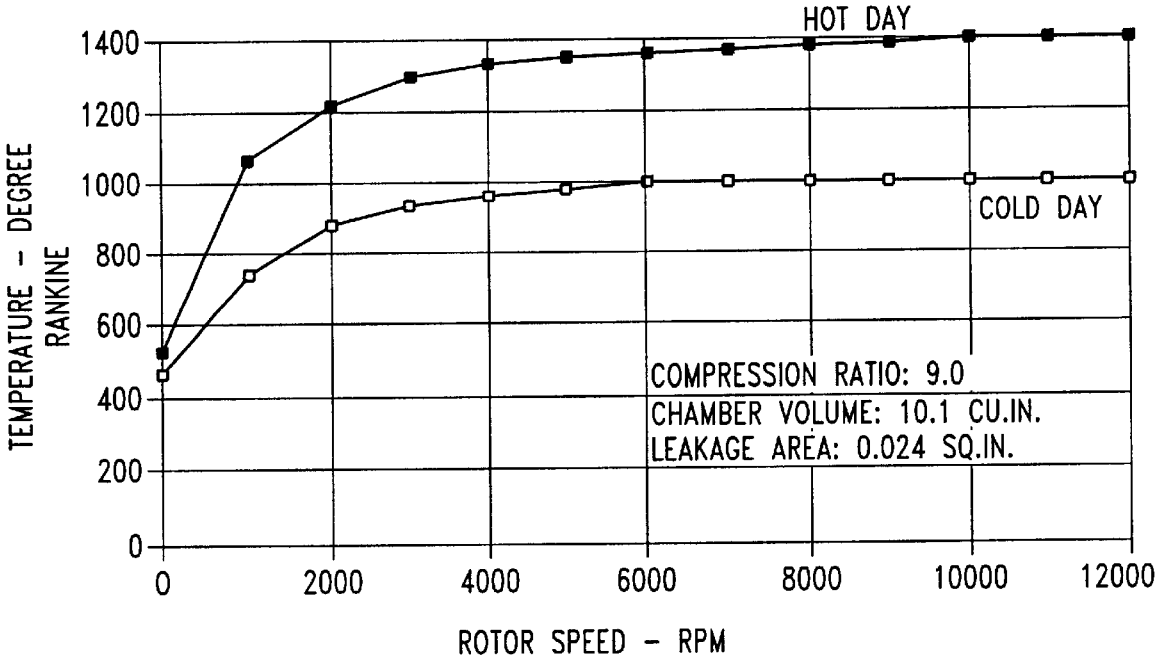
FIG. 12 illustrates Static Compression Temperature versus Rotor Speed on Hot and Cold Days versus Rotor Speed for the same positive displacement engine.
Figure 13:
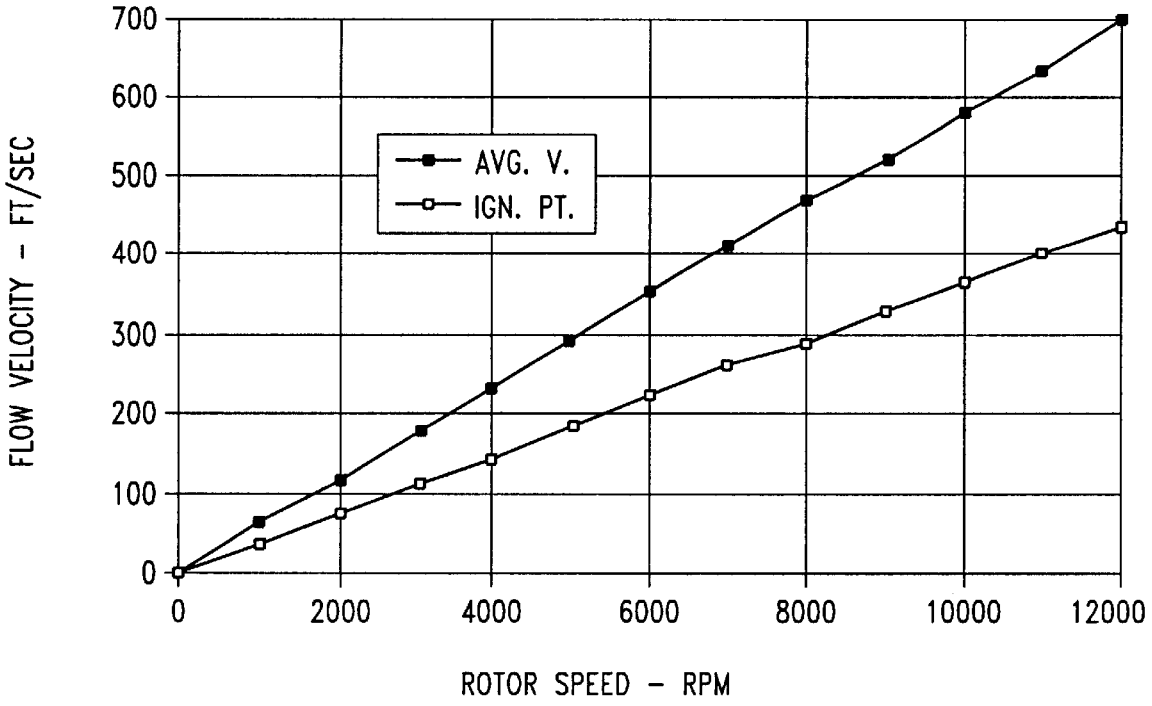
FIG. 13 illustrates the Internal Flow Velocities over the Stator Wall at two locations versus Rotor Speed.

In the heat engine of U.S. Pat. No. 3,762,844 a fuel-air mixture is compressed by volume reduction as in a reciprocating piston type internal combustion engine. FIGS. 11 and 12 show static compression pressure and temperature versus rotor speed for operation on very hot and very cold days. Hot and cold days were selected to be at 600 and 395 degrees Rankine respectively. FIG. 13 shows the flow velocities over an assumed igniter location and the average relative combustion chamber flow velocity over the stator surface. The combustion chamber total compression pressure and temperature at the compression peak are therefore higher than the shown compression ratio of 9.0. While the average velocity shows a maximum value of 700 ft/sec at 12,000 RPM the maximum flow passage velocity could reach 920 ft/sec. This means that a flame initiated upstream of the passage is stretched during combustion before diffusing into the expanding downstream volume of the combustion chamber. The maximum flow velocity relative to the rotor is near half that relative to the stator. This is important to reduce the pressure drop over the compression peak, since the combustion chamber is enclosed by the rotor on five of its six sides.

Figure 14:
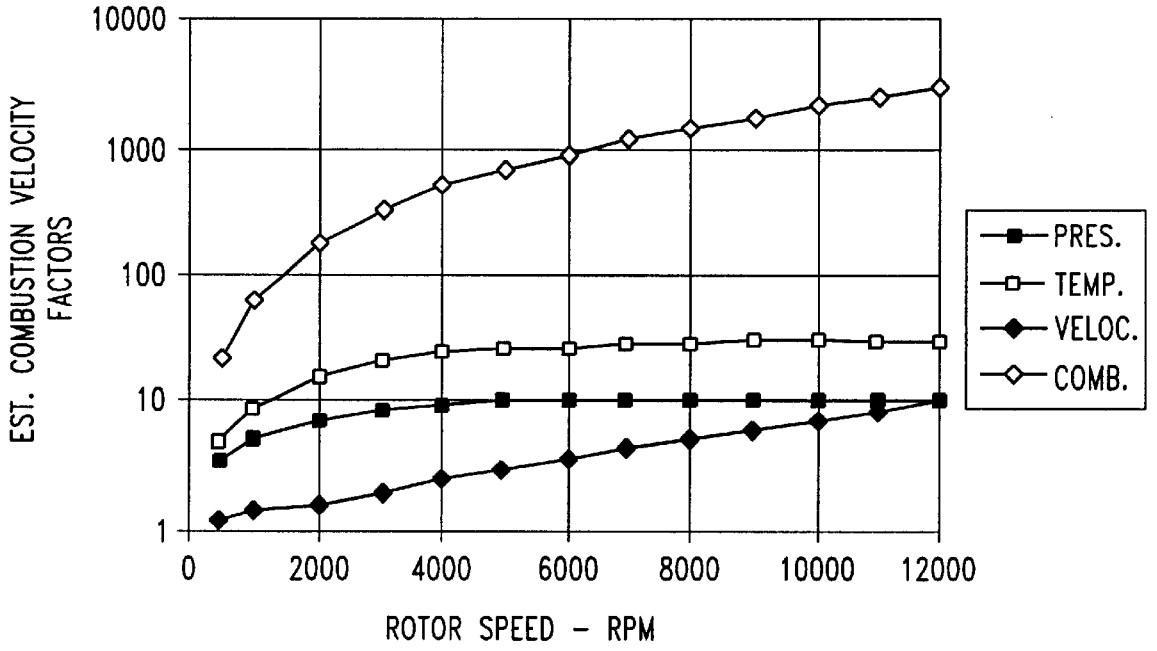
FIG. 14 illustrates the Individual and Combined Combustion Velocity Factors caused by Temperature, Pressure and Mixture Velocity computed for the described basic engine.
Figure 17:
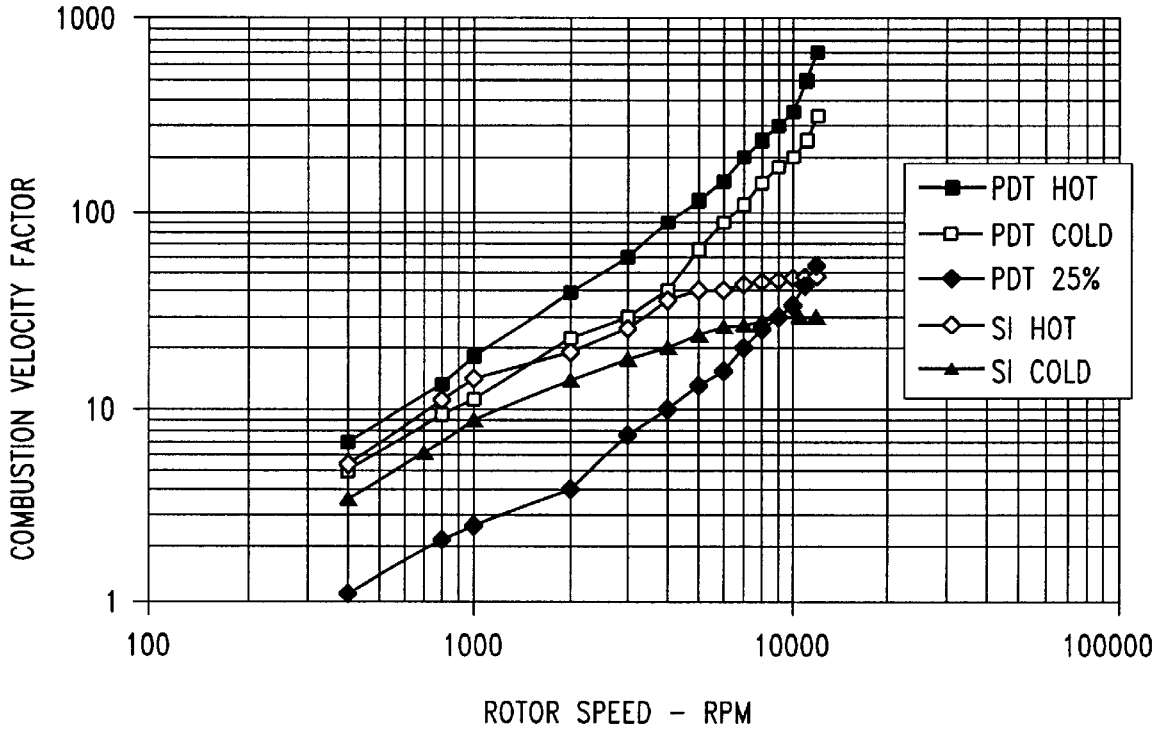
FIG. 17 illustrates the Combustion Chamber Combustion Velocity Factor versus Rotor Speed comparing the described positive displacement engine on hot and cold days and at 25% load on a cold day with a Conventional Reciprocating Piston type four stroke internal combustion engine operating at the same process speeds and at the same leakage factor in rich mixture.

The effect of compression pressure and temperature, and the combustion chamber relative flow velocities can be combined into combustion velocity factors as shown in FIGS. 14 and 17 for rich and lean fuel-air mixtures respectively. In FIGS. 14 and 17 the combustion velocity factors have been computed for an engine with the combustion chamber traveling at a substantial velocity relative to the stator and for conventional piston engines. The former is the case of the engine described in U.S. Pat. No. 3,762,844, which is shown compared to a conventional reciprocating piston type engine operating at the same process velocity and with the same leakage factor. Pressures and temperatures of compression were shown in FIGS. 11 and 12. The relative flow velocities were shown in FIG. 13. The operational differences between the two engine types is confined to the effect of the relative velocity components. These are in reality suspended as an additional compression ratios in disguise. FIG. 14 shows the influence factors of fuel-air mixture pressure, temperature and velocity and combined effects versus engine rotor speed. In contrast to the conventional piston engines, the described heat engine combustion chamber also has a substantial flow velocity component, which as the graph shows increases the combustion velocity by factors up to 10 times. The upper line shows the combined effects of the combustion enhancement factors.

Figure 15:
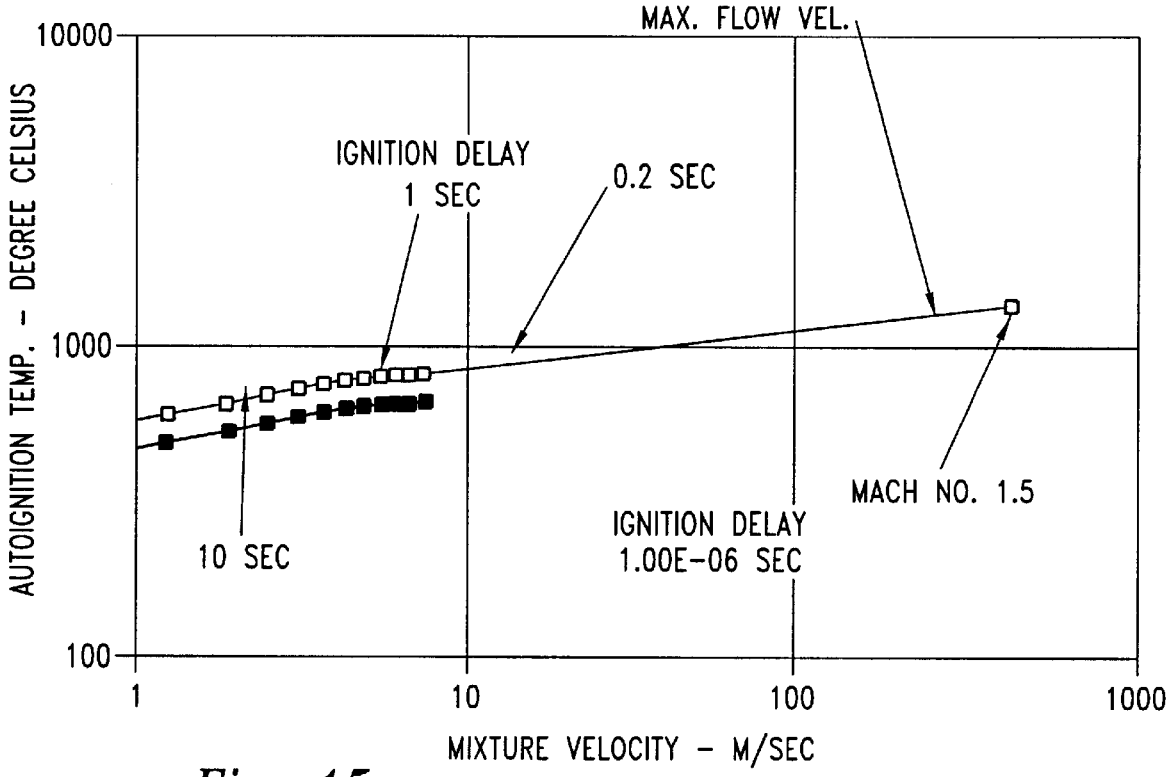
FIG. 15 shows a Combination of data from FIG. 1 and from FIG. 7 of Fuel-Air Autoignition Temperature data versus Mixture Velocity in Logarithmic scales indicating mixture Ignition Delay values up to 435 m/sec relative velocity.

FIG. 15 is a combination of FIG. 1 and FIG. 7 which shows how the fuel-air autoignition temperature varies with fuel-air mixture flow velocity at constant atmospheric pressure. The log-log linear relationship is quite obvious.

Figure 16:
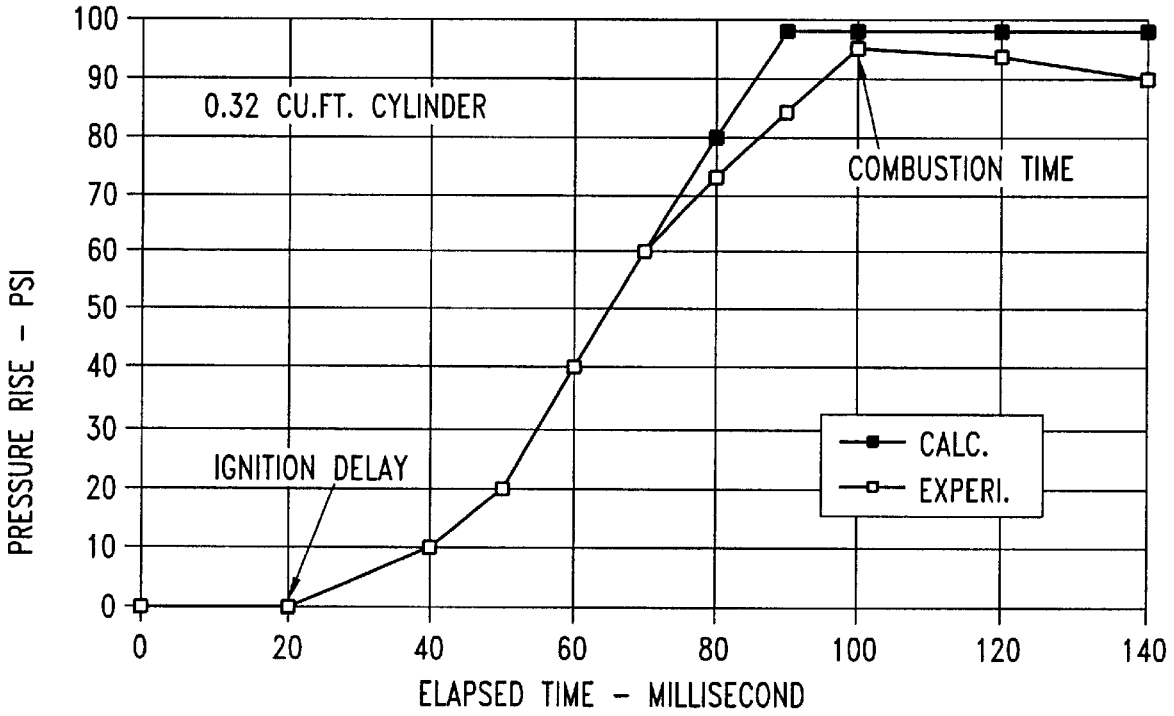
FIG. 16 illustrates a Histogram of Pressure produced by ignition of a 9.6 Volume % Methane-Air in a 0.32 $ft^2$ cylinder (Experimental and Theoretical).

Combustion in a closed volume is entirely different from one conducted in a constant pressure flow tube. FIG. 16 from Tech. Ref. 10 shows a histogram of the pressure rise event during combustion of gasoline in a closed volume. While the combustion took 30 times longer than the ignition delay in constant pressure combustion, it is here seen that combustion at constant volume only takes five times longer than the ignition delay. The curves show very good correlation between theory and experiments.

If operated from atmospheric pressure and temperature statically, Tech. Ref. 10 says that the combustion of the compression volume in rich mixture should have taken:

$$t_m=75(1.28/1728)^{1/3}=6.786 \text{ [millisecond]}$$

For comparison, the combustion velocity factor must be expressed inversely with the combustion time. The engine shown in FIG. 17 operating at full load and full speed shows:

$$t_m=6.786/3020.8=0.002246 \text{ [millisecond]}$$

operating in rich mixture on a hot day.

The same engine operating on a cold day shows:

$$t_m=6.786/741=0.00916 \text{ [millisecond]}$$

Operation at 25% load on a cold day gives the following combustion time:

$$t_m=6.786/60=0.113 \text{ [millisecond]}$$

The reciprocating piston engine of the same compression volume operating at full load on a hot day has the following combustion time:

$$t_m=6.786/300=0.0226 \text{ [millisecond]}$$

which is exactly ten times the combustion time of the described positive displacement piston type SI engine. The same conventional piston engine on a cold day will need 0.089 millisecond for combustion of the same volume.

The difference between rich and lean flame speeds in a flowing fuel-air mixture may be substantially as shown in FIG. 8 contrary to the case in a conventional reciprocating piston type engine, where lean fuel-air mixture means slower combustion.

Converted to equivalent crankangle, the piston engine under full load on a cold day will need 17.13 degrees advanced ignition timing before the pressure peak point. The described positive displacement engine will require an equivalent crankangle of 20.22 degrees advanced timing before the peak pressure point, but only half this is actual engine movement.

FIG. 17 shows the combined combustion velocity factors referred to above versus rotor speed for the new engine configuration on full load, on hot and cold days and at 25% load on cold days. For comparison the figure also shows the combined combustion velocity factors versus shaft speed for a conventional piston type internal combustion engine having a very modest internal flow velocity. As was seen from FIGS. 2 and 3, an internal swirl does improve this situation slightly.

Figure 18:
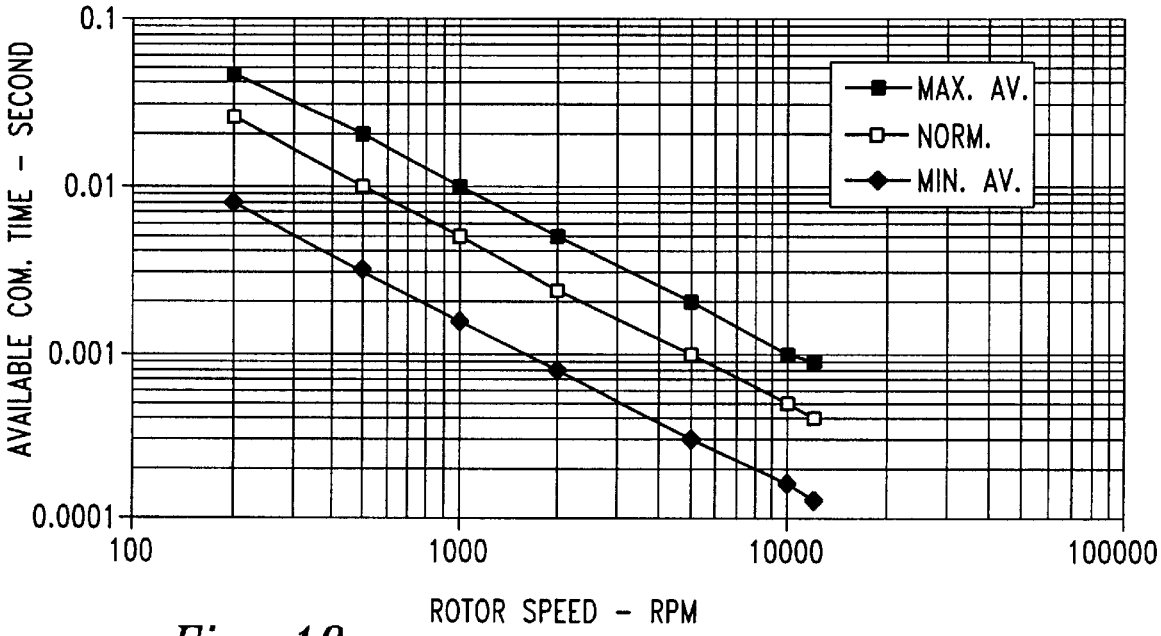
FIG. 18 illustrates Available Combustion Times versus Rotor Speed for the described moving combustion chambers for three different ignition points.

While the ignition in a reciprocating piston engine can be timed to ignite at any desired position of the piston, a traveling combustion chamber is only exposed to ignition during the chamber passage. This limits the ignition lead/lag. FIG. 18 shows the possible range of available combustion times versus rotor speed. Three lines are shown; one for the maximum time available to 10 degrees after top dead center; one for the normal combustion time, when the combustion chamber center line is 20 degrees before the top dead center; and one for the assumed minimum available time, when the center line of the combustion chamber is at the top dead center. Other alternatives are also available. The normal line, where the ignition take place 20 degrees before top dead center gives a pressure rise rate of 25 psi/degree equivalent crankangle, which according to Tech. Ref 12 is normal for reciprocating piston engines of compression ratio of 9.0 and ignited from a single source.

Uncontrolled multiple ignitions can occur in reciprocating piston engines if the pressure rise rate should reach some 124 psi/degree crankangle. Since a different and very fast combustion is involved, a much higher pressure rise rate may be acceptable. Under some operations it may be necessary to slow down the combustion rate to move the ignition point all the way to the top dead center or beyond.

The time scale on FIG. 18 is shown in seconds, and in operation at 12,000 RPM the respective times are:

Max. Available Combustion Time 0.0008 [second]

Normal Conventional Combustion Time 0.0004 [second]

Min. Available Combustion Time 0.00014 [second]

To start combustion an ignition source must be available, which in temperature terms must close the gap to reach the projected combustion time. The combustion time is computed from the available time of ignition to reach the maximum pressure point, which for the Normal Conventional Combustion time in FIG. 18 at 500 RPM rotor speed shows 0.01 second. This value is first divided by the combustion velocity factor from for example FIG. 17 for lean mixture operation on a hot day at full load of approximately 8.35. This obtains the baseline for the ignition temperature requirement which was also shown in FIG. 15. Other ignition point locations will give different temperatures.

Figure 19:
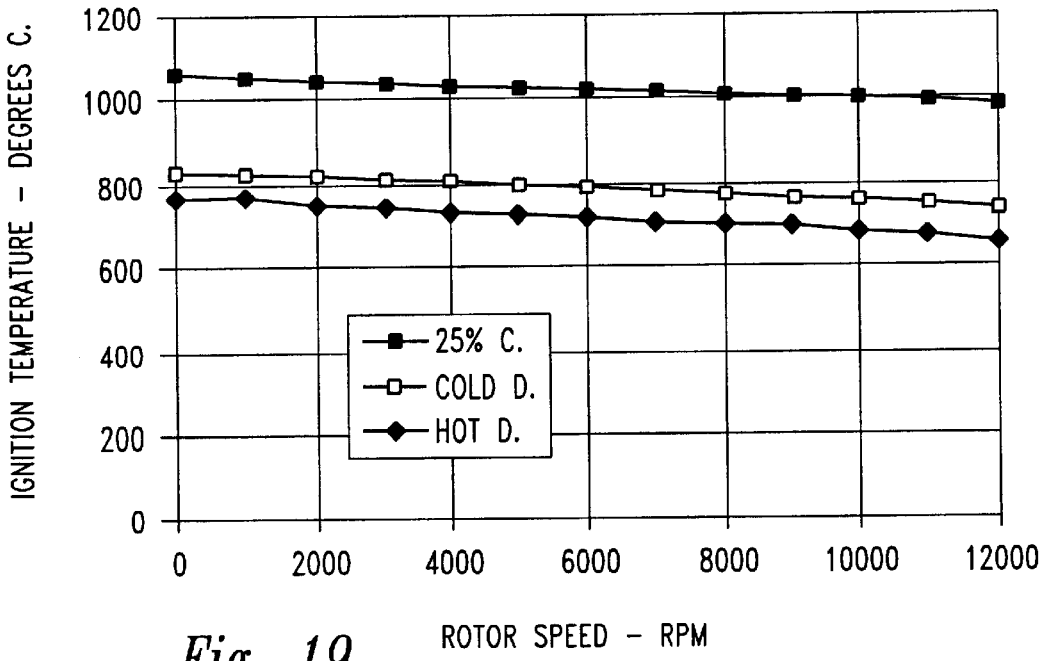
FIG. 19 illustrates Ignition Temperature requirements versus Rotor Speed for the normal ignition point per FIG. 17.

By applying the computed available time to a derivative of FIG. 18 the ignition temperature is found. FIG. 19 shows the computed ignition temperatures for the Normal Conventional Combustion Time line of FIG. 18 for gasoline represented by IsoOctane and kerosene for 25% and full loads on hot and cold days. The positive displacement engine with traveling combustion chambers is operating on lean fuel-air mixture.

The temperature lines of FIG. 19 are seen to slope downward for increasing rotor speeds. This is due to the velocity effect on combustion time. The lower engine load of 25% is causing the ignition temperature requirement to increase. Even lower loads will make this ignition temperature requirement even higher.

The ignition temperatures of the igniter in conventional internal combustion piston engines normally operate between 800 and 900 degrees Celsius to keep themselves clean, but it is not uncommon that much lower temperatures are encountered in operation. To bring the temperatures of FIG. 19 together, the part load ignition point must be advanced to allow for a longer combustion time with a cooler igniter. Conversely, if a shorter combustion time at full load is desirable, a higher temperature igniter must be introduced. A more advanced ignition point for part load means a longer combustion and a lower combustion pressure and less power.

In conventional operation the ignition point is advanced to take care of high speed operation. Here the combustion chamber leakage and velocity effects are such that the ignition must be advanced both for a lower speed and a lower load. Several methods are available for combustion control including lead/lag operation of the ignition point either mechanically or by electronic circuitry, and also by controlling the energy release from the igniters. In the age of electronics, none of these methods are inconceivable. The method of changing the energy release over the igniter gap may be most easily achieved with plasma type igniters. These first ionize the plug gap by means of a high voltage, and then discharge a controlled ignition energy at a lower voltage over the ionized bridge. Engine control by means of igniter plug temperatures has not been entirely successful in reciprocating piston engines. This may present some problem here too because a very fast energy discharge is essential to prevent an afterglow of the igniter to cause pre-ignition and reduced engine performance. The energy requirement for a full load, full speed operation is modest and much latitude is available for energy control.

The minimum ignition energy can be computed as described in Tech. Ref 13 as shown: in FIG. 19.

Since it is the mixture flow, that must be heated to ignition temperature, there may exist a difference between the igniter temperature and the ignition temperature, which is used in this equation. FIG. 1 also shows that when a combustible fuel-air mixture flows over a heated surface, the auto ignition temperature, A.I.T., increases radically. In the case when no flow existed, A.I.T. was low, and the ignition delay and by that the combustion time was very long. A plot of the ignition energies will show that an igniter exposed to the fuel-air mixture flow need more energy for ignition than one sitting in a non-flowing area. The ignition energy requirements increase with reduced rotor speed. The ignition source energy requirement is thus decided by engine starting at high altitude.

Ignition may reach the fuel-air mixture either from an igniter recessed below the contact line between the rotor blade edge seal and the stator wall, or the igniter may be recessed into its own cavity. This is then connected to the main combustion chamber by a small passage. The igniter will then be exposed to very little flow. When the igniter is exposed to the full flow velocity in the combustion chamber or that of the boundary layer, a substantial heat loss takes place from the igniter. Tech. Ref. 13 describes the performance of three methods identified as spark ignition, pilot flame ignition, and glow ignition. While the pilot flame or cavity ignition may be a little slow in starting, the high temperature of the ignition jet emanating from the cavity access passage creates a very fast secondary combustion in the combustion chamber flow duct. This type of combustion is partly controlled by the ignition delay caused by a combustible mixture entering the cavity, ignited, and a jet flame emerges through the access passage. In spite of this, the energy requirement of cavity ignition is much lower than the directly exposed igniter in the combustion chamber flow duct. The jet ignition may, however, have some limitations in lean mixture operations.

Figure 20:
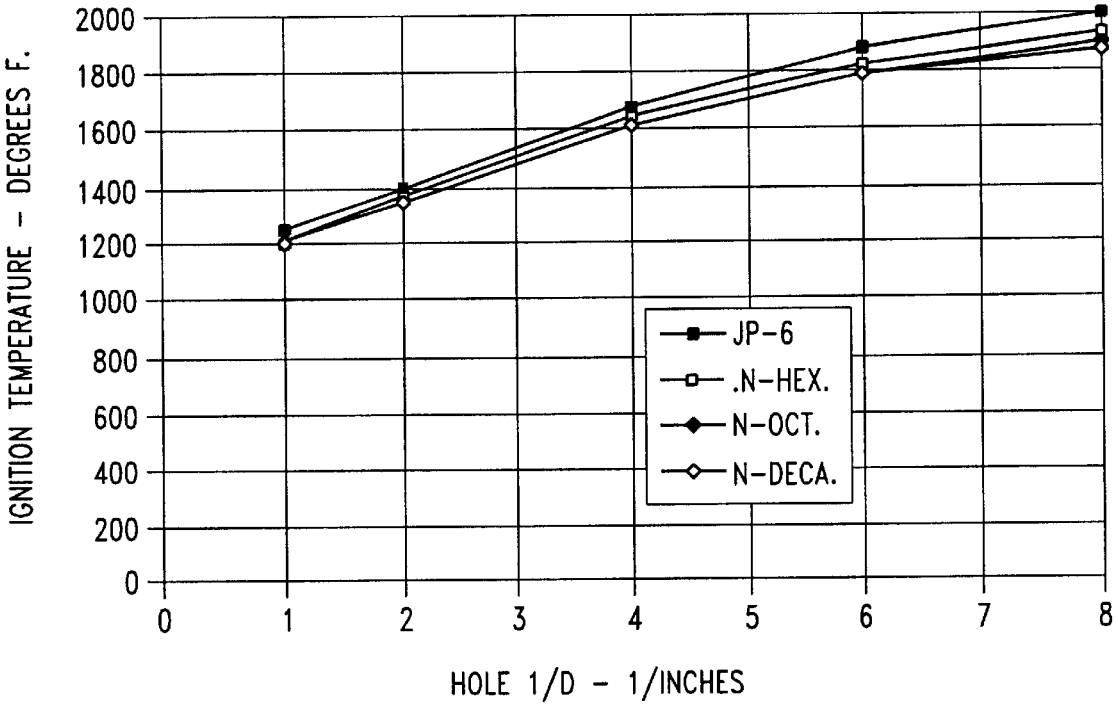
FIG. 20 illustrates variations of Hot Gas Temperature requirement versus the reciprocal of hot air jet diameter for ignition of various hydrocarbon vapor-air mixtures Tech. Ref. 14.

The location of the igniter in the thermodynamic cycle is important. As the trailing rotor blade of the combustion chamber in combustion passes the igniter, the following combustion chamber in compression is exposed to the igniter. Hot gases from the leading combustion chamber may sometimes ignite the combustible mixture in compression prematurely. If, for example, the igniter is located later than 20 degrees before top dead center, the center line of the combustion chamber will be over the top dead center and in combustion. The igniter cavity will be full of hot gases under pressure, and these will be ejected into the compressing gases in the following combustion chamber and ignite these. If the combustion peak is late enough, the following combustion chamber may escape this ignition, otherwise the igniter must be moved a few degrees upstream. Conversely, if the igniter access is located downstream of the top dead center, this must be located so far downstream that the compression pressure and the expanded combustion pressure are almost the same. Otherwise, the residual combustion gases in the cavity may be hot enough to ignite the compressing fuel-air mixture. Residual gas ignition is not a controlled operation, and it reduces engine performance. In such a case the engine will continue to run after the engine ignition is switched off. FIG. 20 from Tech. Ref. 14 shows the temperatures and access hole sizes required for jet ignition. The combustion gas temperatures are far higher than the values shown in the figure, which correspond to the exhaust gas temperatures of the described positive displacement engine without power recovery. It must be recognized that a flame front moving with the air flow gives much faster combustion than one that moves against, even when a vortex is available. The preferred solution is therefore a controlled electric spark induced combustion instead of a self induced gas jet ignition by residual gases. The condition for jet ignition by electric sparking is adequate breathing for the igniter cavity of fresh fuel-air mixture, which is not a problem.

The question of engine performance is closely associated with its combustion performance and its heat losses. This is reflected in the heat balance. A typical balance for a four-stroke cycle, reciprocating cycle piston type gasoline fired heat engine may be:

TABLE 5

| Energy Use | Lean Operation |
|---|---|
| Power Generation | 25% |
| Cooling Loss | 36 |
| Exhaust Loss | 34 |
| Friction Loss | 5 |
| | 100% |

The heat balance for the improved version of the engine described in the U.S. Pat. No. 3,762,844 operating at 6000 RPM and in rich mixture of 0.0782 lb fuel/lb of air and cooling the combustion chamber walls to 350 degrees Fahrenheit came to:

TABLE 6

| Energy Use | Basic Rich | Heat Count |
|---|---|---|
| Excess Hydrocarbons | 15% | 112.7 Btu/sec |
| Power Generation | 34 | 254.4 |
| Cooling Loss | 20 | 150.3 |
| Exhaust Loss | 27 | 202.8 |
| Balance | 4 | 30.1 |
| | 100% | 750.4 Btu/sec |

If a rotor temperature of 1140 degrees Fahrenheit, and a stator temperature of 500 degrees Fahrenheit maximum are acceptable, and the engine is made to operate on lean fuel-air ratio of 0.054 lb fuel/lb air, the new heat balance is:

TABLE 7

| Energy Use | Basic Lean | Heat Count |
|---|---|---|
| Excess Hydrocarbons | 0% | 0 Btu/sec |
| Power Generation | 52.3 | 270 |
| Cooling Loss | 6.2 | 32.1 |
| Exhaust Loss | 41.5 | 215.1 |
| | 100% | 518.1 Btu/sec |

The last heat balance shows that an excessively high heat loss goes through the exhaust. This can be recovered in several ways. If such heat recovery is undertaken by means of a gas turbine geared to the engine main shaft, the new heat balance may be:

TABLE 8

| Energy Use | Basic Lean | Heat Count |
|---|---|---|
| Excess Hydrocarbons | 0% | 0 Btu/sec |
| Power Generation | 69.3 | 361.9 |
| Cooling Loss | 6.2 | 32.1 |
| Exhaust Loss | 24.5 | 124.1 |
| | 100% | 518.1 Btu/sec |

This table shows that without adding any more heat to the engine a substantial increase in power generation has taken place at the expense of the exhaust loss. This recovery is limited by the available exhaust pressure.

Figure 21:
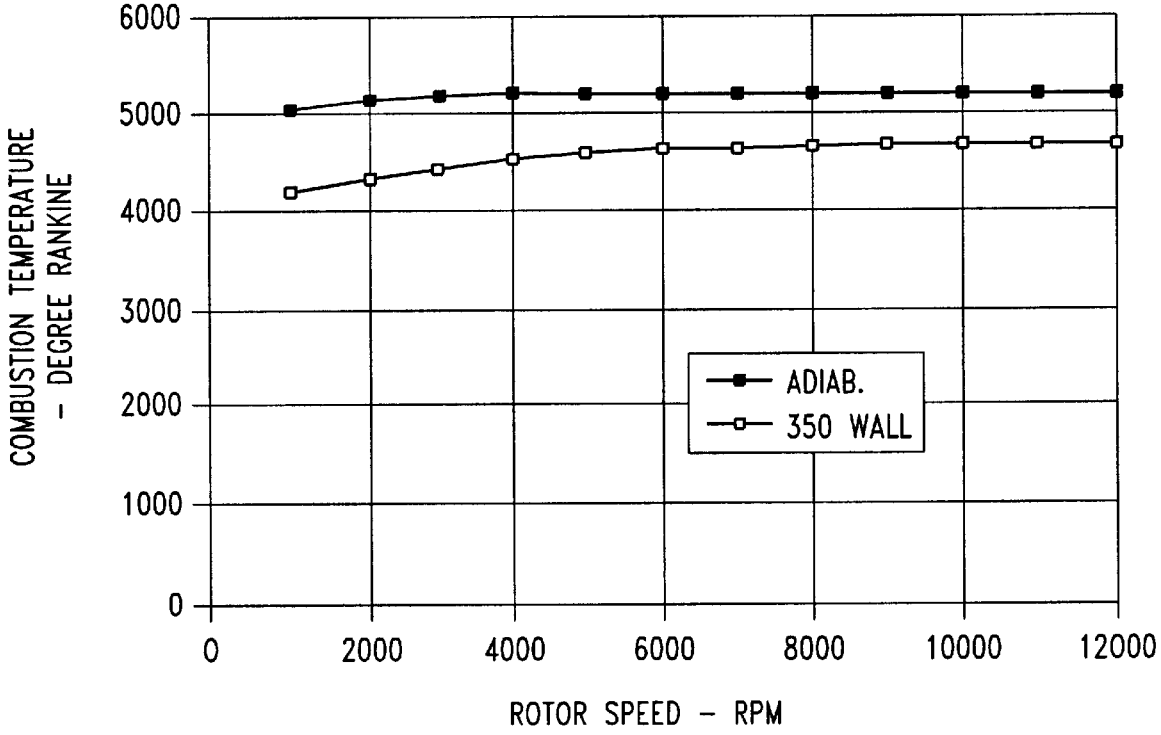
FIG. 21 illustrates Combustion Temperature versus Rotor Speed in the described Positive Displacement Engine in adiabatic operation and with the combustion chamber walls cooled to 350 degrees Fahrenheit.
Figure 22:
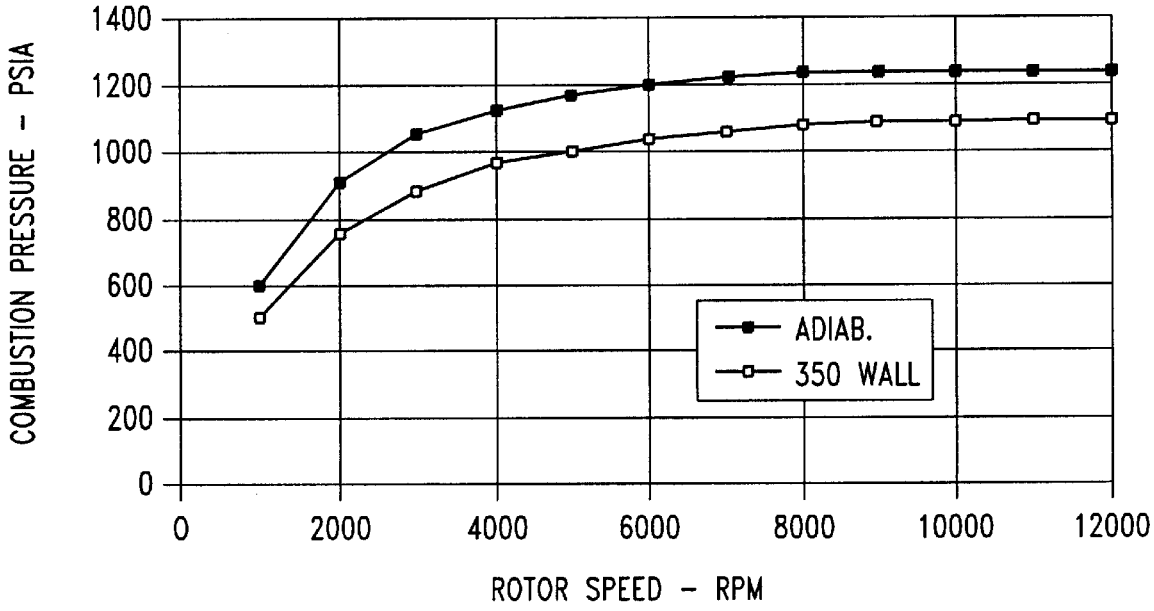
FIG. 22 illustrates the Combustion Pressure versus Rotor Speed in the described positive displacement engine in adiabatic operation and in operation with combustion chamber walls cooled to 350 degrees Fahrenheit.

Such a manipulation with an engine heat balance may also affect the combustion process and the flow path operation. FIGS. 21 and 22 show the combustion temperatures and pressures versus rotor speed for the described positive displacement engine in adiabatic operation and in operation in combustion chambers where the walls have been cooled to 350 degrees Fahrenheit. Both cases show substantial combustion chamber leakage in the lower rotor speed range, which in effect is also a heat loss. Power recovery from the exhaust, however, does not affect the combustion chamber operation beyond a slightly higher back-pressure.

Besides improving the engine power output and its operating efficiency, the higher combustion chamber pressure and temperature will reduce the ignition energy requirement. This is seen from the equation for minimum ignition energy. A lower heat loss from the combustion chambers may also contribute to a higher combustion velocity due to reduced flame quenching.

Flame quenching takes place when the combustion moves through a narrow slot or passage, as happens here. Since these walls are essentially uncooled, this situation may be limited to starting of a cold engine. The flow passage must therefore be carefully sized to prevent flame-out at starting.

Near adiabatic operation presents its own problems. Development of near adiabatic operation has so far been limited to diesel engines, where the fuel can be injected directly into the combustion chamber at a timed position of the piston. Reduced combustion chamber heat loss is normally achieved by means of ceramic materials with reduced thermal conductivities and high temperature capabilities. Due to the high temperature levels involved, premixed fuel-air mixtures from outside will normally auto-ignite and cause engine damage or reduced performance.

Figure 23:
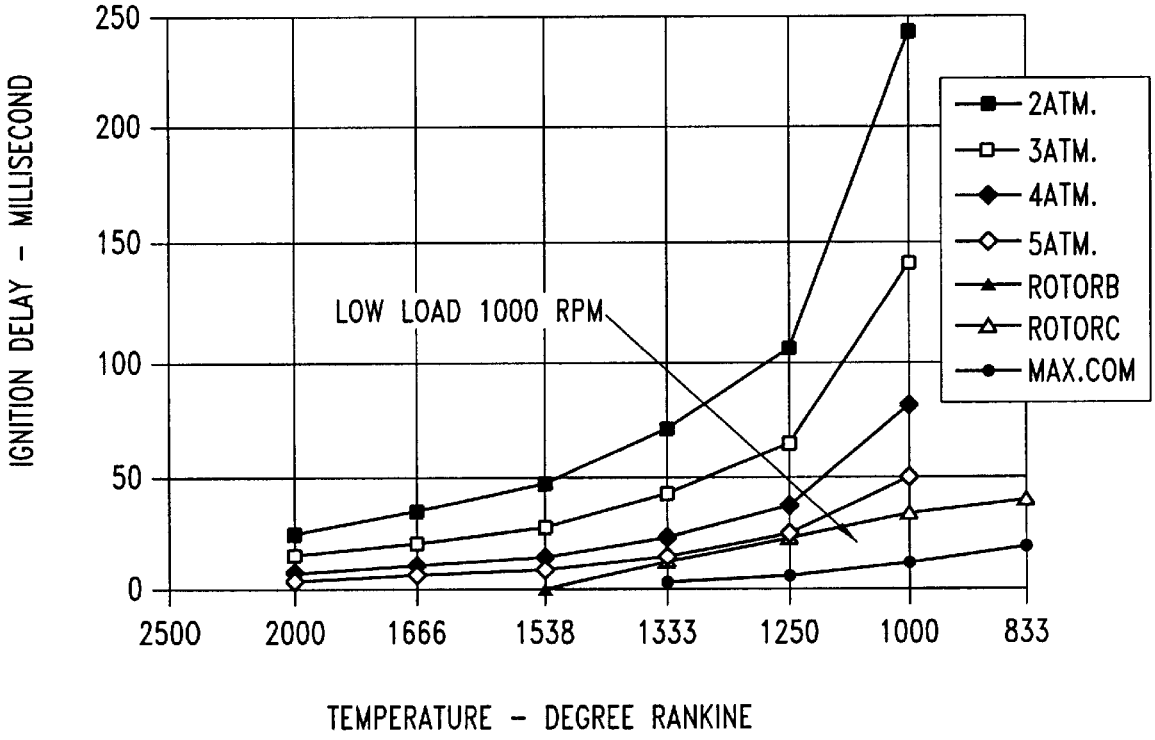
FIG. 23 illustrates Ignition Delay versus Temperature of various Pressure Levels for a low octane JP-6 fuel-air mixture with compression gas and uncooled rotor temperatures laid in. Tech. Ref. 15.

In the type of engines described in this specification the process operation is too fast for the occurrence of pre-ignition even in a premixed fuel-air mixture of low octane fuels. FIG. 23 shows ignition delay in milliseconds versus the temperature for mixtures of low octane JP-6, used in gas turbine engines, at various pressure levels, as taken from Tech. Ref 15. On this illustration are two operating temperature lines from the described positive displacement engine operation. The lower temperature level line shows Maximum Compression Gas Temperature operation at a full load, and the upper line show the metal temperatures of the rotor components. One of the points shows the rotor operating temperatures in a supercharged configuration at two atmospheres manifold pressure is not clearly visible. The rotor will in both cases serve as a heat recouperator preheating the entering fuel-air mixture with heat from the rotor received from the combustion stroke. It can also act to reduce the volumetric efficiency of this engine, if the heat is added so early in the induction stroke as to reduce the density of the fuel-air mixture entering the combustion chamber through the intake port.

The rotor component operating line is shown to cross the 5 atmosphere line in the operating range of 500 to 1000 RPM. This is of no consequence, as the combustion time for constant volume is about 5 times the ignition delay, so the early pressure rise will not have developed to any degree in the time span available. If a lower than maximum load is imposed on the engine in this speed range, the operating line will move away from the 5 atmosphere line as shown by the arrow at 1000 RPM as seen in FIG. 23.

Figure 24:
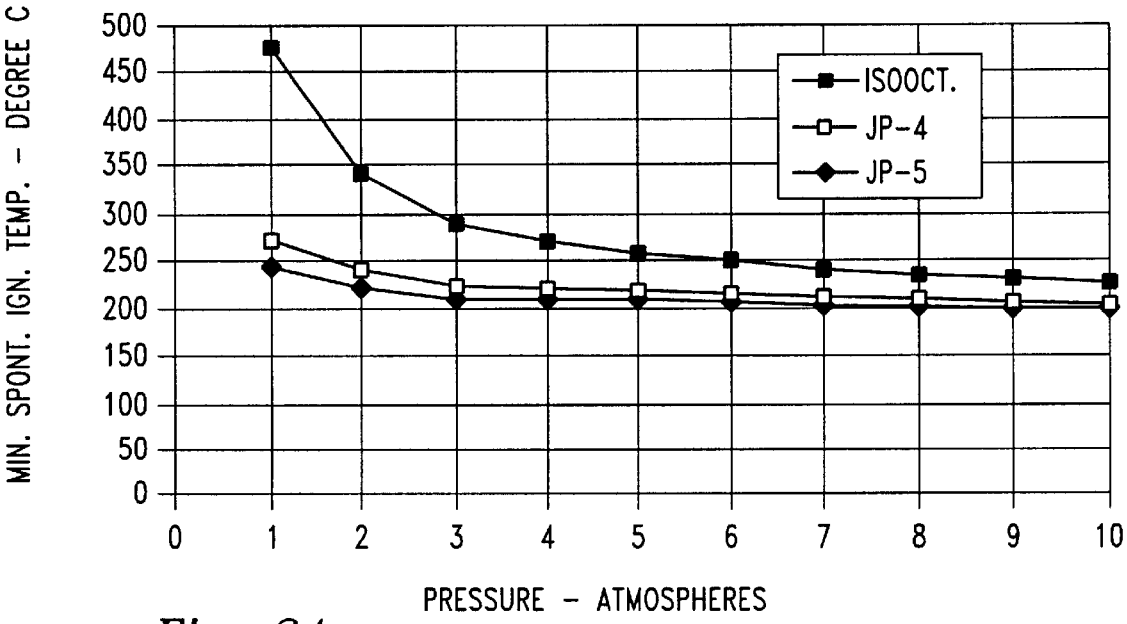
FIG. 24 illustrates the Effect of Pressure on the Ignition Temperature of Iso-Octane, JP-4 or Jet A, and JP-5 in stagnant fuel-air mixtures. Tech. Ref. 16.

The combustion chamber compression pressure at this compression ratio will obviously rise above the 5 atmosphere level shown. FIG. 24 from Tech. Ref. 16, however, shows that for the fuels involved, pressures above 5 atmospheres have little effect on the Minimum Spontaneous or Autoignition Temperatures, A.I.T.

The case of the stator is a little different. Combustion in the combustion chamber will always take place in the same sector of the stator circumference, so no cooling effect is obtained from the incoming fuel-air mixture. Some cooling is therefore necessary in this sector. Since the combustion chamber is enclosed by the rotor on five sides and the stator only on one, the amount of cooling required is quite small. The question arising here is whether the stator wall should be lubricated or not. Operation with sliding wall temperatures up to 700 degrees Fahrenheit has been demonstrated with synthetic oil. Operation in dry rubbing is also quite acceptable if cooling is available, and the interface configuration has been carefully developed for such operation. This is, however, outside the scope of this disclosure. The material selection for the running components will be controlled by the combination of running stress levels in creep and stress rupture at elevated temperatures.

Power recovery has been used in commercial engines such as the Curtiss-Wright R-3350TC, turbo-compound engines, where some 700 BHP was extracted from the exhaust gas by means of three gas turbines geared back to the main shaft. There is, however, no reason why the exhaust gas cannot be expanded to near atmospheric pressure by means of a positive displacement expander. A Wankel engine configuration was tested with good results by Rolls Royce Ltd. some years ago. While the Curtiss-Wright R-3350 turbo-compound engine produced an Equivalent Brake Mean Effective Pressure of 460 psi, a turbo-compounded version of the described positive displacement engine can easily produce 490 psi when operated at 2 atmosphere manifold pressure.

Figure 25:
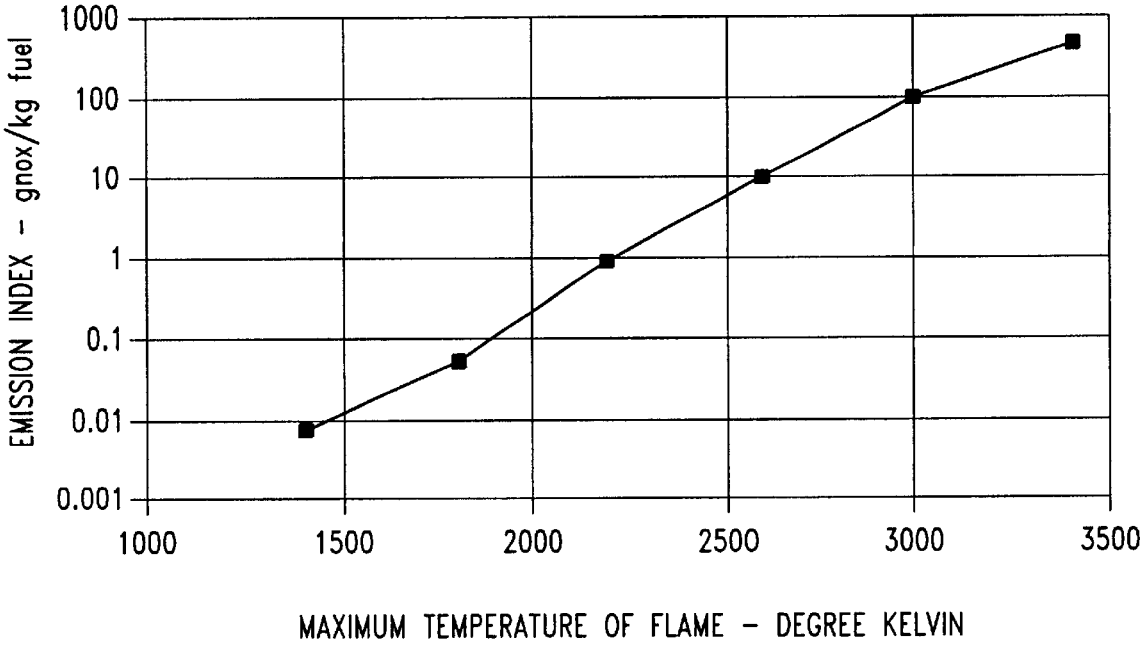
FIG. 25 illustrates $NO_x$ Emission Index versus Flame Temperature at equilibrium. Tech. Ref. 17.
Figure 26:
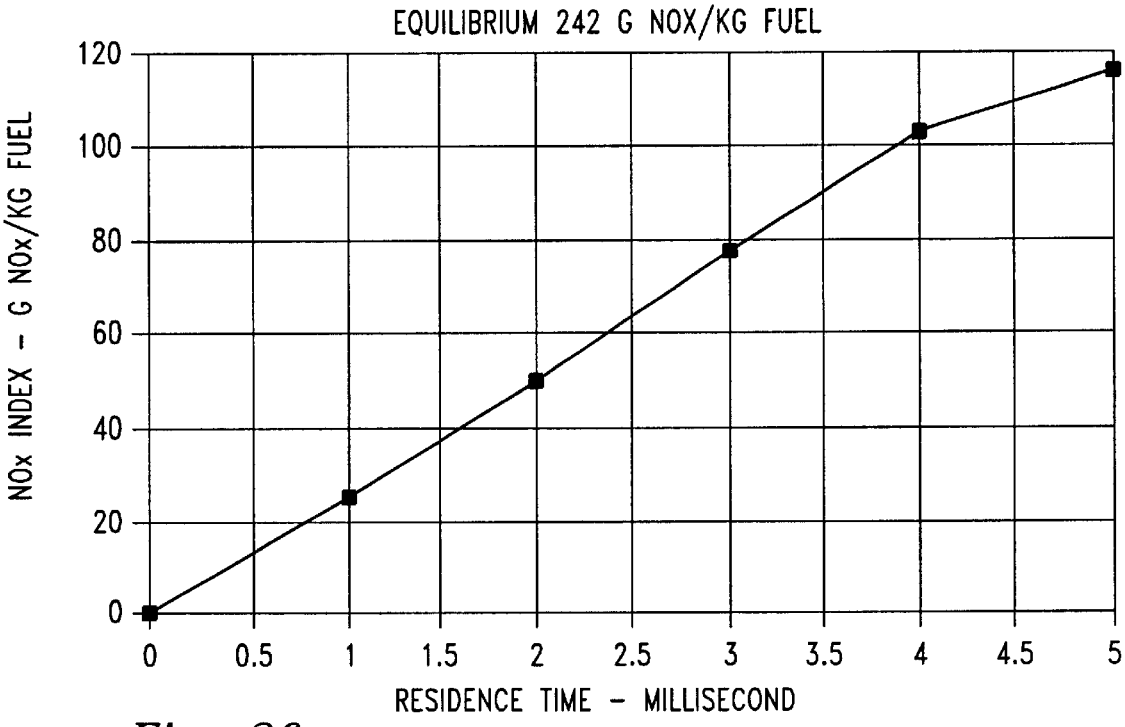
FIG. 26 illustrates $NO_x$ Emission Index versus Residence Time for a fixed equilibrium concentration. Tech. Ref. 18.

Operation at very high combustion temperatures, such as shown for adiabatic operation in FIG. 21, induces a new aspect for consideration. Oxides of nitrogen are byproducts of combustion produced when the nitrogen in the combustion gases are exposed to air at high temperatures over a finite time. FIG. 25 from Tech. Ref. 18 shows the $No_x$ Emission Index expressed in grams of $NO_x$ per kilogram of fuel combusted versus maximum flame temperatures when exposed to equilibrium. While almost no $NO_x$ is produced at 2600 degrees Fahrenheit or 1700 degrees Kelvin, at 4700 degrees Fahrenheit or 2866 degrees Kelvin about 80 grams of $NO_x$ is produced per kilogram of fuel used. FIG. 26 from Tech. Ref 17 again shows the $NO_x$ Emission Index, but this time versus residence time working against an equilibrium $NO_x$ Index of 242. The figure shows that the $NO_x$ level at a residence time of 2 milliseconds will only reach 19.6% of the equilibrium level. FIG. 17 and Page 25 shows that for the engine described in this disclosure, a residence time of 0.014 millisecond combustion time is quite achievable. This corresponds to full load operation in lean fuel-air mixture, which on a hot day will produce about 0.138% of the equilibrium level. At 6000 RPM where the combustion temperature at full load may be almost the same, twice this level may be produced. Since the flame temperature is slow to develop, even less $NO_x$ will be emitted. For operation at near adiabatic flame temperature of more than 5000 degrees Fahrenheit or 2777 degrees Kelvin, FIG. 25 shows an equilibrium $NO_x$ Index of about 75 g $NO_x$/kg fuel. This will yield an effective $NO_x$ Emission Index of 0.104 g $NO_x$/kg fuel after an exposure of 0.014 millisecond at this temperature. Since the temperature spike tapers toward the top, this is probably a very conservative value because the time constraint prevents enough exposure to high temperature levels in this fast running engine.

Figure 27:
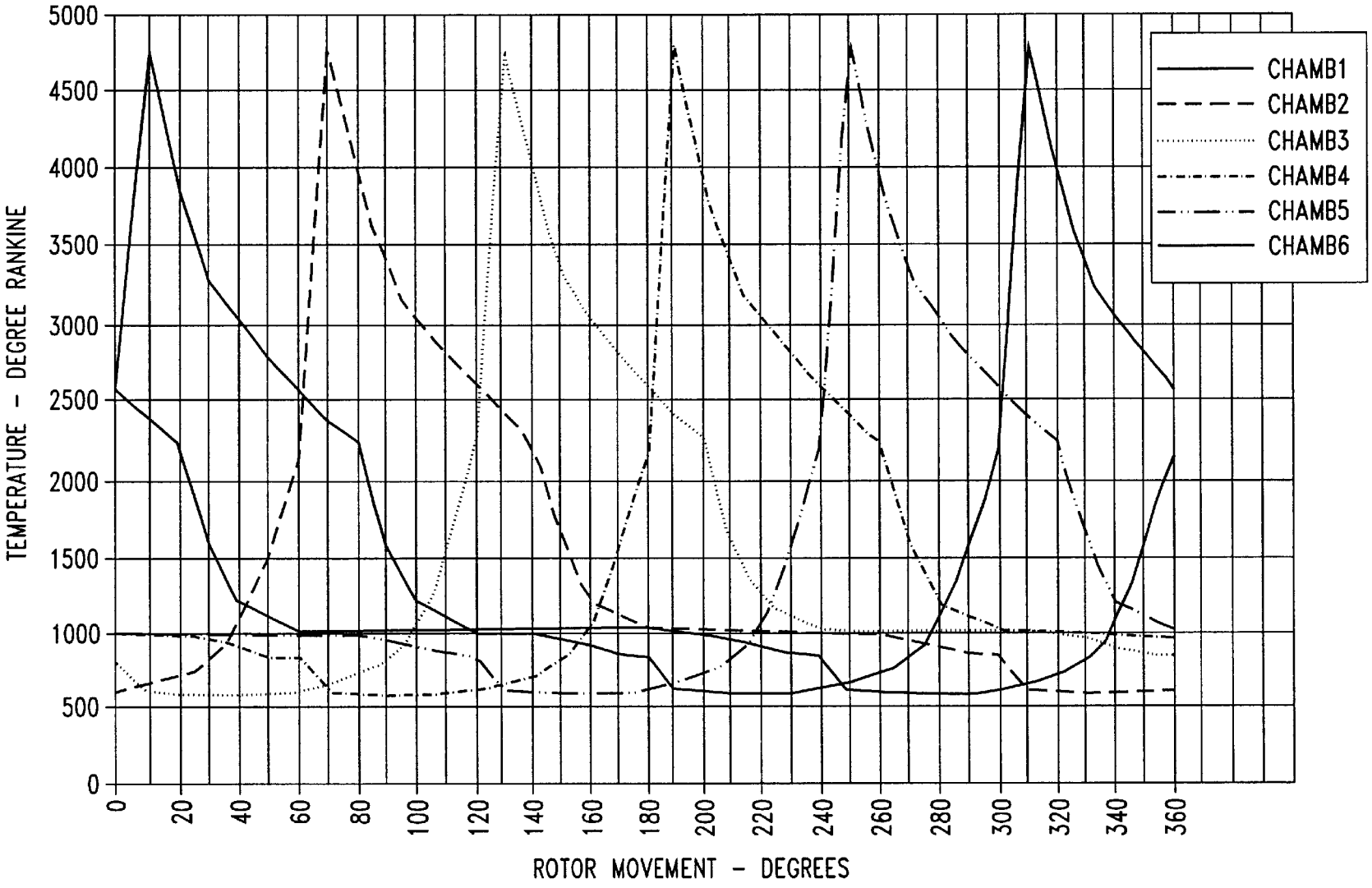
FIG. 27 illustrates the Thermodynamic Cycle Temperatures versus Rotor Movement for one Bank of Combustion Chambers at 6000 RPM for the basic design concept engine.

FIG. 27 shows combustion chamber temperature traces versus rotor position. This illustration shows six combustion chambers on one side of the rotor while another six on the other side located between the shown traces. The peak temperature values shown here are about 4800 degrees Rankine and representing operation at 6,000 RPM. Operation at 12,000 RPM will be hotter. As shown in the figure, combustion starts at 1400 degrees Rankine, and lasts for a little more than 10 degrees angle, which corresponds to about 20 degrees crank angle in a reciprocating piston type four-stroke cycle (SI) engine. A representative value for any duration at temperature in this case should be about 4400 degrees Rankine or 2444.44 degrees Kelvin, which conservatively corresponds to an emission index for equilibrium of about 7 g/kg fuel burned. The time exposure at this temperature over about 10 degrees shaft angle is about 0.277 millisecond at 6,000 RPM. Prorating from FIG. 26 for the time exposure, the resulting $NO_x$ emission becomes 0.14 g $NO_x$/kg fuel burned. Operating at 12,000 RPM at full load the resulting emission becomes less than 0.1 g $NO_x$/kg fuel. Operation at less than a full load will result in lower combustion temperature and result in lower $NO_x$ emission.

For comparison, an advanced high pressure ratio gas turbine engine emits about 36 g $NO_x$/kg fuel at full power in spite of its lean fuel-air mixture operation. It must be obvious that if adiabatic operation is contemplated, an engine must operate at reduced residence times or reduced loads to curb the emission of $NO_x$. Further, since the $NO_x$ emission is defined as a fraction of the fuel used, it becomes imperative to operate economically and extract as much power as possible from the fuel. Emission of excess hydrocarbons and carbon monoxide should not occur in lean mixture operation with premixed, near homogeneous fuel-air mixture and very little cooling. Emission of carbon dioxide is also reduced in high power lean mixture combustion. Near adiabatic operation means elevated exhaust gas temperature and high exhaust noise levels. These can be reduced by using an exhaust expander to remove some exhaust gas energy and return it to the main engine shaft.

The importance of a controlled combustion chamber leakage rate should not be overlooked. Good sealing leads to increased compression pressures and temperatures at lower speeds, which will benefit low speed torque. It will also increase the probability of low speed pre-ignition and increased $NO_x$ Index value due to the increased residence time at higher than normal combustion temperatures. Usually full power is not required in normal engine operation, nor is full torque normally required at reduced engine speeds, which means that the $NO_x$ Index values shown in these analyses are grossly overstated.

This section teaches some of the technology involved in the development of the combustion process necessary to improve the positive displacement heat engines, such as the heat engines described in U.S. Pat. No. 3,762,844 with moving combustion chambers. None of the authors of the prior art cited herein could have foreseen the application to which known information could be used and has been adapted to create the inventive process described herein. Substantial evidence is therefore available to support the findings and methods used in this disclosure. The philosophy promoted according to the invention shows that great benefits can be derived from faster engine operation. This is clearly contrary the conventional view, which seeks low engine speeds to promote better engine durability, while using lower quality materials. The original engine presented in the '844 patent developed merely some 178 BHP/lb of air used. The first improvement according to this invention brought the performance above 300 BRP/lb of air, and later versions show performance values up to 925 BHP/lb of air. Small gas turbine engines rarely produce more than 125 BHP/lb of air.

Further Description of the Invention

While the two preceding sections described the methods and technology involved in fast combustion, sometimes illustrated with examples, this section describes a preferred embodiment of the engine and those design features that make the described combustion possible. The basic engine was described in U.S. Pat. No. 3,762,844, which showed the general mechanic features involved at that level of development.

Further improvements, which contribute to the superior engine performance are described in this disclosure. Reference is made to the '844 patent for a detailed description of the basic embodiment, incorporated herein by reference.

It is common practice in thermodynamics that the combustion process of a cycle describes the thermodynamic cycle. Some of these thermodynamic cycles are ideal, such as constant volume and constant pressure combustion cycles. More practical variations of these are described as the Otto- and the Diesel-cycles, which both deviates from the ideal cycles to some degree. There are also several other thermodynamic cycles, which will not be mentioned here. The method of combustion shown here is much closer to the ideal constant volume combustion cycle than the Otto-cycle ever was, although the method of achieving this is entirely different from the Otto-cycle. This is due to the combined effects on combustion at high relative gas mixture velocity besides the effects of compression pressure and temperature on the combustion velocity. Described in this disclosure is therefore a new and independent thermodynamic operating cycle.

To execute the intended thermodynamic cycle, the engine embodiment must be compatible with the process involved. In the case of the Otto- and Diesel-cycles these can be executed in conventional reciprocating piston engines designed for two or four stroke operations and designed to meet their requirements for combustion. The requirement for executing the described fast closed vessel combustion cycle, however, involves an entirely different embodiment. To produce a high flow velocity in a closed vessel combustion chamber, the chamber must move at a substantial velocity relative to a stator enclosing at least partially the combustion chamber. This velocity can either be linear translation or in a chamber in rotation about a shaft. As the combustion chambers move, a volume compression and expansion must take place before and after the combustion process.

In some respects the Wankel engine satisfies the requirement of a moving combustion chamber. The maximum sliding velocity in the Wankel engine is, however, in the order of 30 ft/sec relative to the stator, and that can hardly be regarded as a substantial velocity. The combustion in that engine is also found to be quite slow, which shows that the effects of fast combustion described in this disclosure are not involved. That engine must also be classified as an orbital piston engine, while the described engine is a positive displacement gas turbine engine.

Figure 28:
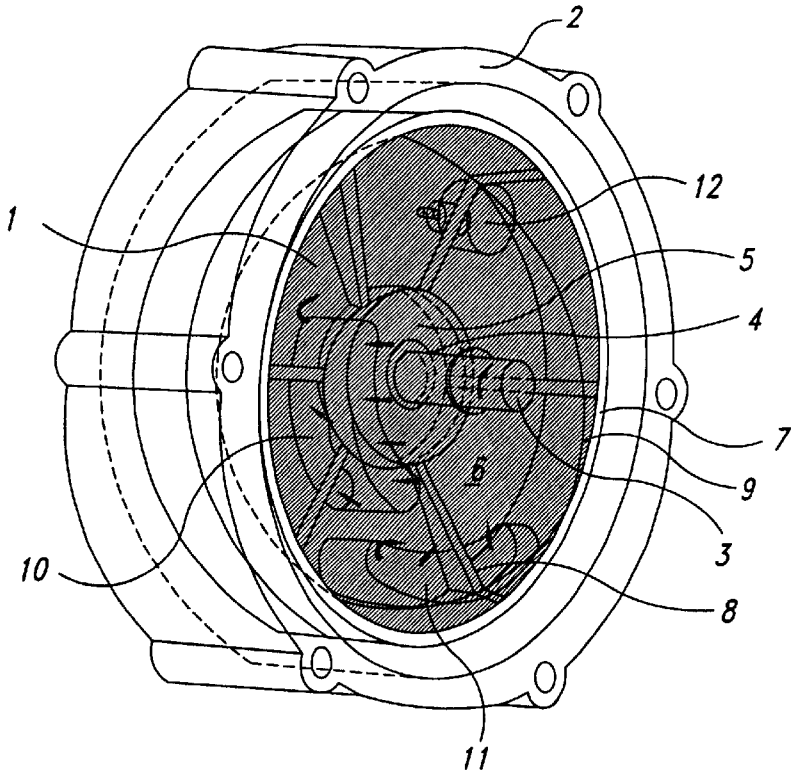
FIG. 28 illustrates in a Semi-transparent View the Four Stroke embodiment of the power section of the engine described in U.S. Pat. No. 3,763,844.
Figure 29:
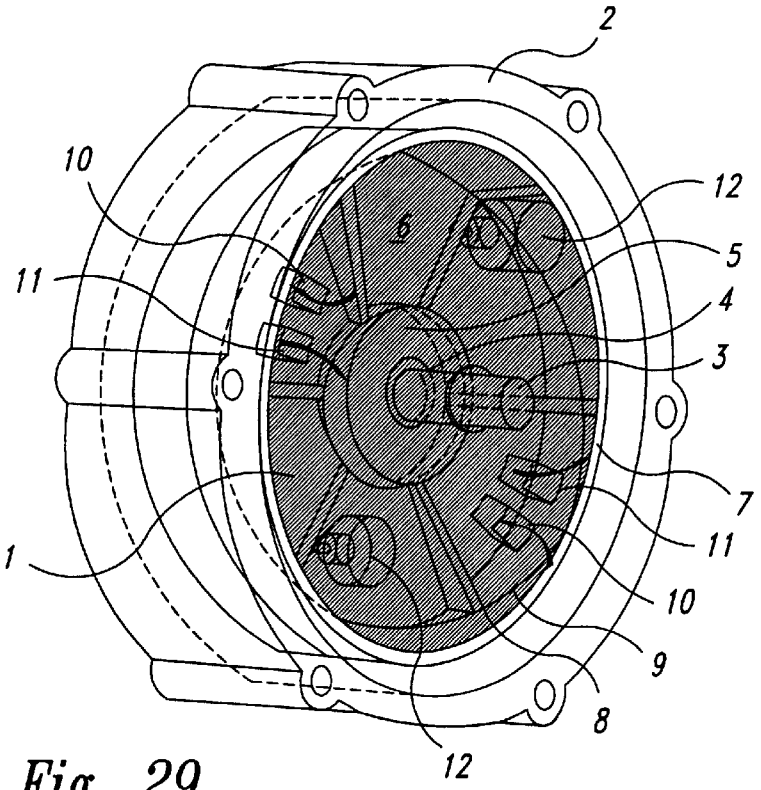
FIG. 29 illustrates in a Semi-transparent View a New Two Stroke version of the power section of an engine of a similar embodiment to the engine shown in FIG. 28.
Figure 30A:
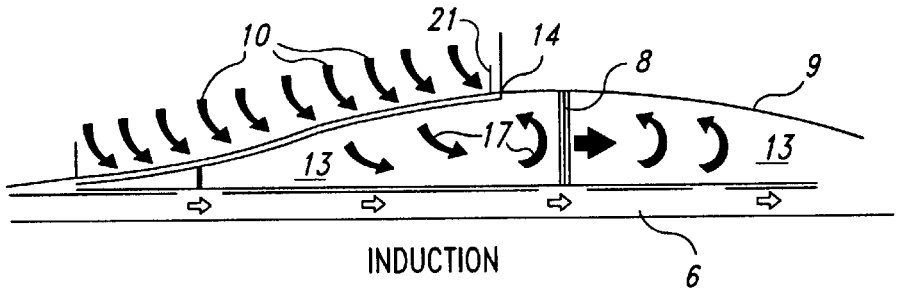
FIGS. 30A–D illustrate a Modified Four-stroke Cycle arrangement for the engine shown in FIG. 28.
Figure 30B:
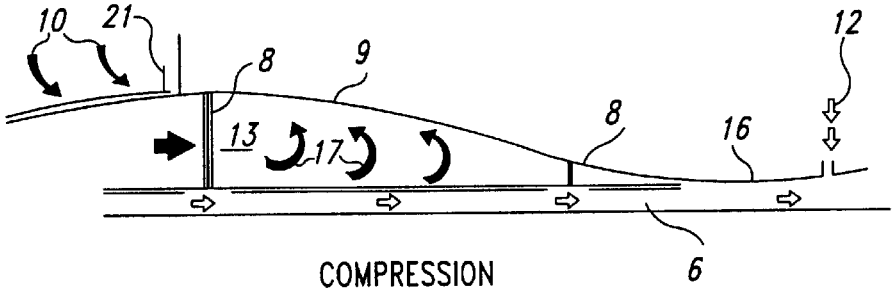
Figure 30C:
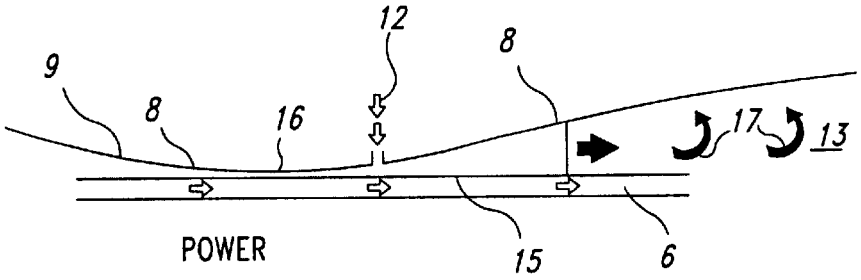
Figure 30D:
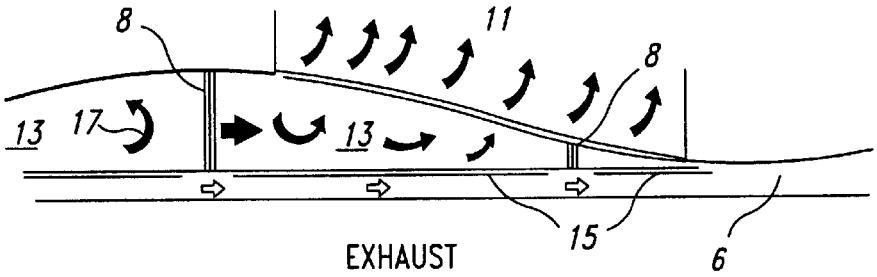
Figure 39:
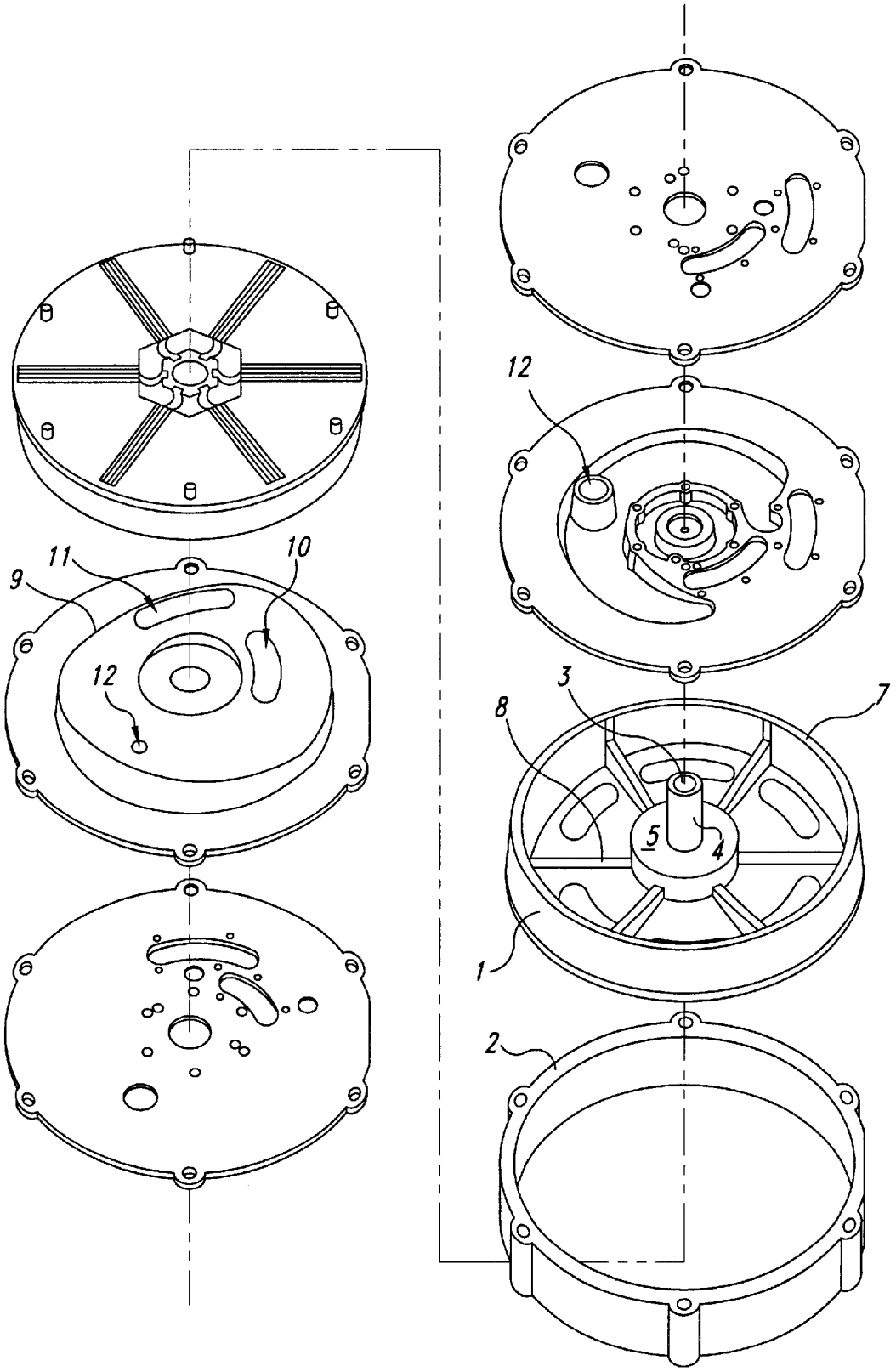
FIG. 39 shows an exploded view of the engine of FIG. 28.
Figure 40:
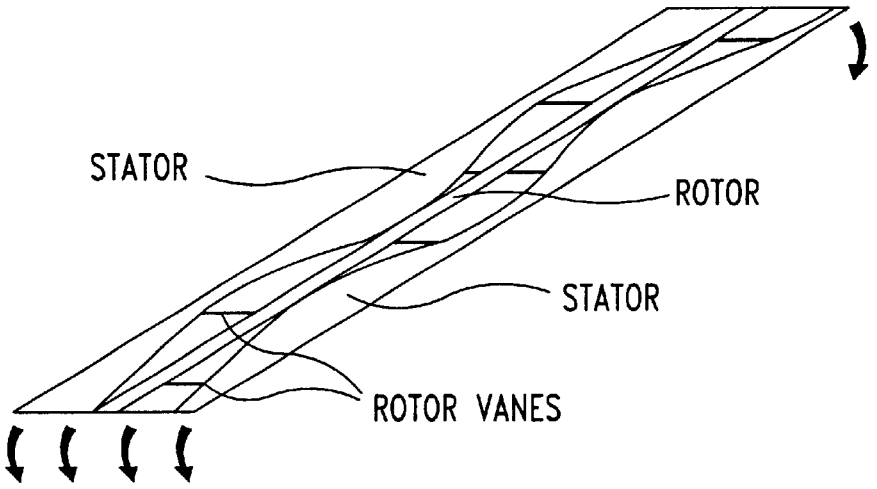
FIG. 40 is a schematic isometric view showing the relationship between the rotor, rotor vanes and the sinusoidal stator surfaces of the engine of FIG. 28.
Figure 41:
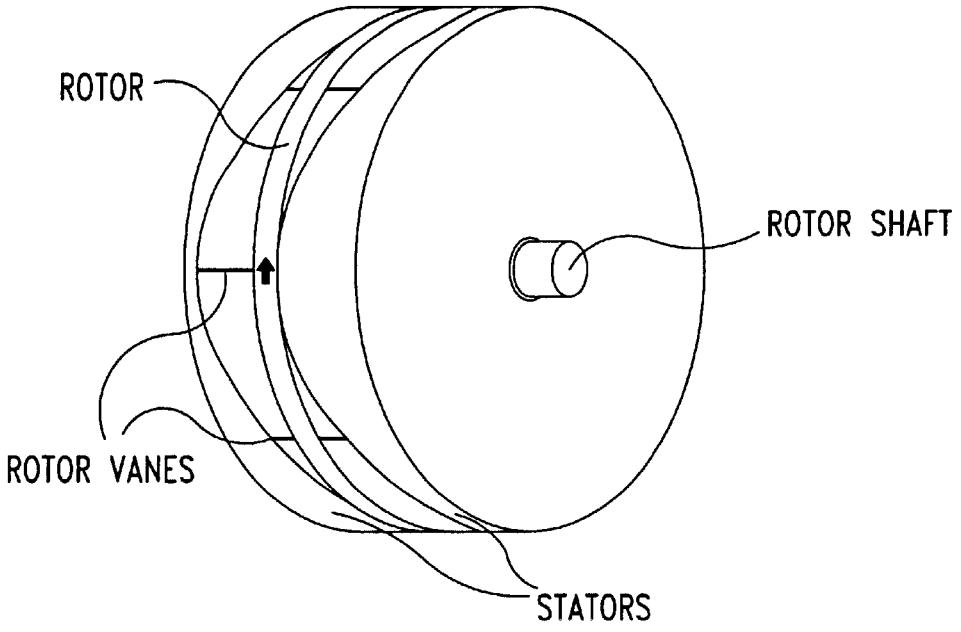
FIG. 41 is an isometric view of the components of the engine of FIG. 28, more clearly showing the sinusoidal stator surfaces.

FIGS. 28 and 39 show the preferred embodiment of the disclosed four stroke cycle engine capable of executing the described new thermodynamic cycle. The engine is a derivative of the engine described in the cited U.S. patent, which has been greatly improved in all aspects and developed to meet the requirements for the present disclosure. FIG. 29 shows the preferred embodiment of the two stroke cycle engine working on the new principles.

The main features of the engine are as shown in FIGS. 28, 30 and 39–41 are as follows:

A rotor 1 is made to rotate inside a stator housing 2 on a main shaft 3 supported in two shaft bearings 4 as shown in FIGS. 28, 29 and 39. The rotor 1 comprises a rotor hub 5, a rotor disk 6, and a rotor rim 7. In the rotor hub 5, which also acts as thrust bearing, six rotor blades alternative rotor vanes 8 are pivoted for axial movement while penetrating the rotor disk 6 through six slots. As can best be seen in FIGS. 40 and 41, the sides of the stator housing 2 facing the rotor disk 6 on either side of the rotor disk 6 are shaped to double sinusoidal curvatures and form contoured stator walls 9, oriented 90 degrees out of phase with each other. The six rotor blades 8, the rotor disk 6 and the contoured stator walls 9 enclose six positive displacement type traveling combustion chambers on either side of said rotor 1.

In FIGS. 28 and 39 there is one intake port 10, one exhaust port 11, and one igniter hole 12 in each contoured stator wall 9, on either side of the rotor disk 6, to negotiate flow into and out of the traveling combustion chambers 13 (FIGS. 30A–D), and to ignite the compressed fuel-air mixture.

Features for cooling and lubrication, and other essential services have been omitted from said drawing for illustration clarity.

FIG. 29 shows the same basic power section in a two-stroke cycle version, featuring two intake ports 10, two exhaust ports 11, and two igniters 12 per side. FIG. 29 is not to scale, and thus does not accurately show that the intake ports are located closer to the main shaft 3 than the exhaust ports 11 as shown in FIG. 28. The positioning facilitates combustion chamber scavenging and recharging to replace the missing suction stroke in two stroke cycle piston engines. In the four-stroke versions this positioning enhances the engine performance.

The features of the two engines shown in FIGS. 28, 29 and 39–41 are quite similar, except for the addition of the two sets of inlet, exhaust, igniter openings and corresponding cooling provisions for the two stroke engine. Since the two-stroke cycle versions of the engine needs some means to compensate for the two missing strokes in their cycle, these two strokes from the four-stroke cycle engines are used for fuel-air mixture breathing, and in the two stroke engine for power and not for aspiration. Thus, the two stroke cycle engines have almost twice the displacement volume of the four-stroke one, and will thus breathe twice as much fuel-air mixture by means of the radial pumping. This engine is therefore a very powerful version, very closely packaged. The intake and exhaust ports of this engine are reduced in size to preserve the engine compression ratio.

FIG. 30 shows the four positive displacement operating strokes of the thermodynamic working cycle of the engine shown in FIGS. 28 and 39. The intake port is now located at right angle 14 to the traveling combustion chamber 13. This causes the flow to separate and form a vortex 17 to prevent the flame from blowing out in the higher rotor speed range. This is a standing vortex until the trailing rotor blade 8 closes said combustion chamber 13, and said vortex 17 moves with said chamber 13 as a free vortex, where the product of the angular velocity and the rotation radius is constant.

The exhaust port 11 is placed at a right angle to the said combustion chamber 13 direction of travel. This prevents an imbalance force against the trailing rotor blade 8, which could reduce engine performance.

The location of the igniter plug hole has been discussed earlier in this disclosure, and the shown location is one example and others could be used. The intake 10 and exhaust ports 11 in these engines are located side by side in the contracting and expanded volume locations.

In the original engine described in the cited '844 patent, radial flow passages were provided in the core of the rotor disk 6 to cool the rotor walls to about 350 degrees Fahrenheit temperature. Liquid cooling was required to attain this temperature level. Since the rotor is a powerful radial pump, a substantial power loss of some 86 BHP developed at 10,000 RPM rotor speed. Such a loss was unacceptable, and the liquid cooling was replaced by a less effective air cooling. The air blasting provided less cooling and caused a much higher rotor temperature, peaking around 5000 RPM. Here the pumping capability was low and the combustion temperature had already reached near its maximum value. The rotor disk temperature was lower at 12,000 RPM rotor speed because the air pumping was greater.

By air cooling the rotor disk 6 as described, said rotor 1 temperature could be reduced by some 200 degrees Fahrenheit, but this effect was considered marginal. Research conducted into operation without rotor disk 6 cooling other than that provided by the entering fuel-air mixture, as shown in FIG. 23, that an uncooled rotor will not cause pre-ignition in the compression fuel-air mixture even when low octane fuels are used. The rotor stress levels at elevated temperature could be handled by using better rotor materials. In the normally aspirated version shown in FIGS. 28 and 39 the rotor disk 6 temperatures are expected to occasionally reach 1140 degrees Fahrenheit at full load operation. In a supercharged version said temperatures will be higher. The no rotor cooling configuration is therefore considered acceptable for all operations.

The stator contoured wall 9 temperature was established from friction and wear life requirements. A 350 degree Fahrenheit wall temperature could have been maintained by using a high thermal conductivity stator wall material, but friction favored a 500 to 600 degree Fahrenheit wear surface temperature. The no wear requirement of 10,000 hours at 10,000 RPM in either dry rubbing or lubricated sliding contact also favored such a temperature level. Even if the wear life in lubricated sliding contact is more than 1000 times longer than in dry rubbing, the latter may be preferable from many points of view. The very short residence time of the fuel-air mixture under compression in the high temperature sector of the stator can easily accept the temperature level without any prospect of pre-ignition. The engine is thus capable of near adiabatic operation.

Fuel-air mixing in this engine can be by means of a carburetor or by fuel injection either into the air inlet manifold or directly into the combustion chamber during charging. This is a matter of control only. Almost uniform droplet sizes will develop by the rotating rotor disk 6. Emission of carbon dioxide, however, will be lower if methane is used. Methane is a high octane gas under normal condition.

A special problem arising concerning the combustion process is that of ignition. In an engine with 12 combustion chambers 13 all firing for each rotor revolution, a total of 144,000 sparks are needed per minute at 12,000 RPM. This exceeds the capability of most ignition systems. To reduce this requirement, two separate ignition systems are used, one for each igniter plug. This reduces the ignition requirement to 72,000 sparks per minute per side, which is not attainable with commercially available capacitance discharge or CD ignition systems of automotive designs. A new ignition system capable of 100,000 sparks per minute is under development. This spark frequency barely allows enough time for the capacitors of the CD ignition system to charge to full capacity before next discharge. The normal ignition trigger and distribution systems used in reciprocating piston four-stroke internal combustion engines are not acceptable in the described engines, and must be replaced by a specially designed head with no distributor.

The question of igniter temperature and discharge energy is more involved. In conventional spark igniters the spark energy cannot be varied according to demand, since it takes a certain voltage to jump a fixed spark gap, and the capacity charge at a constant voltage cannot vary the energy discharges. This can be achieved with plasma type ignition systems, where a high voltage is used to ionize the spark gap, and a variable voltage high energy current is discharged over the ionized bridge. This may not be important as ignition advance-retard is still available to compensate for the variations in temperature and energy requirement as shown in FIG. 19 or better. An electronic type of advance-retard arrangement is under development, but a conventional system moving inductive pickups relative to rotating targets is quite acceptable.

The passage 15 over the compression peak 16 is important as seen in FIG. 30. The size of this passage has some influence on the compression ratio, and on the flow velocity over the compression peak 16. To prevent a flame blow-out in this passage when the engine is operating in the high rotor speed range, the vortex 17 is introduced. The passage height is of controlled size to that effect. Operation at increased combustion chamber wall temperatures also contributes to reduce the effect of flame quenching. Without the described vortex, the engine may have difficulty operating above 6000 RPM before flameout would take place. It is important to prevent pre-ignition at high operating loads in the lower process speed range is also the combustion chamber leakage rate. A reduced leakage rate is quite possible, and beneficial as this will improve the low speed torque capability and the associated low speed fuel efficiency. Since most engines are not loaded to maximum torque values at low speeds, this question could be associated with engine application.

Modes of Operation

The principle mode of operation is related to the four-stroke thermodynamic process cycle, although a distinct advantage can be achieved by the two-stroke cycle operations with its radial flow means for inducting fuel-air mixtures.

The principle mode of operation is as follows. (See FIGS. 28, 29, 30 and 39):

A combustible fuel-air mixture is drawn into the combustion chamber 13 as seen in FIGS. 28, 29, 30 and 39. This happens when the combustion chamber 13 is exposed to the intake duct 10 in expansion relative to the sinusoidal contoured stator wall 9. Fuel and air are mixed in the intake manifold 10 to a near homogeneous combustible gaseous fluid. As the fuel-air mixture flows past the corner or edge 14 to enter the combustion chamber 13, the flow separates and a standing vortex 17 develops at the corner 14. Alternatively, an upright fence 21 proximate to the inlet may trip the flow. In one preferred embodiment, the edge includes an upright fence 21 formed at a substantially right angle with respect to a line tangential to a rotational movement of a rotor forming at least a portion of the combustion chamber. When the combustion chamber 13 trailing rotor blade 8 closes the combustion chamber 13 from the intake duct 10, the vortex 17 will move with the combustion chamber 13 at a rotor 1 speed relative to the sinusoidal contoured stator sinusoidal wall 9. The vortex reduces in diameter and increases in velocity of circulation as the chamber 13 goes into compression and enters the flow passage 15. Superimposed on this circulation is a radial circulation assisting the filling of the combustion chamber 13. The flow velocity in the inlet duct 10 is about the same as the rotor speed relative to the contoured stator wall 9.

During the gas movement the combustion chamber 13 passes the igniter in the ignition hole 12, from which a flame emerges at a timed position of the combustion chamber 13 relative to the contoured wall 9. The traveling vortex 17 induces a relative back-flow near the contoured stator wall 9 and this flow rotation secures a stable flame downstream and upstream from the igniter location for the duration of the combustion. During the gas flow through the flow passage 15 over the compression peak 16 of the sinusoidal contoured stator wall 9 the gas moves at a very high traveling speed. The flow diffusion downstream of the flow passage 15 reduces the traveling speed of the combustion gases and increases the static pressure and temperature while reducing the dynamic head.

During the flow of gases through the flow passage 15 between the rotor disk 6 and the stator 2, the rotor blades 8 will expose varying areas. The pressure application of the enclosed gases at elevated pressure levels in the combustion chamber 13, is thus developing torque about the main shaft 3 over a constant arm.

Combustion of the enclosed combustible fuel-air mixture takes place during gas flow through the flow passage 15 in the rotor disk 6. During the combustion within the combustion chamber 13 a rapid rise in pressure and temperature takes place causing a radical drop in flow Mach No., while the flow velocity remains constant. This leads to a marked rise in static pressure and a reduced pressure drop over the flow passage inside the combustion chamber 13. The static pressure will rise further during the diffusion into the leading part of the combustion chamber 13 after passing the compression peak 16, as mentioned above.

Toward the end of the expansion stroke, the exhaust manifold opens the combustion chamber 13 to the atmosphere or the power recovery means at a sharp angle to the rotor disk 6 and the direction of rotation. This prevents back pressure on the trailing rotor blade 8 and vents the residual combustion chamber 13 pressure for a new induction stroke after scavenging the residual gas during the passage of the second compression peak 16.

The flow channel operation described here is quite different from the one described in the cited U.S. patent. The creation of a flow vortex to stabilize the flame at high rotor speeds to secure against flame blowout during combustion through the flow passage 15, the intake and exhaust flows directed perpendicularly to the rotor disk movement, the elimination of rotor cooling, the severely reduced stator cooling leading to near adiabatic operation, the lean mixture combustion method, the alternative methods of power recovery by attaching the residual heat energy in the exhaust gas, and the combined method of power recovery and turbo-charging to secure an extremely high power output from the fuel-air mixture, improve the new engine versions above the previous concept. As shown, the described method of combustion permits operation at reduced equivalence ratios, a fast combustion and a high process speed, that permits the use of low octane fuels, heating value controlled power output, and external fuel-air mixing. This leads to higher engine power and a radically reduced emission of carbon dioxide, carbon monoxide, excess fuel emission, and emission of oxides of nitrogen which in near adiabatic engines can become a deterrent to high power extraction.

FIG. 29 shows the same type of engine in a two-stroke thermodynamic operation. Most two stroke engines are not self sustained with respect to fuel-air induction and scavenging, as they lack the ability to aspirate without some additional means of pumping, either an external pump or the crankcase. Assuming for the moment that such functions are available, the fuel-air mixture in the same combustion chamber 13 in a swirling vortex 17 operation will be compressed between the contoured stator wall 9 and the rotor disk 6. Reaching the maximum compression at the compression peak, the fuel-air mixture will be ignited by the igniter 12 during the gas mixture flow through the flow passage 15. The flame will penetrate downstream into the expanding part of the combustion chamber 13 and also upstream against the flow. Since each combustion chamber 13 completes two power strokes during each rotor 6 revolution, the displacement volume of this engine becomes twice that of the four-stroke engine shown in FIGS. 28 and 30. This engine will therefore need 288,000 ignition pulses per minute during operation at 12,000 RPM. With two trigger heads connected in parallel this number can be reduced to 72,000 sparks per minute using four ignition systems and two igniters plugs. With almost twice as much power and the same resistance, this engine can operate in excess of 12,000 RPM. A slight loss in compression ratio prevails for this engine as the intake ports are placed in the compression stroke area of the engine operation. Induction and scavenging in these engines are afforded by locating the intake port closer to the rotor shaft than the exhaust ports, and the effect of a radial pump will serve this purpose.

Combustion Control and Engine Performance

This section of the disclosure is directed to the method of combustion and flow path operations associated with this combustion. This could be used in many engines, including the one of the '844 patent, but for this section a specific engine embodiment is not necessary to discuss and theoretical operation is explained. New engines are normally pursued for their performance and to a much lesser degree for their architecture, although they must be adaptable to their intended uses.

In the pursuit of engine performance the combustion performance is very important. Engine compression and the engine breathing capability must be pursued to their practical limits for the type of engine involved. Combustion must be conducted as fast as possible, with a minimum loss to engine cooling and exhaust. The various parameters controlling the combustion velocity were described in previous sections. The most important variable available for combustion control in a defined engine operating on a fixed fuel-air ratio is the ignition temperature.

For lack of other combustion control in a conventional reciprocating piston internal combustion engine, ignition control is achieved by an advance-retard mechanism. This moves the ignition point earlier or later in the compression stroke of the thermodynamic cycle to compensate for variations in combustion velocity during various speed and load conditions. This is done to place the peak combustion pressure correctly and most composed for best power output in the power stroke. An early or late ignition means slower combustion with less clearly defined pressure peak.

FIG. 19 shows that when full load is required from the described engine, and the ambient temperature does not vary, a single ignition temperature will be satisfactory. The lower compression pressure and temperature in part power operation caused by combustion chamber leakage and intake manifold throttling, requires more time for combustion, so the ignition point must be advanced. Slow combustion normally means that less torque is developed, so a method permitting variable ignition temperature is more desirable than advance-retard operations. While the latter method is more common, variation in ignition temperature may only be a matter of development.

To vary the ignition timing for an inductive pickup relative to the moving rotor targets is very easy, and a conventional intake manifold pressure type actuator can be adapted with few changes to standard components. To vary ignition temperature may be more difficult, especially if a jet flame is used to ignite the compressed combustion chamber mixture. The matter of flame temperature of the jet can become very involved.

The most common method for meeting the load and engine speed requirements in a conventional reciprocating piston internal combustion engine is by throttling the inlet manifold. This reduces the inlet manifold pressure available for engine operation, as if the engine operated in less dense air at a high altitude. This is the only method usable in conventional reciprocating piston gasoline engines, since the lean flammability limit in these restricts lean mixture operation. Lean total mixture operation controls are used in Diesel engines. Engines used in airplanes normally have means of fuel-air leaning for use at a high altitude.

The expanded lean mixture flammability limit in the described heat engine opens the possibility that engine speed and load control can be achieved both by inlet throttling and by fuel-air mixture variation, thus allowing for better engine control.

FIG. 10 illustrates the flammability limits for the flame tube in a modern gas turbine engine combustion chamber. The blowout limit range is here seen as the fuel-air equivalence ratio plotted against a correlation parameter, PT/V, where:

P=combustion chamber compression pressure [psia]

T=combustion chamber compression temperature [°R]

V=combustion chamber gas travel velocity [ft/sec]

Applying values from FIGS. 11, 12, and 13 as an example, the parameter computed for the disclosed engine at 1000 RPM on a hot day approximately becomes:

$$PT/V=(50)(900)/50=900\ (\text{psia})(°R)/(\text{ft/sec})$$

Again referring to FIG. 10, it is seen that the combustion chamber may operate at an equivalence ratio down to 0.30, while a ratio of more than one is normally used in the reciprocating piston internal combustion engines. Note that this is a different method of combustion.

In Tech. Ref 5, the gas flow had a static pressure of 14.7 psia, and a static temperature of 210 degrees Kelvin or 378 degrees Rankine, which is very cold. At Mach. No. 1.5, PT/V=(14.7)(378)/(952.8)=5.83(psia)(°R)/(ft/sec) at a mass fraction of methane to air of 0.037 lb/lb giving an equivalence ratio of (0.037)/(0.058)=0.636. FIG. 10 shows that the blow out boundary for this equivalence ratio in the gas turbine combustion chamber liner should have PT/V values of about 400 (psia)(°R)/(ft/sec). FIG. 12 shows much higher temperatures. It is thus shown that the flow tube combusting high velocity methane-air can operate in a stable manner at a much lower PT/V value than the gas turbine combustion chamber liner.

Similarly, in FIG. 7, ignition takes place at a gas temperature of 1600 degrees Kelvin or 2880 degrees Rankine. The PT/V value computed for Mach. No. 1.5 based on that temperature gives a PT/V value of 16.1 (psia)(°R)/(ft/sec), which is quite near the previously computed value before ignition took place.

As the combustion progresses, the chain reaction of events in a flow tube and in a closed combustion chamber become very different. In a flow tube, the Mach No. prevails, while the temperature and flow velocity increase in value as heat is added. The pressure remains constant. In a closed volume combustion chamber, as shown in the described heat engine, the flow velocity prevails, the pressure and temperature increase, and the Mach. No. decreases. By applying the values from FIGS. 13, 21 and 22 for the same 500 RPM operation, the new PT/V value for the disclosed engine becomes 38,000 (psia)(°R)/(ft/sec). This shows that the flame becomes even more stable as the combustion progresses, if flame stability over such a short time span makes any sense.

It seems here that the blowout limit has moved to a lower correlating parameter value with the increase in velocity of the fuel-air mixture compared with a modern combustion chamber liner in a gas turbine engine. Flame stability therefore is not a problem in the derivative of the positive displacement engine cited in the U.S. patent.

Therefore, operation at idle power at a high altitude or with a nearly closed manifold throttle is not a problem. It is maybe better to resort to lean mixture operation at a high altitude instead of intake manifold throttling. For starting at a high altitude, it may be desirable to use a wide open throttle with the intake pressure supplemented by any available ram pressure and run at a lean fuel-air mixture.

Figure 31:
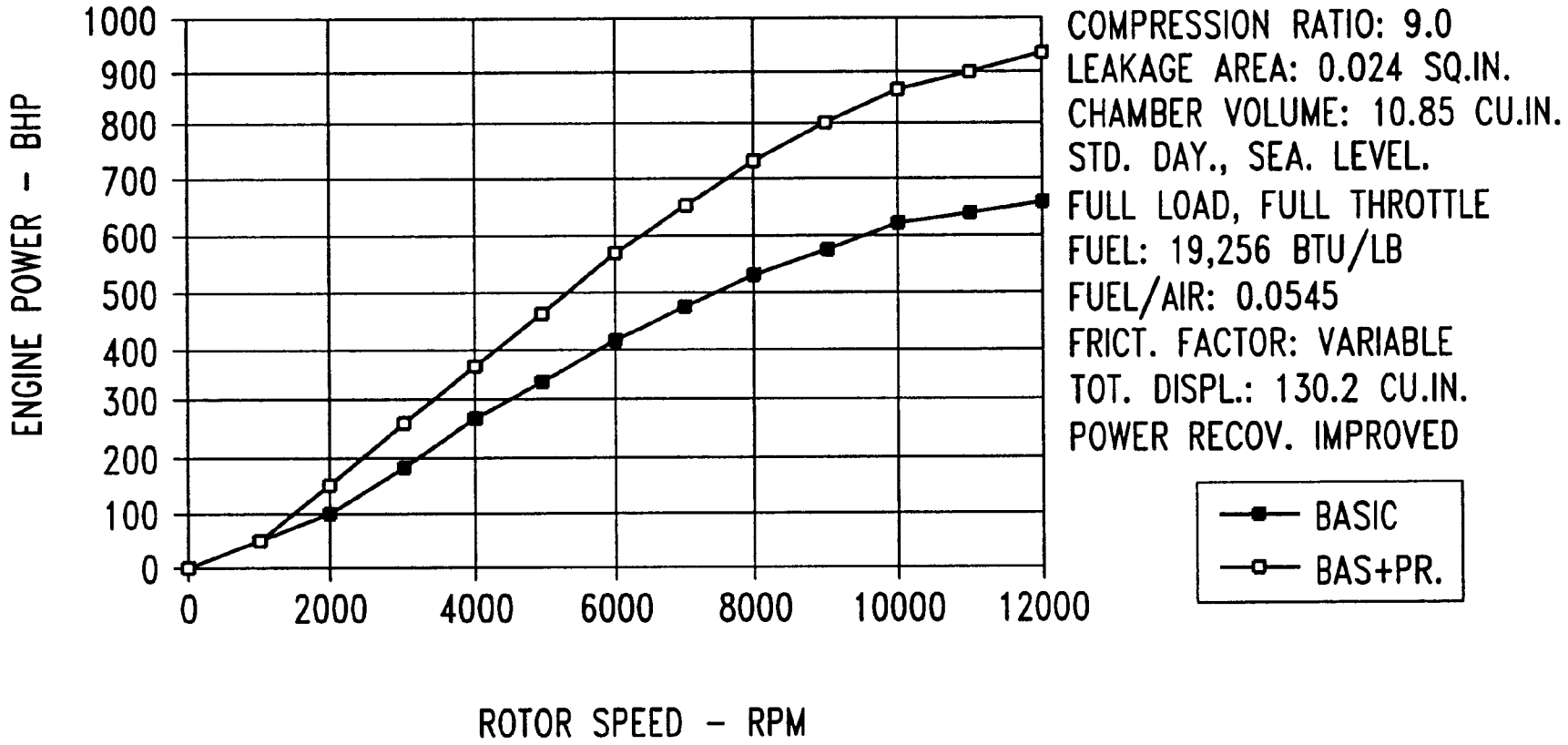
FIG. 31 shows an estimate of the Power Performance potentials of a normally aspirated engine shown in FIG. 28 and in a Power Recovery compounded version of the configurations shown in FIG. 28 and 34.

FIG. 31 shows the power performance of the four-stroke engines in two different configurations. The lower values refer to the basic engine in a normally aspirated version. The higher values refer to the same four-stroke engine in a normally aspirated version with power recovery in the exhaust exit geared back to the main shaft. Both engines consume the same amount of fuel-air mixture, but the engine with the power recovery extracts more power from the fuel. In a turbo-charged version, the peak power level will reach some 1600 BHP, but then the fuel-air mixture mass has nearly doubled. In the two-stroke cycle configurations, the peak power level reaches about 3300 BHP, but here the flow of fuel-air mixture has doubled compared with the corresponding four-stroke cycle engine versions.

Figure 32:
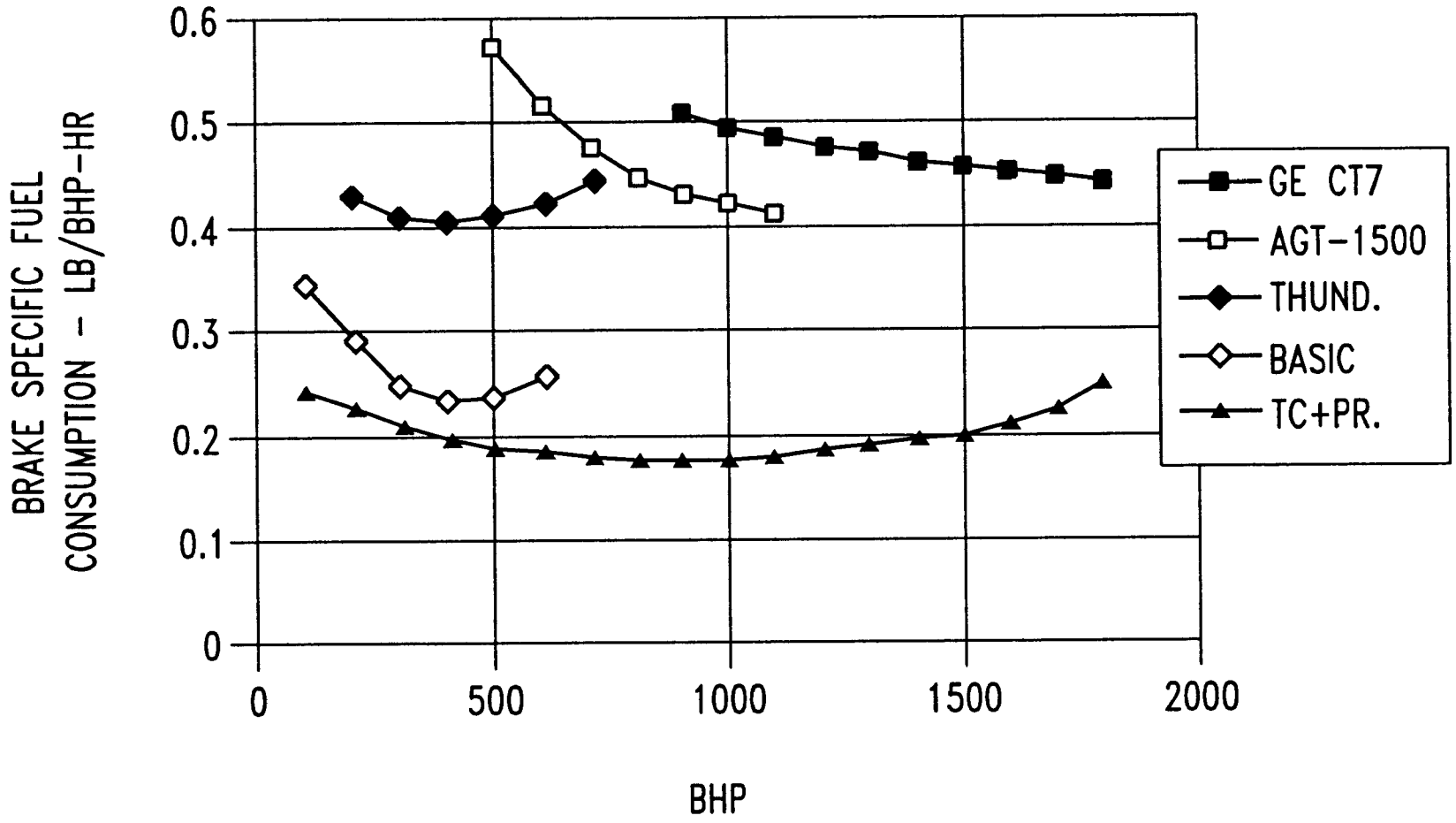
FIG. 32 shows estimated Brake Specific Fuel consumption (BSFC) versus engine power for the GE CT7, Lycoming AGT-1500, Thunder, the Basic Design Concept Engine of FIG. 28, and the Basic Engine in Turbo-charged and Power Recovery configurations, FIGS. 28 and 35.

FIG. 32 shows the engine performance in the basic and the turbo-charged, turbo-compounded versions of the described four-stroke cycle engine in terms of Brake Specific Fuel Consumption versus Engine Power. These are compared with two small gas turbine engines and an automotive engine modified for airplane use. As seen from the figure, the described engines are most economical at 50% power or around 6000 RPM. The fuel consumption curves, however, remain almost flat from some 2000 to 12,000 RPM. The General Electric CT-7 engine is used extensively in large helicopters, the Lycoming AGT 1500 turbine engine is exclusively used in the M-1 Abram Main Battle Tank, and the Thunder engine is an open issue.

Best power operation in conventional piston type positive displacement internal combustion (SI) engines is normally found at about 15% rich fuel-air mixture, where the combustion velocity is highest. More heat but less power is available at the stoichiometric fuel-air ratio, but at a slower combustion velocity. Since an internal flow velocity was introduced into the disclosed heat engine, the loss in Brake Mean Effective Pressure (BMEP) normally found when operating in lean fuel-air mixture due to the slower combustion rate is overcome by the higher combustion velocity factor. The engine power output will now become a function of the available heat. Thus, as much power or more is now available at 15% lean fuel-air mixture as in 15% rich mixture. The values shown in this disclosure refer to 15% rich and about 15% lean fuel-air mixtures.

Operation in lean fuel-air mixtures without loss in engine performance leads to a reduced emission of carbon monoxide, and less excess hydrocarbons emission in combustion, and since less fuel is used also to a reduced the emission of carbon dioxide. Almost no emission of carbon monoxide and hydrocarbon will be exhausted. Since low octane fuels are acceptable, and the combustion is fast, practically all recognized pollutants are controlled to extremely low emission levels, when fossil hydrocarbon fuels are used in the disclosed positive displacement engines. Oxides of nitrogen levels of 0.01 to 0.1 g/kg fuel are possible. By using methane for fuel the carbon dioxide levels can be reduced by 70% in the best of the described engines compared with jet fuels and gasoline in their respective engines.

The four-stroke versions of the described positive displacement heat engines can produce 4.3 BHP/lb engine weight in the basic version. This compares to about 0.5 BHP/lb engine weight for the best of the four stroke cycle reciprocating piston engines. Also, since the engine air pumping rate is very high for its displacement volume, and little heat energy is lost to cooling, the described basic version of the engine will produce some 5.0 BHP/cu.in. displacement at full engine speed and load, and some 650 BHP/lb of air consumed. A small gas turbine engine will produce about 125 BHP/lb of air consumed. The engine power output is now increased by a factor of 2.5 over the engine described in the cited U.S. patent. This performance improvement is also the result of mechanical improvements outside the scope of this disclosure. From a fuel consumption rate of 0.5 lb/BHP-hr for a typical four-stroke reciprocating piston engine, the fuel consumption of the basic disclosed engine went from 0.4 to 0.26 lb/BHP-hr in the improved embodiment. Fuel consumption then went further down to some 0.18 lb/BHP-hr for the compounded versions. Since less fuel is consumed to produce the same power, less carbon dioxide must also be produced. If methane was used for fuel, another 15.2% reduction in fuel consumption can be expected.

Figure 42:
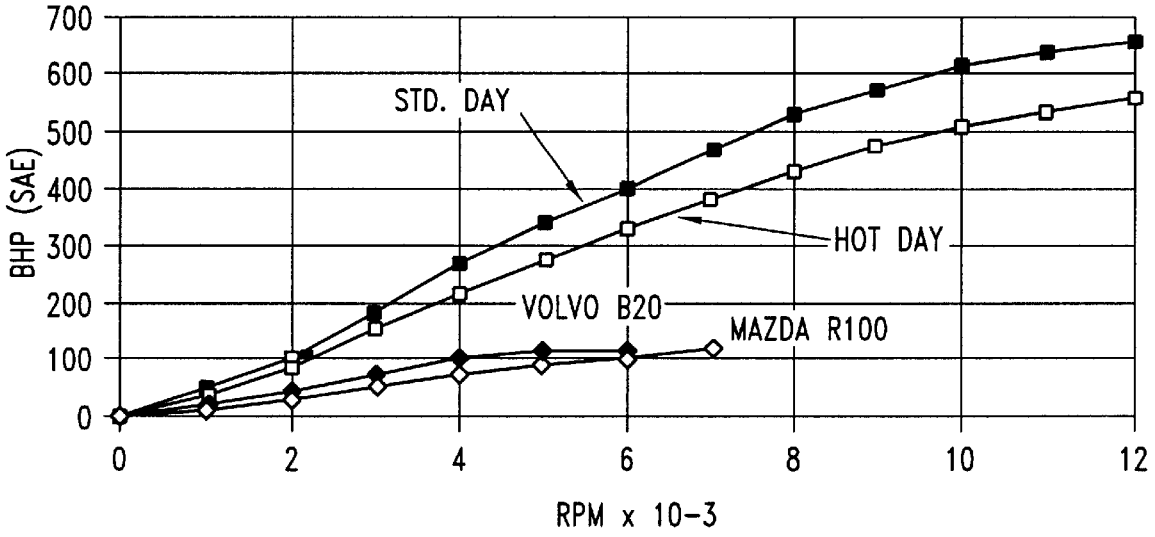
FIG. 42 illustrates a comparison of the performance characteristics in terms of break horse power of an engine operated according to the disclosed method and two other engines.
Figure 43:
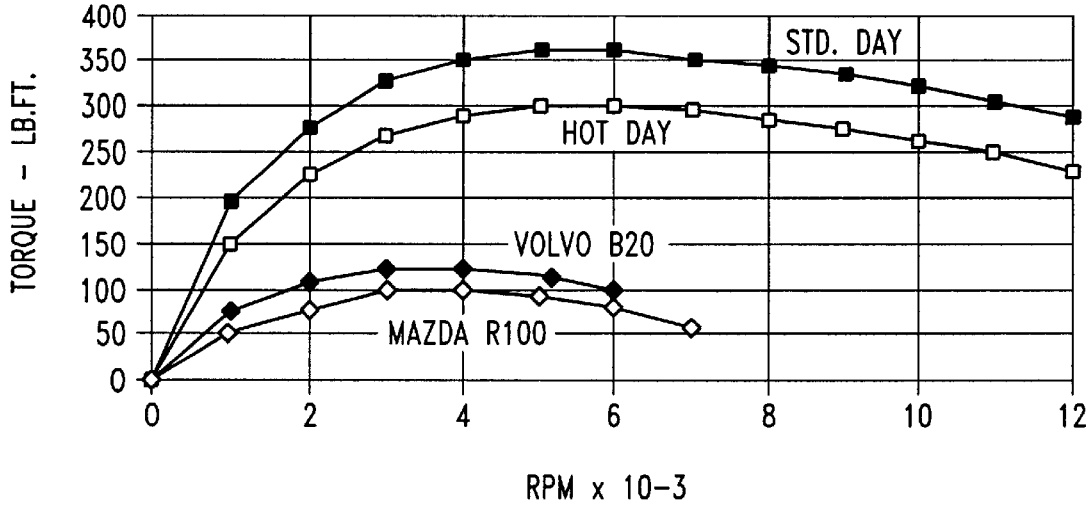
FIG. 43 illustrates a comparison of the performance characteristics in terms of torque-pounds-foot of an engine operated according to the disclosed method and two other engines

A comparison of the performance characteristics of the above described engine operation and other engines is shown in FIGS. 42 and 43. The reference engine operated under the principals described herein develops significantly more brake horse power and torque than comparable engines.

Due to low combustion velocity, reciprocating piston type internal combustion engines must have their fuel-air ratios increased to rich mixture when operating at idle speeds and loads. As shown earlier in this section, the described positive displacement engine will combust at least 21% faster. Lean fuel-air mixtures also will be usable at idle speeds, and the emission of excess hydrocarbons and carbon monoxide will be almost eliminated.

Near adiabatic operation of the disclosed engine will result in higher exhaust pressures and temperatures, which leads to high infrared emission and high exhaust gas noise levels. Peak exhaust gas temperatures up to 1855 degrees Fahrenheit and high enough residual pressure to cause supersonic exhaust gas velocities are expected. This will cause free exhaust noise levels below the threshold for discomfort on the A-weighted scale, corrected for high impulse frequency to go as high as 113.8 dB at a 10 ft. distance. This means 85.3 dB at a 200 ft. distance and 66 dB at a 1000 ft distance from the exhaust outlet while operating at 10,000 RPM. The highest noise level is found in the seventh octave.

Since relative small gas masses are involved, the noise level can easily be muffled down to a close field goal of approximately 75 dB(A). More beneficial, but also more involved, is the recovery of some heat energy from the exhaust. This involves expanding the exhaust gas pressure to a lower pressure level and by that reducing the residual exhaust gas temperature and exit jet velocity.

Exhaust gas recovery may be introduced in different or additional manners involving the conversion of energy to engine shaft power, to thrust, or to steam or heat. A static thrust level of some 75 lbs/lb of air is available from the exhaust for special applications. The energy recovery by blow-down is limited to available pressure, but more heat may be recovered otherwise. Both noise and exhaust gas temperatures are reduced by these methods.

Alternative Methods and Embodiments

In positive displacement internal combustion constant volume combustion (SI) engines, where the compression ratio and the expansion ratio are equal, there will always be a substantial amount of energy lost through the exhaust ports. This heat loss is higher for near adiabatic engines than for conventional ones, where some of this loss takes place through the combustion chamber cooling. The purpose of the shown alternatives is to produce or recover more power from the disclosed heat cycle by means of exhaust gas recovery and additional turbo-charging.

This specification describes an advanced method of closed vessel or combustion chamber combustion, that can be executed in a special class of fast operating, positive displacement, internal combustion engines. A fast flow inside the combustion chamber serves to expand the lean fuel-air mixture flammability limit, so that leaner fuel-air ratios can be combusted. The rapid process operation also means that this engine becomes insensitive to fuel octane values, and permits near adiabatic operation without the use of ceramics. Since the near adiabatic operation also induces a higher than normal exhaust gas energy loss, some means of energy recovery becomes important.

In a reciprocating piston type internal combustion (SI) engine the displacement volume and the compression ratio are based on the volume swept between the bottom and top dead centers. In the described positive displacement engine the swept volume is the volume swept between the closing of the intake port and the top dead center. The expansion volume is the volume swept between the top dead center and the opening of the exhaust port. By moving the intake port closer to the top dead center, the compression ratio can be made smaller than the expansion ratio, which again may reduce the power output but improve engine operating efficiency. To meet this operation, the number of combustion chambers in the circumference can be increased, thus increasing the compression ratio. This again may mean a larger engine diameter and a larger diameter rotor hub, so the benefits of this change may be questionable.

Figure 33:
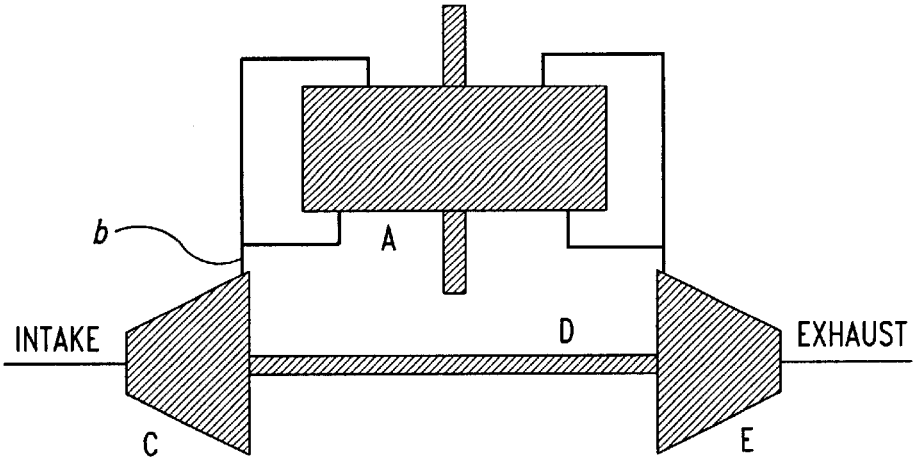
FIG. 33 shows a schematic of the Power Section of the engine in FIG. 28 in a Turbo-charged version.

FIG. 33 shows a schematic of the basic four-stroke power section A of FIG. 28 in a turbo-charged configuration. Air is drawn into the compressor C and compressed to higher pressure and temperature levels. Fuel B is introduced into the compressed air to form a homogeneous fuel-air mixture. This mixture enters the engine A combustion chamber and is further compressed, combusted and expanded. The residual expansion gas at elevated temperature and pressure is expanded further toward atmospheric pressure in the expander E. This again drives the compressor C through shaft D. All excess energy is exhausted to the atmosphere.

Figure 34:
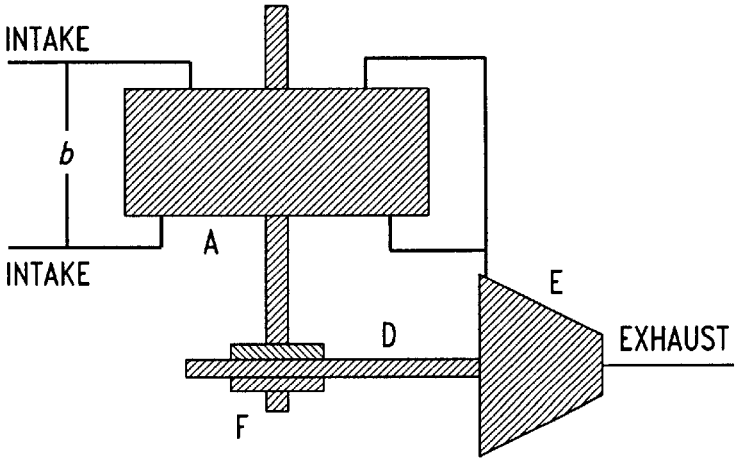
FIG. 34 shows a schematic of the Power Section from FIG. 28 in a compounded version and with a speed reducer geared to the power shaft.

FIG. 34 shows a schematic of the four-stroke power section A from FIG. 28 in a compounded version with an expander E with its shaft D geared to the engine shaft. Residual combustion gases at elevated pressures and temperatures are expanded toward atmospheric pressure in the expander E, which transmits its power output to the basic engine shaft B through a speed reducer F. A turbine should run up to 40,000 to 60,000 RPM. A positive displacement expander should run close to basic engine speed.

Figure 35:
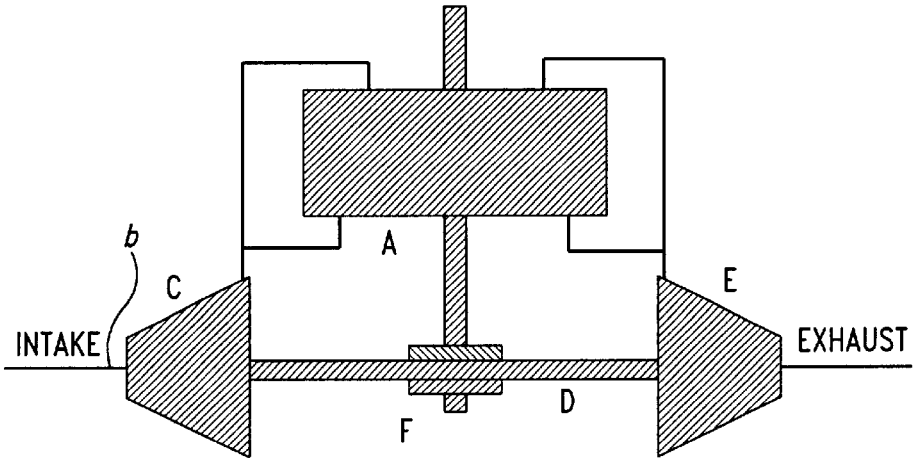
FIG. 35 shows a schematic of the Power Section of FIG. 28 in a compounded configuration with an expander and a compressor geared to the power shaft.

FIG. 35 shows a schematic arrangement of the basic four stroke power section A from FIG. 28 with a turbo-charger C, D and E geared to its drive shaft through a speed reducer F. Air is again drawn into the compressor C and compressed to a higher pressure and temperature level, where fuel B is induced to form a near homogeneous fuel-air mixture. The fuel-air mixture is further compressed in the basic power section A where combustion and expansion also take place. The expanded gases are then exhausted into an expander E. Here the residual pressure is further expanded to near atmospheric pressure at C. The turbo-compressor drive shaft is geared to the power section shaft by means of a speed reducer F. More energy is here taken out of the exhaust gas than is required to drive the compressor C.

The performance of this last type of engine system at an intake manifold pressure at 2 atmospheres shows an enhancement of the equivalent brake mean effective pressure (BMEP) to about 490 psi. The brake specific fuel consumption is still well below 0.20 lb of fuel/ BHP-hr as shown in FIG. 32. The power/weight ratio of this engine is near 8 BHP/lb weight, which is dependent upon the choice of material and components. The exhaust temperature and noise levels are lower than for the preceding case.

Figure 36:
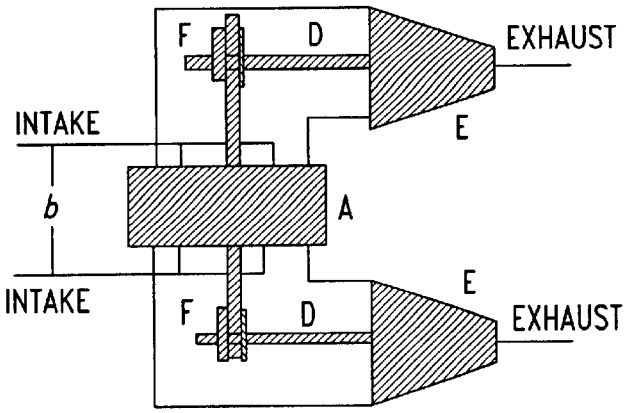
FIG. 36 shows a schematic of the Two-stroke Power Section of FIG. 29 in a compounded version with two expanders geared to the engine shaft.

FIG. 36 shows a schematic arrangement of the two stroke engine power section from FIG. 29 with two exhaust gas expanders in the exhaust flow gas path. The double arrangement is shown to simplify the duct work of the manifolds between the engine power section A the expanders E. This arrangement doubles the power output compared with the arrangement in FIG. 34 due to the higher flow volume. An improvement in engine power/weight ratio is expected.

Figure 37:
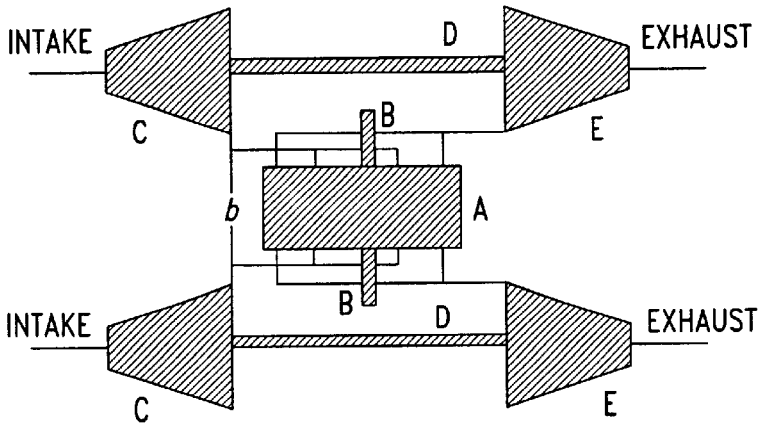
FIG. 37 shows a schematic of the Two-stroke Power Section of FIG. 29 in a supercharged version with two expanders and two compressors.

FIG. 37 shows a schematic arrangement of the two-stroke engine power section A from FIG. 29 with two turbo-chargers C, D and E in the gas flow path. The double arrangement is shown to simplify the duct work of the manifolds between the engine A and the turbo-chargers C, D, and E. The flow path is similar to the four-stroke arrangement of FIG. 29. The exception is that two instead of one intake port, two exhaust ports, and two igniters are involved per side. This engine has therefore twice the displacement of the four-stroke engine of the same dimensions, and the power output is almost twice as high. The power/weight ratio of this engine is about 11.25 BHP/lb engine weight. The equivalent brake mean effective pressure (BMEP) will be in the vicinity of 350 psi, and the brake specific fuel consumption (BSFC) will be close to 0.26 lb of fueUBHP-hr. The manifold pressure is here 2 atmospheres.

Figure 38:
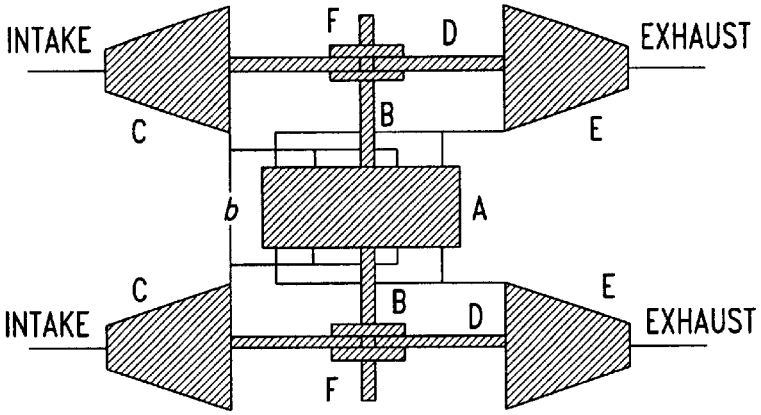
FIG. 38 shows a schematic of the Two-stroke Power Section FIG. 29 in a compounded version with two expanders and two compressors geared to the power shaft.

FIG. 38 shows the same basic two stroke engine power section A from FIG. 29 again with two turbo-chargers C, D, and E. These have now been geared shaft D to shaft B by means of two speed reducers F. The gas flow path is similar to the arrangement of FIGS. 35 and 37. The basic engine here receives excess power from an oversized exhaust expander E transmitting power back to engine power section A power shaft B through shaft D and speed reducer F.

This engine arrangement is very powerful and will produce about 15 BHP/lb of engine weight at an equivalent brake mean effective pressure (BMEP) of about 490 psi. The brake specific fuel consumption (BSFC) will be less than 0.20 lb of fuel/BHP-hr as shown in FIG. 32. This performance is at a full load at 6000 to 8000 RPM at sea level and with an intake manifold pressure of two atmospheres. The exhaust temperature and the exhaust noise level will be lower than in the embodiment of FIG. 29.

Fuel is seen to be introduced into the supercharged engine inlet manifold at B after the exit from the compressor. This was done to subdue the intake manifold gas temperature to act as a precooler for the fuel-air mixture. It is, however, also possible to introduce this fuel into the compressor intake.

This concludes the description of the alternative engine embodiments and configurative arrangements of the described engine combustion and its flow path operation examined in this context. More combinations are, however, possible. It must be clear that any engine, which meets the fast internal flow criteria will be adaptable to the combustion method and the flow path embodiment of this invention.

Some engines that use the process of the invention may obtain greater or lesser advantages, depending on the engine design and other aspects of the engine itself.

It must also be clear that this family of high performance heat engines has been developed with some specific applications in mind. This should, however, not prevent their universal adaptation to other applications.

Conclusion

The technology of combustion is not an exact science and is subject to interpretations and some deviations from the test data. The data shown in this disclosure are intended to show methods and trends, which may deviate some from other methods and information sources and may conflict with some opinions. This is common in any science, where interpretations and logics are required to arrive at a right result. Sometimes we cannot get the results we want from the information available and we must resort to reasonable assumptions.

Evidently the autoignition temperature can be raised by making the fuel/air mixture flow, and the ignition delay and combustion time can be reduced substantially as the temperature, pressure and flow velocity is increased. The ignition delay and the combustion times are related to how the combustion is conducted, normally by 30 times in constant pressure combustion and about 5 times in constant volume combustion. A comparison of the performance of gasoline and methanol combustion in a single cylinder reciprocating piston internal combustion engine confirms that faster burning fuels and higher mixture turbulence levels cause higher performance levels and lower the lean fuel-air mixture flammability limits.

A simplified method of analysis was shown to establish ignition delays and combustion times for various engine operations, and a combustion velocity factor was defined for the establishment to determine the enhanced ignition delays and combustion times from atmospheric baselines.

Besides above discoveries and observations, the analyses teach that low octane fuels can be used instead of high octane ones when fast process operations are involved. Fast combustion can be attained by introducing a fast fuel-air mixture flow velocity into the combustion process. This increases the ignition temperature requirement, but it also reduces the ignition delay and combustion times, so a very fast combustion rate can be developed. Multi-fuel operation capability was thereby established and fuel octane values became irrelevant.

This disclosure further teaches that the increase in ignition temperature can be moved so far that near adiabatic operation is attainable, even when low octane fuels are used. A fast operating engine is, however, required to provide the process operations fast enough to outrun the ignition delay to prevent pre-ignition.

A relatively small amount of stator cooling was left to ease the asymmetric thermal stresses in the stator. The rotor is automatically cooled by the colder fuel-air mixture from the intake manifold. This recovers some heat from the combustion sector through the low thermal conductivity rotor of the described engine.

This disclosure further teaches that ignition delay and combustion times are functions of parameters such as combustion chamber compression gas pressure and temperature, combustion flow velocity, turbulence level, fuel-air ratio, and fuel droplet size.

Also discussed was the need for a flame holder or a vortex to prevent the flame from blowing out at very high flow velocities when the combustion chamber pressure and temperature are inadequate to prevent flame blow-out, or at cold wall operations.

The teachings show a method for estimating ignition energy levels, and it suggests that ignition temperature can be varied by means of the ignition energy level and the ignition gap.

The teachings further show that the flammability limits observed in the reciprocating piston, in a single cylinder type internal combustion (SI) engine can be expanded into the lean fuel-air mixture region when internal flow and turbulence is introduced. The increased combustion velocity described will restore lean fuel-air mixture combustion power levels to best power levels in rich mixture or better. The flame stability, if such a short combustion duration can be called stable, compared with a gas turbine combustion chamber operation, also improves in the disclosed operation.

Also, described are the extensions of the expansion stroke compared with the compression stroke in a positive displacement internal combustion engine. This will result in higher recovery of residual exhaust gas energy, which may be used to enhance the engine shaft power and the operating efficiency.

Then, shown is the conversion of the cited basic positive displacement four stroke cycle engine into a two-stroke cycle one of nearly twice the displacement volume.

The teachings also include the effects of fast process operation on emission of oxides of nitrogen, which causes smog and acid rain to form, carbon monoxide, which induce respiratory problems, and excess hydrocarbons besides exhaust noise and infrared emission of the exhaust gases. A reduction in oxides of nitrogen to some 0.01 to 0.1 g/kg fuel at maximum rotor speed is quite attainable. When methane gas is used for fuel, the emission of carbon dioxide can be reduced by 64% compared with a small gas turbine operating on kerosene or a gasoline fired reciprocating engine.

All technology involved in the combustion and flow path operations have been substantiated by documented test data and analyses. This demonstrates the feasibility of the various operating aspects and shows the execution of the disclosed process operation of said positive displacement internal combustion engine system. The adaption of this technology is the basis for this disclosure.

The final result is a family of engines capable of outstanding performance levels both in terms of specific fuel economy and in power output. These engines are also environmentally more acceptable than any existing internal combustion engine. They are fast in operation, simple in design, compactly packaged, and are also light in weight. In spite of the simplified philosophy and methods used, this specification reveals a very advanced engine concept.

According to one embodiment of the present invention, there is provided in a closed vessel, of the positive displacement internal combustion type heat engine having at least two combustion chambers that travel at a substantial velocity relative to a pair of opposed stator walls. The combustion chambers are formed by the stator walls and at least two rotor blades carried by a rotor shaft and extending through respective slots formed in a rotor disk. The stator walls include an intake port and an exhaust port, the intake port formed radially inward of the exhaust port. The stator walls and the rotor blades successively compress and expand volumes enclosed by the combustion chambers during the travel. The following acts facilitate an advanced method of closed vessel combustion and associated flow duct operation to perform complete thermodynamic cycles. The method includes mixing a volume of fuel and a volume of air to form a fuel-air mixture having a near homogenous combustible equivalence ratio; inducing the fuel-air mixture to flow through the inlet port into the combustion chambers at substantial flow velocities; separating the fuel-air mixture from the stator wall to form a standing vortex at a forward end of the inlet port; advancing a trailing rotor blade to close the inlet port to trap the vortex in the combustion chamber; accelerating the vortex along with the combustion chamber to travel at the speed of the combustion chamber while maintaining a circulatory radial motion of the vortex in the combustion chamber, such that the increased combustion chamber internal flow velocity lowers a combustible fuel-air lean mixture flammability limit of the fuel-air mixture, and in combination with an elevated compression pressure and an elevated temperature increases a combustion chamber ignition temperature and an internal combustion velocity; adding heat to the fuel-air mixture from the rotor disk that is otherwise uncooled while compressing the fuel-air mixture in the combustion chamber without causing pre-ignition, wherein the combustion chamber is capable of operating on rich and lean fuel-air mixtures using multi-octane and multi-fuel combustion; further compressing the fuel-air mixture in the combustion chambers to pass the fuel-air mixture over a compression peak to an expanding leading volume of the combustion chambers downstream of the compression peak at a substantial speed relative to the stator wall and the rotor disk; igniting the fuel-air mixture with an electric spark introduced through an ignition port in the stator wall during the flow through a passage; introducing an electric spark at a location in a thermodynamic cycle of the engine such that auto-ignition from hot gases is prevented, while the combustion chamber ignition temperature, an ignition spark timing, and a number of ignition sparks facilitate optimum engine torque; controlling the fuel, the compression process speed and a combustion chamber leakage rate to prevent fuel-air mixture pre-ignition; developing torque about the rotor shaft by means of the elevated pressure acting on differentially exposed portions of the rotor blades and a constant torque arm to the rotor shaft in response to compression in the combustion chambers before and expansion after flow through the passage; exhausting products of combustion from the combustion chambers to the atmosphere through the exhaust port during expansion at an angle near perpendicular to the rotor disk to prevent an unbalanced force reaction against a trailing one of the rotor blades; and exposing sufficient areas of the stator walls to the combustion and expansion to cool the stator walls.

What is claimed is:

1. A method of operating an engine, comprising:

providing a fuel-air mixture to a combustion chamber having an ignition source;

creating a vortex in the fuel-air mixture entering the combustion chamber by passing the fuel-air mixture over an edge at an inlet to the combustion chamber, the edge being formed by at least one surface at a substantially right angle to the direction of travel of the combustion chamber;

accelerating the fuel-air mixture within the combustion chamber relative to the ignition source;

compressing the fuel-air mixture in the combustion chamber;

igniting the compressed fuel-air mixture in the combustion chamber; and exhausting the combustion chamber after igniting the fuel-air mixture.

2. The method of claim 1 wherein the ignition source is in a wall of a stator forming at least a portion of the combustion chamber and accelerating the fuel-air mixture within the combustion chamber comprises:

moving the combustion chamber relative to the stator.

3. The method of claim 1, further comprising:

accelerating the fuel-air mixture in the combustion chamber over a compression peak for the fuel-air mixture in the combustion chamber prior to igniting the compressed fuel-air mixture.

4. The method of claim 1, further comprising:

injecting a fuel into air within the combustion chamber to create the fuel-air mixture.

5. The method of claim 1, further comprising:

creating a standing vortex in the fuel-air mixture at an inlet to the combustion chamber; and creating a sufficiently low pressure in the combustion chamber to draw the fuel-air mixture including the standing vortex of fuel-air mixture into the combustion chamber as a free vortex of fuel-air mixture.

6. The method of claim 1 wherein compressing the fuel-air mixture in the combustion chamber includes reducing a volume of the combustion chamber.

7. The method of claim 1 wherein compressing the fuel-air mixture in the combustion chamber includes reducing the volume of the combustion chamber by reducing an exposed area of a blade forming, at least a portion of the combustion chamber.

8. The method of claim 1, further comprising:

drawing the fuel-air mixture into the combustion chamber substantially perpendicularly with respect to a rotor forming at least a portion of the combustion chamber.

9. The method of claim 1 wherein igniting the fuel-air mixture in the combustion chamber includes creating an electric spark at an ignition hole formed in a wall of a stator forming at least a portion of the combustion chamber.

10. The method of claim 1, further comprising:

extracting heat from an exhaust resulting from the combustion of the fuel-air mixture.

11. The method of claim 1, further comprising:

expanding an exhaust resulting from the combustion of the fuel-air mixture to recover energy from the exhaust.

12. The method of claim 1, further comprising:

transferring heat to air-fuel mixture in the combustion chamber during the compression from a rotor forming at least a portion of the combustion chamber.

13. A method of operating an engine, comprising:

providing a fuel-air mixture to a combustion chamber having an ignition source;

creating a vortex in the fuel-air mixture entering the combustion chamber;

accelerating the fuel-air mixture within the combustion chamber to a velocity of at least 70 feet per second relative to the ignition source;

compressing the fuel-air mixture in the combustion chamber;

igniting the compressed fuel-air mixture in the combustion chamber; and exhausting the combustion chamber after igniting the fuel-air mixture.

14. A method of operating an engine, comprising:

providing a fuel-air mixture to a combustion chamber having an ignition source;

passing the fuel-air mixture over an edge at an inlet to the combustion chamber, the edge being formed by at least one surface at a substantially right angle to the direction of travel of the combustion chamber, to create a standing vortex in the fuel-air mixture entering the combustion chamber;

drawing the standing vortex of fuel-air mixture into the combustion chamber as a free vortex of fuel-air mixture;

compressing the fuel-air mixture in the combustion chamber;

igniting the compressed fuel-air mixture in the combustion chamber; and exhausting the combustion chamber after igniting the fuel-air mixture.

15. A method of operating an engine, comprising:

providing a fuel-air mixture to a combustion chamber having an ignition source, passing the fuel-air mixture over a fence proximate an inlet to the combustion chamber to create a standing vortex in the fuel-air mixture entering the combustion chamber;

drawing the standing vortex of fuel-air mixture into the combustion chamber as a free vortex of fuel-air mixture;

compressing the fuel-air mixture in the combustion chamber;

igniting the compressed fuel-air mixture in the combustion chamber; and exhausting the combustion chamber after igniting the fuel-air mixture.

16. A method of operating an engine, comprising:

providing a fuel-air mixture to a combustion chamber having an ignition source;

passing the fuel-air mixture over an edge of an inlet to the combustion chamber to create a standing vortex of fuel-air mixture, the edge including a fence formed at a substantially right angle with respect to a line tangential to a rotational movement of a rotor forming at least a portion of the combustion chamber;

drawing the standing vortex of fuel-air mixture into the combustion chamber as a free vortex of fuel-air mixture;

compressing the fuel-air mixture in the combustion chamber;

igniting the compressed fuel-air mixture in the combustion chamber; and exhausting the combustion chamber after igniting the fuel-air mixture.

17. A method of operating an engine, comprising:

providing a fuel-air mixture to a combustion chamber having an ignition source;

creating a vortex in the fuel-air mixture entering the combustion chamber;

accelerating the fuel-air mixture within the combustion chamber relative to the ignition source;

compressing the fuel-air mixture in the combustion chamber;

igniting the compressed fuel-air mixture in the combustion chamber; and venting an exhaust of the ignited fuel-air mixture from the combustion chamber substantially perpendicularly with respect to a movement of a rotor forming at least a portion of the combustion chamber.

18. A method of operating an engine, comprising:

creating a vortex in a fuel-air mixture entering a combustion chamber by passing the fuel-air mixture over an edge, the edge being formed by at least one surface at a substantially right angle to the direction of travel of the combustion chamber;

compressing the fuel-air mixture in the combustion chamber;

igniting the compressed fuel-air mixture in the combustion chamber; and exhausting the combustion chamber after igniting the fuel-air mixture, accelerating the fuel-air mixture within the combustion chamber relative to an ignition source.

19. The method of claim 18, wherein:

accelerating the fuel-air mixture includes accelerating the vortex within the combustion chamber, and the ignition source is located in a stator wall forming at least a portion of the combustion chamber.

20. The method of claim 18, further comprising:

accelerating the fuel-air mixture in the combustion chamber over a compression peak for the fuel-air mixture in the combustion chamber prior to igniting the compressed fuel-air mixture.

21. The method of claim 18 wherein creating a vortex in a fuel-air mixture entering a combustion chamber, comprises creating a standing vortex in the fuel-air mixture at an inlet to the combustion chamber; and creating a sufficiently low pressure in the combustion chamber to draw the fuel-air mixture including the standing vortex into the combustion chamber as a free vortex of fuel-air mixture.

22. The method of claim 18 wherein creating a vortex in a fuel-air mixture entering a combustion chamber, comprises passing the fuel-air mixture over an edge at an inlet to the combustion chamber to crate a standing vortex in the fuel-air mixture; and drawing the standing vortex of fuel-air mixture into the combustion chamber as a free vortex of fuel-air mixture.

23. The method of claim 18 wherein creating a vortex in an fuel-air mixture entering a combustion chamber, comprises passing the fuel-air mixture over a fence proximate an inlet to the combustion chamber to create a standing vortex in the fuel-air mixture; and drawing the standing vortex of fuel-air mixture into the combustion chamber as a free vortex of fuel-air mixture.

24. The method of claim 18 wherein creating a vortex in an fuel-air mixture entering a combustion chamber comprises:

passing the fuel-air mixture over an edge of an inlet to the combustion chamber to create a standing vortex of fuel-air mixture, the edge including a fence formed at a substantially right angle with respect to a line tangential to a rotational movement of a rotor forming at least a portion of the combustion chamber; and drawing the standing vortex of fuel-air mixture into the combustion chamber as a free vortex of fuel-air mixture.

25. The method of claim 18 wherein compressing the fuel-air mixture in the combustion chamber includes reducing a volume of the combustion chamber.

26. The method of claim 18 wherein compressing the fuel-air mixture in the combustion chamber includes reducing the volume of the combustion chamber by reducing an exposed area of a blade forming at least a portion of the combustion chamber.

27. The method of claim 18, further comprising:

drawing the fuel-air mixture into the combustion chamber substantially perpendicularly with respect to a rotor forming at least a portion of the combustion chamber.

28. The method of claim 18, further comprising:

venting an exhaust from the combustion chamber substantially perpendicularly with respect to a rotor forming at least a portion of the combustion chamber.

29. The method of claim 18 wherein igniting the fuel-air mixture in the combustion chamber includes creating an electric spark at an ignition hole formed in a stator wall forming at least a portion of the combustion chamber.

30. The method of claim 18, further comprising:

extracting heat from an exhaust resulting from the combustion of the fuel-air mixture.

31. The method of claim 18, further comprising:

expanding an exhaust resulting from the combustion of the fuel-air mixture to recover energy from the exhaust.

32. A method of operating an engine comprising:

lowering the combustible fuel-air lean mixture flammability limit of a fuel-air mixture in a combustion chamber to an equivalence below approximately 0.7, by passing the fuel-air mixture through an inlet to the combustion chamber over an edge formed by at least one surface at a substantially right angle to the direction of travel of the combustion chamber to create a vortex in the fuel-air mixture entering the combustion chamber;

compressing the fuel-air mixture in the combustion chamber;

igniting the compressed fuel-air mixture in the combustion chamber; and exhausting the combustion chamber after igniting the fuel-air mixture.

33. The method of claim 32, wherein lowering the combustible fuel-air lean mixture flammability limit of a fuel-air mixture, comprises:

reducing a combustion time of the compressed fuel-air mixture within the combustion chamber.

34. The method of claim 32, wherein lowering the combustible fuel-air lean mixture flammability limit of a fuel-air mixture, includes:

accelerating the fuel-air mixture within the combustion chamber relative to an ignition source.

35. The method of claim 32, wherein lowering the combustible fuel-air lean mixture flammability limit of a fuel-air mixture, includes:

accelerating the fuel-air mixture within the combustion chamber relative to an ignition source in a stator wall that forms at least a portion of the combustion chamber.

36. The method of claim 32, further comprising:

injecting a fuel into air within the combustion chamber to create the fuel-air mixture.

37. The method of claim 32, further comprising:

increasing a velocity of the fuel-air mixture in the combustion chamber over a compression peak for the fuel-air mixture in the combustion chamber prior to igniting the compressed fuel-air mixture.

38. The method of claim 32, wherein lowering the combustible fuel-air lean mixture flammability limit of a fuel-air mixture, includes:

creating a vortex in a fuel-air mixture entering a combustion chamber.

39. The method of claim 32 wherein compressing the fuel-air mixture in the combustion chamber includes reducing a volume of the combustion chamber.

40. The method of claim 32, further comprising:

drawing the fuel-air mixture into the combustion chamber substantially perpendicularly with respect to a rotor forming at least a portion of the combustion chamber.

41. A method of operating an engine, comprising:

lowering the combustible fuel-air lean mixture flammability limit of a fuel-air mixture in a combustion chamber to an equivalence below 0.3 by passing the fuel-air mixture through an inlet to the combustion chamber over an edge formed by at least one surface at a substantially right angle to the direction of travel of the combustion chamber to create a vortex in the fuel-air mixture entering the combustion chamber;

compressing the fuel-air mixture in the combustion chamber;

igniting the compressed fuel-air mixture in the combustion chamber; and exhausting the combustion chamber after igniting the fuel-air mixture.

42. A method of operating an engine, comprising:

passing a fuel-air mixture over an edge of an inlet to a combustion chamber to create a standing vortex of fuel-air mixture, the edge including a fence formed at a substantially right angle with respect to a line tangential to a rotational movement of a rotor forming at least a portion of the combustion chamber;

drawing the standing vortex of fuel-air mixture into the combustion chamber as a free vortex of fuel-air mixture;

lowering the combustible fuel-air lean mixture flammability limit of a fuel-air mixture to an equivalence below approximately 0.7, by attaining faster combustion of the compressed fuel-air mixture within the combustion chamber;

compressing the fuel-air mixture in the combustion chamber;

igniting the compressed fuel-air mixture in the combustion chamber; and exhausting the combustion chamber after igniting the fuel-air mixture.

43. A method of operating an engine, comprising:

lowering the combustible fuel-air lean mixture flammability limit of a fuel-air mixture to an equivalence below approximately 0.7, by attaining faster combustion of the compressed fuel-air mixture within the combustion chamber;

compressing the fuel-air mixture in the combustion chamber;

igniting the compressed fuel-air mixture in the combustion chamber; and exhausting the combustion chamber after igniting the fuel-air mixture; and venting an exhaust from the combustion chamber substantially perpendicularly with respect to a motion of a rotor forming at least a portion of the combustion chamber.

44. In a closed vessel, positive displacement internal combustion type heat engine having at least two combustion chambers that travel at a substantial velocity relative to a pair of opposed stator walls, the combustion chambers formed by the stator walls and at least two rotor blades carried by a rotor shaft and extending through respective slots formed in a rotor disk, the stator walls including an intake port and an exhaust port, the intake port formed radially inward of the exhaust port, and wherein the stator walls and the rotor blades successively compress and expand volumes enclosed by the combustion chambers during the travel and involving the following acts to facilitate an advanced method of closed vessel combustion and associated flow duct operation to perform complete thermodynamic cycles, the method comprising:

mixing a volume of fuel and a volume of air to form a fuel-air mixture having a near homogenous combustible equivalence ratio;

inducing the fuel-air mixture to flow through the inlet port into the combustion chambers at substantial flow velocities;

separating the fuel-air mixture from the stator wall to form a standing vortex at a forward end of said inlet port;

advancing a trailing rotor blade to close the inlet port to trap the vortex in the combustion chamber;

accelerating the vortex along with the combustion chamber to travel at the speed of the combustion chamber while maintaining a circulatory radial motion of the vortex in the combustion chamber, such that the increased combustion chamber internal flow velocity lowers a combustible fuel-air lean mixture flammability limit of the fuel-air mixture, and in combination with an elevated compression pressure and an elevated temperature increases a combustion chamber ignition temperature and an internal combustion velocity;

adding heat to the fuel-air mixture from the rotor disk that is otherwise uncooled while compressing the fuel-air mixture in the combustion chamber without causing pre-ignition, wherein the combustion chamber is capable of operating on rich and lean fuel-air mixtures using multi-octane and multi fuel combustion;

further compressing the fuel-air mixture in the combustion chambers to pass the fuel-air mixture over a compression peak to an expanding leading volume of the combustion chambers downstream of the compression peak at a substantial speed relative to the stator wall and the rotor disk;

igniting the fuel-air mixture with an electric spark introduced through an ignition port in the stator wall during the flow through a passage;

introducing an electric spark at a location in a thermodynamic cycle of the engine such that auto-ignition from hot gases is prevented, while the combustion chamber ignition temperature, an ignition spark timing, and a number of ignition sparks facilitate optimum engine torque;

controlling the fuel, the compression process speed and a combustion chamber leakage rate to prevent fuel-air mixture pre-ignition;

developing torque about the rotor shaft by means of the elevated pressure acting on differentially exposed portions of the rotor blades and a constant torque arm to the rotor shaft in response to compression in the combustion chambers before and expansion after flow through the passage; and exhausting products of combustion from the combustion chambers to the atmosphere through the exhaust port during expansion at an angle near perpendicular to the rotor disk to prevent an unbalanced force reaction against a trailing one of the rotor blades.

* * * * *